US010242653B2

(12) United States Patent
Hayashi et al.

(10) Patent No.: US 10,242,653 B2
(45) Date of Patent: Mar. 26, 2019

(54) DISPLAY DEVICE

(71) Applicant: Japan Display Inc., Tokyo (JP)

(72) Inventors: Shuji Hayashi, Tokyo (JP); Takayuki Nakanishi, Tokyo (JP)

(73) Assignee: Japan Display Inc., Tokyo (JP)

( * ) Notice: Subject to any disclaimer, the term of this patent is extended or adjusted under 35 U.S.C. 154(b) by 2 days.

(21) Appl. No.: 15/228,447

(22) Filed: Aug. 4, 2016

(65) Prior Publication Data

US 2017/0053624 A1 Feb. 23, 2017

(30) Foreign Application Priority Data

Aug. 19, 2015 (JP) ..... 2015-161631

(51) Int. Cl.
*G09G 5/391* (2006.01)
*G09G 3/20* (2006.01)

(52) U.S. Cl.
CPC ..... *G09G 5/391* (2013.01); *G09G 3/2003* (2013.01); *G09G 2300/0452* (2013.01)

(58) Field of Classification Search
CPC ..... G09G 5/391; G09G 3/2003; G09G 2300/0452
See application file for complete search history.

(56) References Cited

U.S. PATENT DOCUMENTS 7,583,279 B2 * 9/2009 Brown Elliott ... G02F 1/133514 345/694
7,876,341 B2 * 1/2011 Credelle ..... G09G 3/2003 345/690
2003/0128225 A1 7/2003 Credelle et al.
2005/0225563 A1 10/2005 Brown Elliott et al.
2005/0225575 A1 10/2005 Brown Elliott et al.
2007/0030284 A1 * 2/2007 Ogasawara ..... G09G 3/2003 345/589
2010/0118045 A1 5/2010 Brown Elliott et al.
2012/0287147 A1 * 11/2012 Brown Elliott ..... G09G 5/02 345/593
2014/0002431 A1 * 1/2014 Shibata ..... G09G 3/3614 345/208
2014/0204321 A1 * 7/2014 Koh ..... G02F 1/133514 349/109

(Continued)

FOREIGN PATENT DOCUMENTS

JP 2007-532949 A 11/2007
JP 2007-532999 A 11/2007

(Continued)

*Primary Examiner* — Nitin Patel
*Assistant Examiner* — Robert M Stone
(74) *Attorney, Agent, or Firm* — Michael Best & Friedrich LLP

(57) ABSTRACT

According to an aspect, a display device includes a display panel including sub-pixels of three primary colors, and pixels having a high-luminance color having higher luminance than that of the primary colors. The three primary colors include a first primary color, a second primary color, and a third primary color. The number of the sub-pixels is smaller than twice the number of the pixels, sub-pixels of the same color are arranged at even intervals in a row direction and at even intervals in a column direction, and the sub-pixels of the same color are arranged in a staggered manner.

1 Claim, 47 Drawing Sheets

(56) References Cited

U.S. PATENT DOCUMENTS

| | | | | |
|---|---|---|---|---|
| 2014/0285542 | A1* | 9/2014 | Izumi | G09G 3/2003 345/694 |
| 2014/0313112 | A1* | 10/2014 | Madhusudan | G09G 3/3208 345/83 |
| 2015/0116375 | A1* | 4/2015 | Yang | G09G 3/2003 345/690 |
| 2015/0187301 | A1* | 7/2015 | Yoon | G09G 3/36 345/88 |
| 2016/0171917 | A1* | 6/2016 | Yang | G09G 3/2003 345/694 |
| 2016/0284768 | A1* | 9/2016 | Phan | H01L 27/3213 |
| 2017/0200428 | A1* | 7/2017 | Song | G09G 5/003 |
| 2017/0256193 | A1* | 9/2017 | Zhou | G09G 3/2003 |

FOREIGN PATENT DOCUMENTS

| | | | |
|---|---|---|---|
| JP | 2011-505017 | A | 2/2011 |
| JP | 2011-164464 | A | 8/2011 |

* cited by examiner

49B
Pix
48
49B
Pix
48
49B
48
Pix
49G
48
Pix
49R
48
Pix
49B
48
Pix
49G
48
49R
48
Pix
49R
48
R
W
B
W
G
W
R
W
B
W
G
W
R
W
B
W
G
W 49L
48L
Pix
49L
49R
48L
Pix
49L
49G
49G
48
49B
Pix
49R
48
49G
Pix
49B
48
Pix
49R
48
Pix
49B
48
Pix
49G
48
49G
48
Pix
48
Pix
48
Pix 49G
49B
48
49G
48
49R
49B
48
49G
49L
48L
48
49L
49R
48L
48
49L
49G
W
B
R
G
W
W
W

DISPLAY DEVICE

CROSS-REFERENCE TO RELATED APPLICATIONS

This application claims priority from Japanese Application No. 2015-161631, filed on Aug. 19, 2015, the contents of which are incorporated by reference herein in its entirety.

BACKGROUND

1. Technical Field

The present invention relates to a display device.

2. Description of the Related Art

Known are display devices in which one pixel includes four sub-pixels of red (R), green (G), blue (B), and white (W) (refer to Japanese Patent Application Laid-open Publication No. 2011-164464; hereinafter referred to as JP-A-2011-164464).

To achieve higher resolution in such display devices disclosed in JP-A-2011-164464, only a very small mounting area can be assigned to one sub-pixel because four such sub-pixels each smaller than one pixel are provided in the pixel, resulting in the problem that a thin-film transistor (TFT) and a color filter are difficult to be mounted. Thus, a method is required to make it easier to secure the area assigned to one sub-pixel to achieve higher resolution.

For the foregoing reasons, there is a need for a display device that can reduce the degree of decrease in the mounting area assigned to one sub-pixel associated with the increase in the resolution. Also there is a need for a display device that can more easily achieve both higher resolution and securement of the area for the sub-pixel.

SUMMARY

According to an aspect, a display device includes a display panel including: sub-pixels of three primary colors, and pixels having a high-luminance color having higher luminance than that of the primary colors. The three primary colors include a first primary color, a second primary color, and a third primary color. The number of the sub-pixels is smaller than twice the number of the pixels, sub-pixels of the same color are arranged at even intervals in a row direction and at even intervals in a column direction, and the sub-pixels of the same color are arranged in a staggered manner.

According to another aspect, a display device includes a display panel including: sub-pixels of three primary colors, and pixels having a high-luminance color having higher luminance than that of the primary colors. The three primary colors include a first primary color, a second primary color, and a third primary color. The number of the sub-pixels is smaller than twice the number of the pixels, and sub-pixels of the same color are arranged in a matrix along row and column directions.

DETAILED DESCRIPTION

Figure 1:
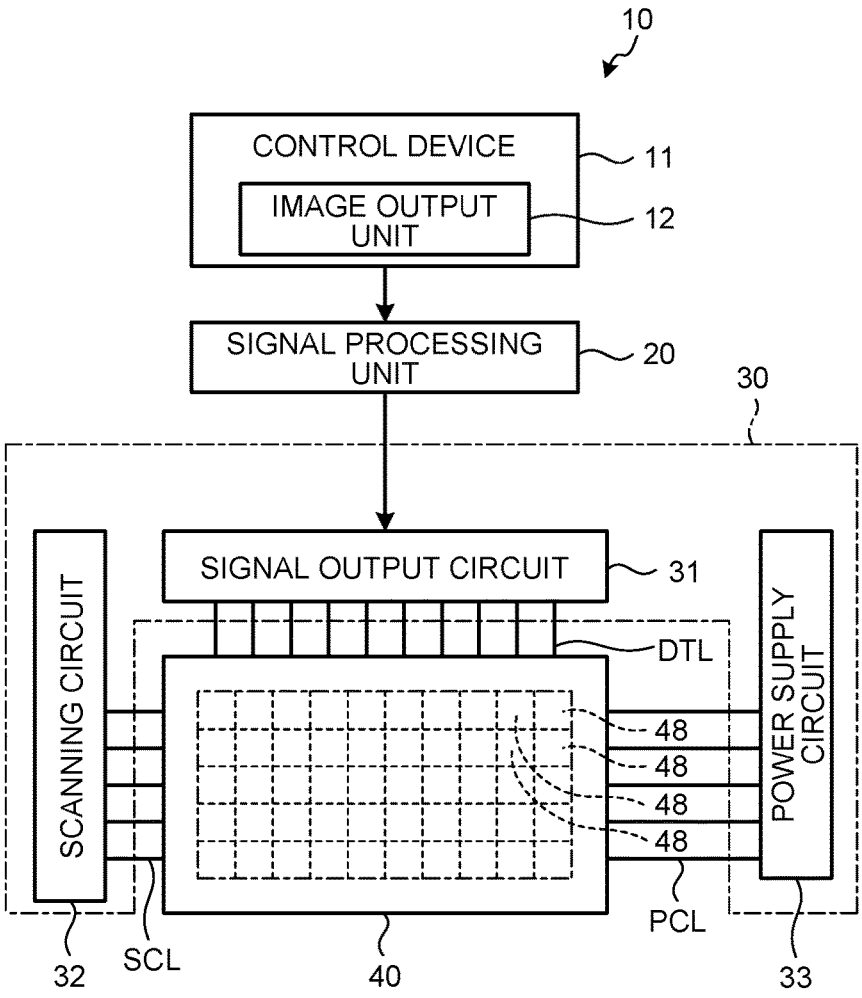
FIG. 1 is a block diagram illustrating an example of a configuration of a display device according to a first embodiment.

The following describes embodiments of the present invention with reference to the accompanying drawings. The disclosure is merely an example, and the present invention naturally encompasses appropriate modifications maintaining the gist of the present invention that is easily conceivable by those skilled in the art. To further clarify the description, the width, the thickness, the shape, and the like of each component may be schematically illustrated in the drawings as compared with an actual aspect. However, this is merely an example and interpretation of the present invention is not limited thereto. The same elements as those described in the drawings that have already been discussed are denoted by the same reference signs through the description and the drawings, and detailed descriptions thereof will not be repeated in some cases.

First Embodiment

FIG. 1 is a block diagram illustrating an example of a configuration of a display device 10 according to a first embodiment. As illustrated in FIG. 1, the display device 10 according to the first embodiment includes a signal processing unit 20, an image-display-panel driving unit 30, and an image display panel 40. The signal processing unit 20 is a circuit that receives an input signal from an image output unit 12 of a control device 11, generates a signal by performing predetermined data conversion processing on the input signal, and transmits the resultant signal to components of the display device 10.

The input signal indicates gradation values of pixel data constituting an image to be displayed by the display device 10. The image to be displayed by the display device 10 is received as the input signal corresponding to a plurality of pieces of pixel data constituting the image. The gradation values indicated by the input signal are what is called RGB data, and can be represented in the form of, for example, (R, G, B)=(a, b, c). a, b, and c are values indicating the gradation values, and each have a value within a range corresponding to the number of bits of the input signal. For example, if red (R), green (G), and blue (B) are each represented by an 8-bit signal, each of a, b, and c has any value in the range from 0 to 255. In the first embodiment, one set of the RGB data (R, G, B)=(a, b, c) indicated by the input signal is output using one unit pixel region Pix (refer to FIG. 7 and other figures). Not only in the first embodiment, but in the present invention, a pixel 48 in a unit pixel region Pix is used to output, at least, a white component extracted from the input signal.

The image-display-panel driving unit 30 is a circuit that controls the driving of the image display panel 40 based on the signal from the signal processing unit 20. The image display panel 40 is a self-luminous type image display panel that displays an image by causing a self-luminous body of the pixel 48 and sub-pixels 49 (refer to FIG. 2) to be lit based on the signal from the image-display-panel driving unit 30.

Figure 2:
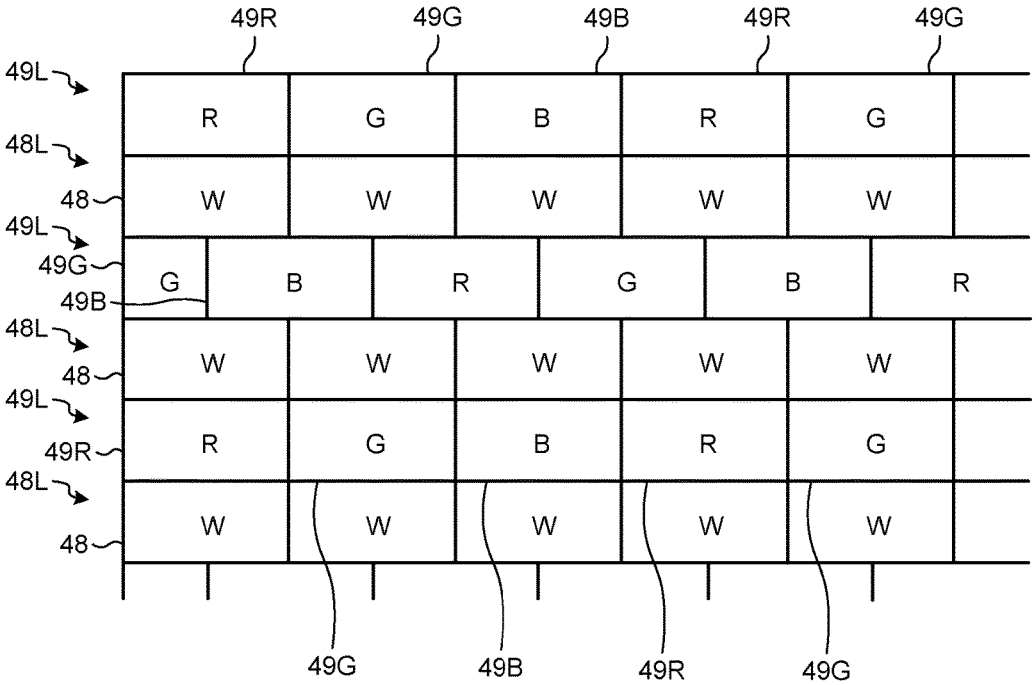
FIG. 2 is a diagram illustrating an arrangement of pixels and sub-pixels of an image display panel according to the first embodiment.

FIG. 2 is a diagram illustrating an arrangement of the pixels 48 and the sub-pixels 49 of the image display panel 40 according to the first embodiment. The image display panel 40 includes pixel rows 48L constituted by a plurality of pixels 48 arranged in the row direction and sub-pixel rows 49L each constituted by a plurality of sub-pixels 49 arranged in the row direction. In the image display panel 40, the pixel rows 48L and the sub-pixel rows 49L are alternately arranged along a column direction. With a focus only on the pixels 48 constituting the pixel rows 48L, the pixels 48 are arranged in a matrix. With a focus only on the sub-pixels 49 constituting the sub-pixel rows 49L, the sub-pixels 49 are arranged in a staggered manner. The row direction and the column direction can be referred to as "a first direction and a second direction that are two directions orthogonal to each other". When the first direction is the row direction, the second direction is the column direction. When the first direction is the column direction, the second direction is the row direction.

The color of each of the sub-pixels 49 is any one of a first primary color, a second primary color, and a third primary color. Specifically, as illustrated, for example, in FIG. 2, the color of the sub-pixel 49 according to the first embodiment is any one of red (R) as the first primary color, green (G) as the second primary color, and blue (B) as the third primary color. That is, the image display panel 40 includes the sub-pixels 49 of three primary colors including the first, the second, and the third primary colors. In FIG. 2, a character "R" representing red (R) denotes a first sub-pixel 49R, a character "G" representing green (G) denotes a second sub-pixel 49G, and a character "B" representing blue (B) denotes a third sub-pixel 49B.

Figure 3:
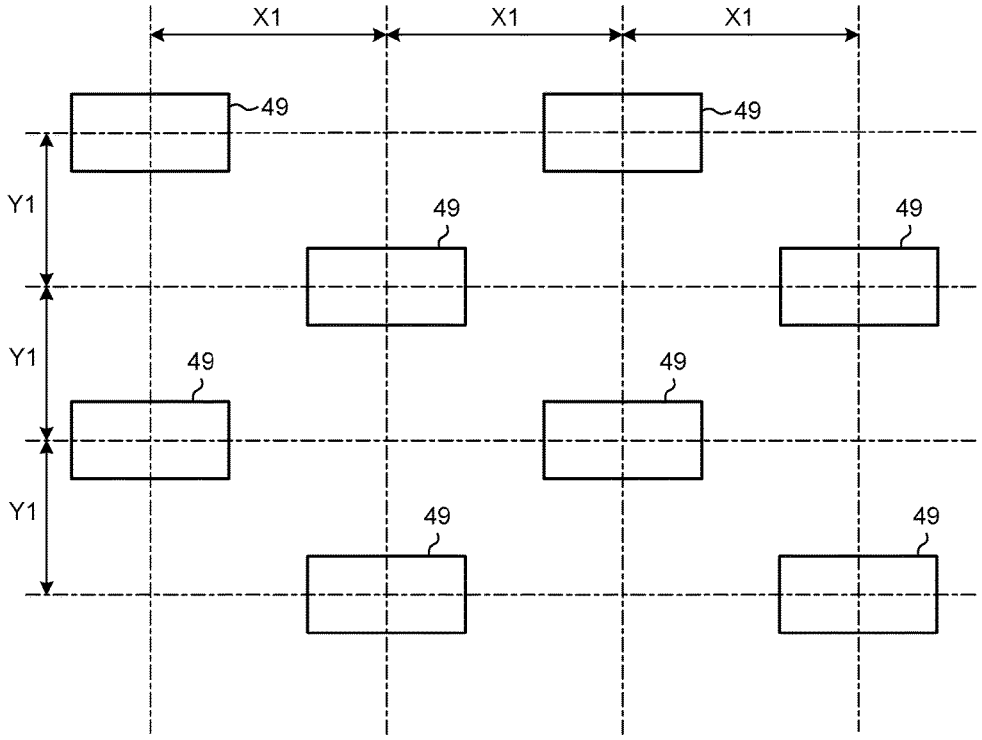
FIG. 3 is a diagram illustrating an arrangement of sub-pixels of the same color according to the first embodiment.

FIG. 3 is a diagram illustrating an arrangement of sub-pixels 49 of the same color according to the first embodiment. In the first embodiment, the sub-pixels 49 of the same color are arranged at even intervals in the row direction and at even intervals in the column direction. The arrangement of the sub-pixels 49 of the same color refers to an arrangement determining a positional relation of a plurality of sub-pixels 49 having a color limited to any one of, for example, red (R), green (G), and blue (B). Specifically, as illustrated in FIG. 3, the sub-pixels 49 of the same color are arranged in a staggered manner. The sub-pixels 49 of the same color arranged in a staggered manner are spaced at uniform distances X1 in the row direction, thus being arranged at even intervals in the row direction. The sub-pixels 49 of the same color arranged in a staggered manner are spaced at uniform distances Y1 in the column direction, thus being arranged at even intervals in the column direction.

The sub-pixels 49 are arranged so that the sub-pixel of the first primary color, the sub-pixel of the second primary color, and the sub-pixel of the third primary color are adjacent to each of the pixels 48. Specifically, as illustrated in FIG. 2 for example, the sub-pixels 49 are arranged so that the first sub-pixel 49R as the sub-pixel of red (R), the second sub-pixel 49G as the sub-pixel of green (G), and the third sub-pixel 49B as the sub-pixel of blue (B) are adjacent to one pixel 48. Hereinafter, in descriptions in which the first sub-pixel 49R, the second sub-pixel 49G, and the third sub-pixel 49B are not required to be distinguished from each other, or in which all of the sub-pixels 49R, 49G, and 49B are included, the sub-pixels 49R, 49G, and 49B may be simply described as the sub-pixels 49.

More specifically, the ratio among the numbers of the first sub-pixels 49R, the second sub-pixels 49G, and the third sub-pixels 49B is 1:1:1. In the first embodiment, the sub-pixels 49 are arranged so that one first sub-pixel 49R, one second sub-pixel 49G, and one third sub-pixel 49B are adjacent to one pixel 48. In each of the sub-pixel rows 49L, the first sub-pixel 49R, the second sub-pixel 49G, and the third sub-pixel 49B are periodically arranged along the row direction. In the example illustrated in FIG. 2, the sub-pixels 49 are arranged so that the colors of the sub-pixels are periodically arranged from the left side to the right side in the order of the first sub-pixel 49R, the second sub-pixel 49G, and the third sub-pixel 49B. However, the order of arrangement of the colors of the sub-pixels 49 can be appropriately changed.

The color of the pixel 48 is a high-luminance color having higher luminance than that of the colors of the sub-pixels 49. Specifically, as illustrated, for example, in FIG. 2, the color of the pixel according to the first embodiment is white (W) as a high-luminance color. In FIG. 2, a character "W" representing white (W) denotes the pixel 48.

Figure 4:
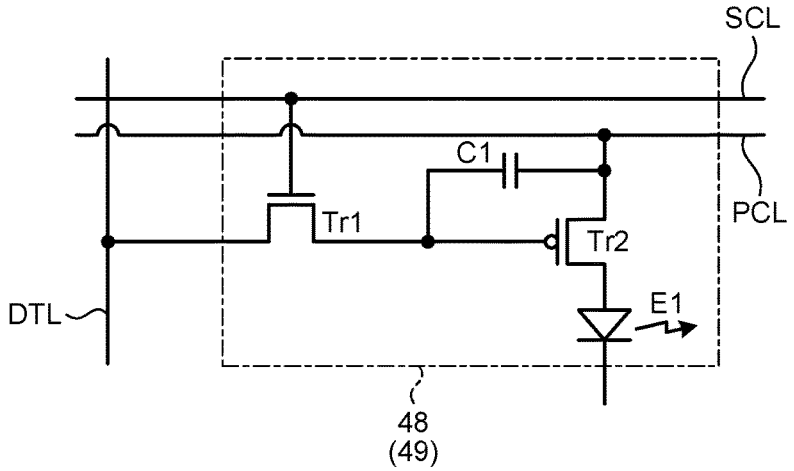
FIG. 4 is a diagram illustrating a lighting drive circuit for the pixels and the sub-pixels of the image display panel according to the first embodiment.
Figure 5:
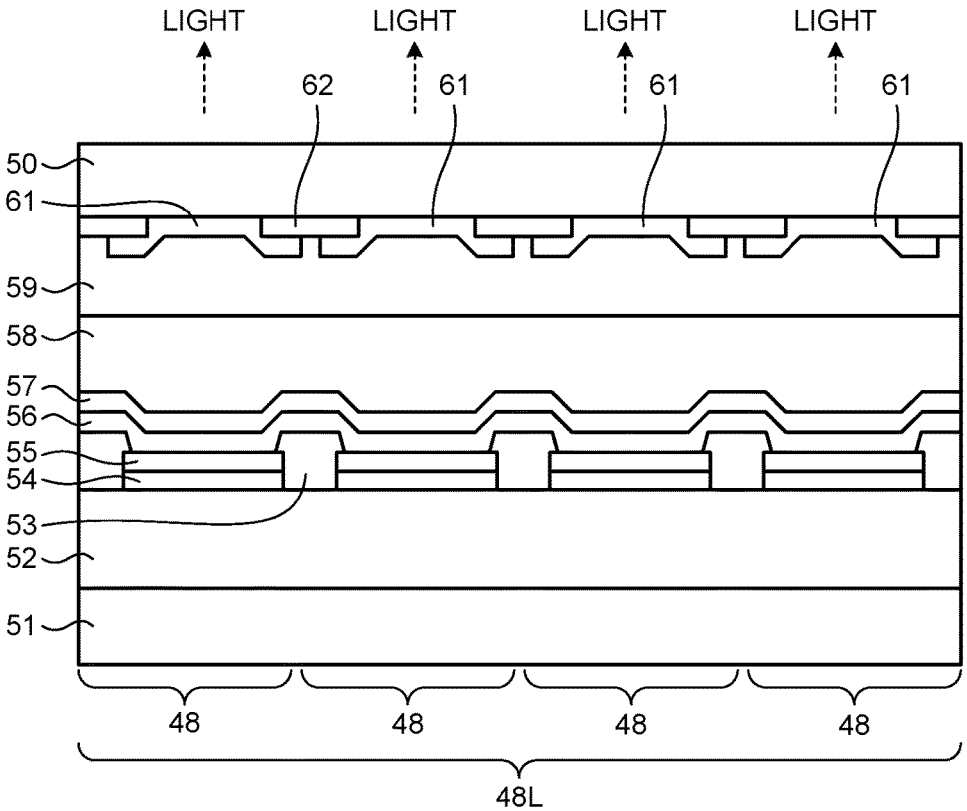
FIG. 5 is a diagram illustrating a sectional structure of the image display panel according to the first embodiment.
Figure 6:
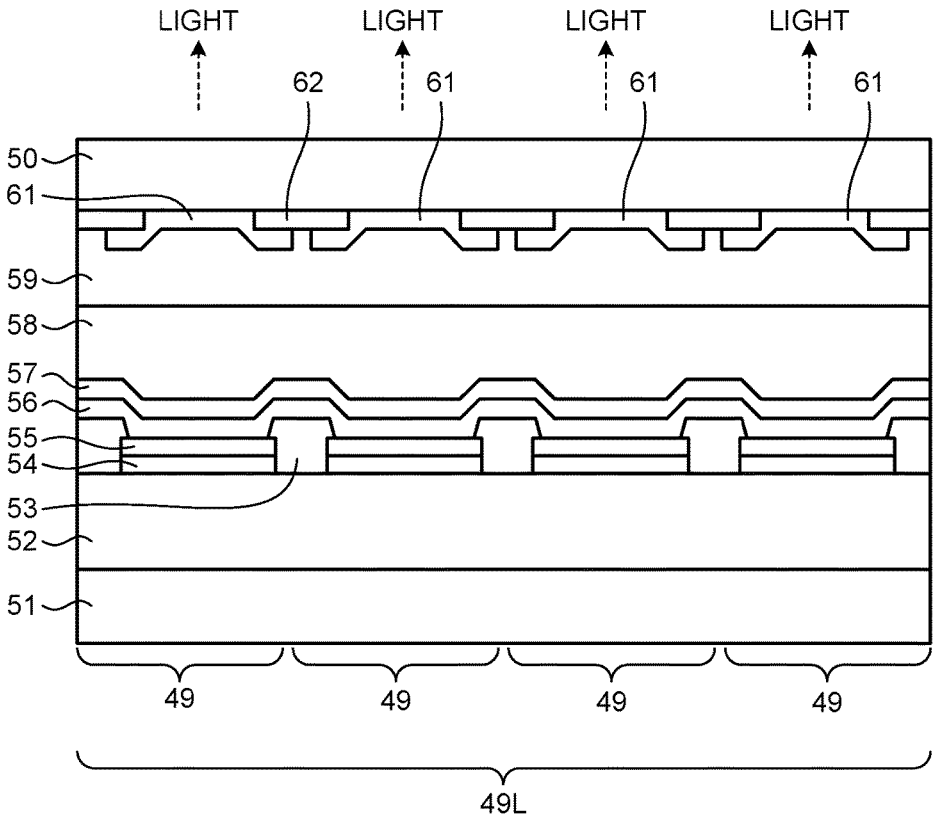
FIG. 6 is a diagram illustrating a sectional structure of the image display panel according to the first embodiment.

FIG. 4 is a diagram illustrating a lighting drive circuit for the pixels 48 and the sub-pixels 49 of the image display panel 40 according to the first embodiment. FIGS. 5 and 6 are diagrams illustrating a sectional structure of the image display panel according to the first embodiment. The pixel 48 and the sub-pixel 49 each include a lighting drive circuit. Specifically, as illustrated in FIG. 4, the lighting drive circuit includes a control transistor Tr1, a driving transistor Tr2, and a charge holding capacitor C1. A gate of the control transistor Tr1 is coupled to a scanning line SCL, a source thereof is coupled to a signal line DTL, and a drain thereof is coupled to a gate of the driving transistor Tr2. One end of the charge holding capacitor C1 is coupled to the gate of the driving transistor Tr2, and the other end thereof is coupled to a source of the driving transistor Tr2. The source of the driving transistor Tr2 is coupled to a power supply line PCL, and a drain of the driving transistor Tr2 is coupled to an anode of an organic light emitting diode E1 serving as a self-luminous body. A cathode of the organic light emitting diode E1 is coupled, for example, to a reference potential (for example, a ground potential). FIG. 4 illustrates an example in which the control transistor Tr1 is an n-channel transistor and the driving transistor Tr2 is a p-channel transistor. However, a polarity of each transistor is not limited thereto. The polarity of each of the control transistor Tr1 and the driving transistor Tr2 may be determined as needed.

The image-display-panel driving unit 30 is a control device for the image display panel 40, and includes a signal output circuit 31, a scanning circuit 32, and a power supply circuit 33. The signal output circuit 31 is electrically coupled to the image display panel 40 via the signal line DTL. The signal output circuit 31 holds input image output signals, and sequentially outputs the image output signals to the pixel 48 and the sub-pixel 49 (hereinafter, referred to as a pixel and the like) of the image display panel 40. The scanning circuit 32 is electrically coupled to the image display panel 40 via the scanning line SCL. The scanning circuit 32 selects the pixel and the like in the image display panel, and controls ON/OFF of a switching element (for example, a TFT) for controlling an operation (light emission intensity) of the pixel and the like. The power supply circuit 33 supplies electric power to the organic light emitting diode E1 of the pixel and the like via the power supply line PCL.

As illustrated in FIGS. 5 and 6, the image display panel 40 includes a substrate 51, insulating layers 52 and 53, a reflective layer 54, a lower electrode 55, a self-luminous layer 56, an upper electrode 57, insulating layers 58 and 59, a color filter 61 serving as a color conversion layer, a black matrix 62 serving as a light shielding layer, and a substrate 50. The substrate 51 is a semiconductor substrate made of silicon and the like, a glass substrate, a resin substrate, and the like, and forms or holds the lighting drive circuit and the like. The insulating layer 52 is a protective film that protects the lighting drive circuit and the like, and may be made of silicon oxide, silicon nitride, and the like. The lower electrode 55 is provided to each of the pixel 48 and the sub-pixel 49, and is an electric conductor serving as an anode (positive pole) of the organic light emitting diode E1 described above. The lower electrode 55 is a translucent electrode made of a translucent conductive material (translucent conductive oxide) such as indium tin oxide (ITO). The insulating layer 53 is an insulating layer that is called a bank and partitions the first sub-pixel 49R, the second sub-pixel 49G, the third sub-pixel 49B, and the pixel 48 from each other. The reflective layer 54 is made of a material having metallic luster that reflects light from the self-luminous layer 56 such as silver, aluminum, and gold. The self-luminous layer 56 includes an organic material, and includes a hole injection layer, a hole transport layer, a light emitting layer, an electron transport layer, and an electron injection layer (not illustrated).

As a layer that generates positive holes, for example, it is preferable to use a layer including an aromatic amine compound and a substance exhibiting an electron accepting property to the compound. The aromatic amine compound is a substance having an arylamine skeleton. Among aromatic amine compounds, especially preferred is an aromatic amine compound including triphenylamine in the skeleton thereof and having a molecular weight of 400 or more. Among aromatic amine compounds including triphenylamine in the skeleton thereof, especially preferred is an aromatic amine compound including a condensed aromatic ring such as a naphthyl group in the skeleton thereof. When the aromatic amine compound including triphenylamine and a condensed aromatic ring in the skeleton thereof is used, heat resistance of a light emitting element is improved. Specific examples of the aromatic amine compound include, but are not limited to, 4,4'-bis[N-(1-naphthyl)-N-phenylamino]biphenyl (abbreviated as α-NPD), 4,4'-bis[N-(3-methylphenyl)-N-phenylamino]biphenyl (abbreviated as TPD), 4,4',4"-tris(N,N-diphenylamino)triphenylamine (abbreviated as TDATA), 4,4',4"-tris[N-(3-methylphenyl)-N-phenylamino]triphenylamine (abbreviated as MTDATA), 4,4'-bis[N-{4-(N,N-di-m-tolylamino)phenyl}-N-phenylamino]biphenyl (abbreviated as DNTPD), 1,3,5-tris[N,N-di(m-tolyl)amino]benzene (abbreviated as m-MTDAB), 4,4',4"-tris(N-carbazolyl)triphenylamine (abbreviated as TCTA), 2,3-bis(4-diphenylaminophenyl) quinoxaline (abbreviated as TPAQn), 2,2',3,3'-tetrakis(4-diphenylaminophenyl)-6,6'-bisquinoxaline (abbreviated as D-TriPhAQn), 2,3-bis {4-[N-(1-naphthyl)-N-phenylamino]phenyl}-dibenzo[f,h]quinoxaline (abbreviated as NPADiBzQn), etc. The substance exhibiting the electron accepting property to the aromatic amine compound is not specifically limited. For example, molybdenum oxide, vanadium oxide, 7,7,8,8-tetracyanoquinodimethane (abbreviated as TCNQ), and 2,3,5,6-tetrafluoro-7,7,8,8-tetracyanoquinodimethane (abbreviated as F4-TCNQ) can be used as the substance.

An electron transport substance is not specifically limited. For example, as the electron transport substance, metal complex such as tris(8-quinolinolato)aluminum (abbreviated as $Alq_3$), tris(4-methyl-8-quinolinolato)aluminum (abbreviated as $Almq_3$), bis(10-hydroxybenzo[h]-quinolinato) beryllium (abbreviated as $BeBq_2$), bis(2-methyl-8-quinolinolato)-4-phenylphenolate-aluminum (abbreviated as BAlq), bis[2-(2-hydroxyphenyl)benzoxazolato]zinc (abbreviated as $Zn(BOX)_2$), and bis[2-(2-hydroxyphenyl)benzothiazolato]zinc (abbreviated as $Zn(BTZ)_2$) can be used, and 2-(4-biphenylyl)-5-(4-tert-butylphenyl)-1,3,4-oxadiazole (abbreviated as PBD), 1,3-bis[5-(p-tert-butylphenyl)-1,3,4-oxadiazole-2-yl]benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), bathocuproin (abbreviated as BCP), and the like can also be used. A substance exhibiting an electron donating property to the electron transport substance is not specifically limited. For example, an alkali metal such as lithium and cesium, an alkaline-earth metal such as magnesium and calcium, and a rare earth metal such as erbium and ytterbium can be used as the substance. A substance selected from among alkali metal oxides and alkaline-earth metal oxides such as lithium oxide ($Li_2O$), calcium oxide (CaO), sodium oxide ($Na_2O$), potassium oxide ($K_2O$), and magnesium oxide (MgO) may be used as the substance exhibiting the electron donating property to the electron transport substance.

For example, to obtain red-based light emission, a substance exhibiting light emission having a peak of emission spectrum in a range from 600 nm to 680 nm can be used, such as 4-dicyanomethylene-2-isopropyl-6-[2-(1,1,7,7-tetramethyljulolidine-9-yl) ethenyl]-4H-pyrane (abbreviated as DCJTI), 4-dicyanomethylene-2-methyl-6-[2-(1,1,7,7-tetramethyljulolidine-9-yl) ethenyl]-4H-pyrane (abbreviated as DCJT), 4-dicyanomethylene-2-tert-butyl-6-[2-(1,1,7,7-tetramethyljulolidine-9-yl) ethenyl]-4H-pyrane (abbreviated as DCJTB), periflanthene, and 2,5-dicyano-1,4-bis[2-(10-methoxy-1,1,7,7-tetramethyljulolidine-9-yl) ethenyl]benzene. To obtain green-based light emission, a substance exhibiting light emission having a peak of emission spectrum in a range from 500 nm to 550 nm can be used, such as N,N'-dimethylquinacridone (abbreviated as DMQd), coumarin 6, coumarin 545T, and tris(8-quinolinolato)aluminum (abbreviated as $Alq_3$). To obtain blue-based light emission, a substance exhibiting light emission having a peak of emission spectrum in a range from 420 nm to 500 nm can be used, such as 9,10-bis(2-naphthyl)-tert-butylanthracene (abbreviated as t-BuDNA), 9,9'-bianthryl, 9,10-diphenylanthracene (abbreviated as DPA), 9,10-bis(2-naphthyl) anthracene (abbreviated as DNA), bis(2-methyl-8-quinolinolato)-4-phenylphenolate-gallium (abbreviated as BGaq), and bis(2-methyl-8-quinolinolato)-4-phenylphenolate-aluminum (abbreviated as BAlq). In addition to the substances that emit fluorescence as described above, substances that emit phosphorescence can also be used as light-emitting substances, such as bis[2-(3,5-bis(trifluoromethyl)phenyl)pyridinato-N,C2']iridium (III) picolinate (abbreviated as $Ir(CF_3ppy)_2(pic)$), bis[2-(4,6-difluorophenyl)pyridinato-N,C2']iridium (III) acetylacetonate (abbreviated as FIr(acac)), bis[2-(4,6-difluorophenyl)pyridinato-N,C2']iridium (III) picolinate (abbreviated as FIr(pic)), and tris(2-phenylpyridinato-N,C2') iridium (abbreviated as $Ir(ppy)_3$).

The upper electrode 57 is a translucent electrode made of a translucent conductive material (translucent conductive oxide) such as indium tin oxide (ITO). In the first embodiment, ITO is exemplified as the translucent conductive material, but the translucent conductive material is not limited thereto. As the translucent conductive material, a conductive material having another composition such as indium zinc oxide (IZO) may be used. The upper electrode 57 functions as a cathode (negative pole) of the organic light emitting diode E1. The insulating layer 58 is a sealing layer that seals the upper electrode described above, and can be made of silicon oxide, silicon nitride, and the like. The insulating layer 59 is a planarization layer for preventing unevenness from being generated due to the bank, and can be made of silicon oxide, silicon nitride, and the like. The substrate 50 is a translucent substrate that protects the entire image display panel 40, and can be a glass substrate, for example. FIGS. 5 and 6 illustrate an example in which the lower electrode 55 is the anode (positive pole) and the upper electrode 57 is the cathode (negative pole), but the embodiment is not limited thereto. The lower electrode 55 may be the cathode and the upper electrode 57 may be the anode. In this case, the polarity of the driving transistor Tr2 electrically coupled to the lower electrode 55 can be appropriately changed, and a stacking order of a carrier injection layer (the hole injection layer and the electron injection layer), a carrier transport layer (the hole transport layer and the electron transport layer), and the light emitting layer can be appropriately changed.

The image display panel 40 is a color display panel, and the color filter 61 that transmits light, from among light emitting components of the self-luminous layer 56, having a color corresponding to the color of the sub-pixel 49 is arranged between the sub-pixel 49 and an image observer. The image display panel 40 can emit light having a color corresponding to red (R), green (G), blue (B), and white (W). The color filter 61 is not necessarily arranged between the pixel 48 corresponding to white (W) and the image observer. In the image display panel 40, the light emitting component of the self-luminous layer 56 can emit light of each color of the first sub-pixel 49R, the second sub-pixel 49G, the third sub-pixel 49B, and the pixel 48 without using the color conversion layer such as the color filter 61. For example, in the image display panel 40, a transparent resin layer may be provided to the pixel 48 in place of the color filter 61 for color adjustment. In this way, the image display panel 40 thus provided with the transparent resin layer can suppress the occurrence of a large gap above the pixel 48.

The present embodiment illustrates the example of arranging the color filter 61 that transmits light having a color corresponding to the color of the sub-pixel 49. However, the present invention is not limited to this example. The self-luminous layer 56 that emits light in colors corresponding to red (R), green (G), blue (B), and, if necessary, other colors may be used, and the color filter may not be provided in the image display panel 40.

Figure 7:
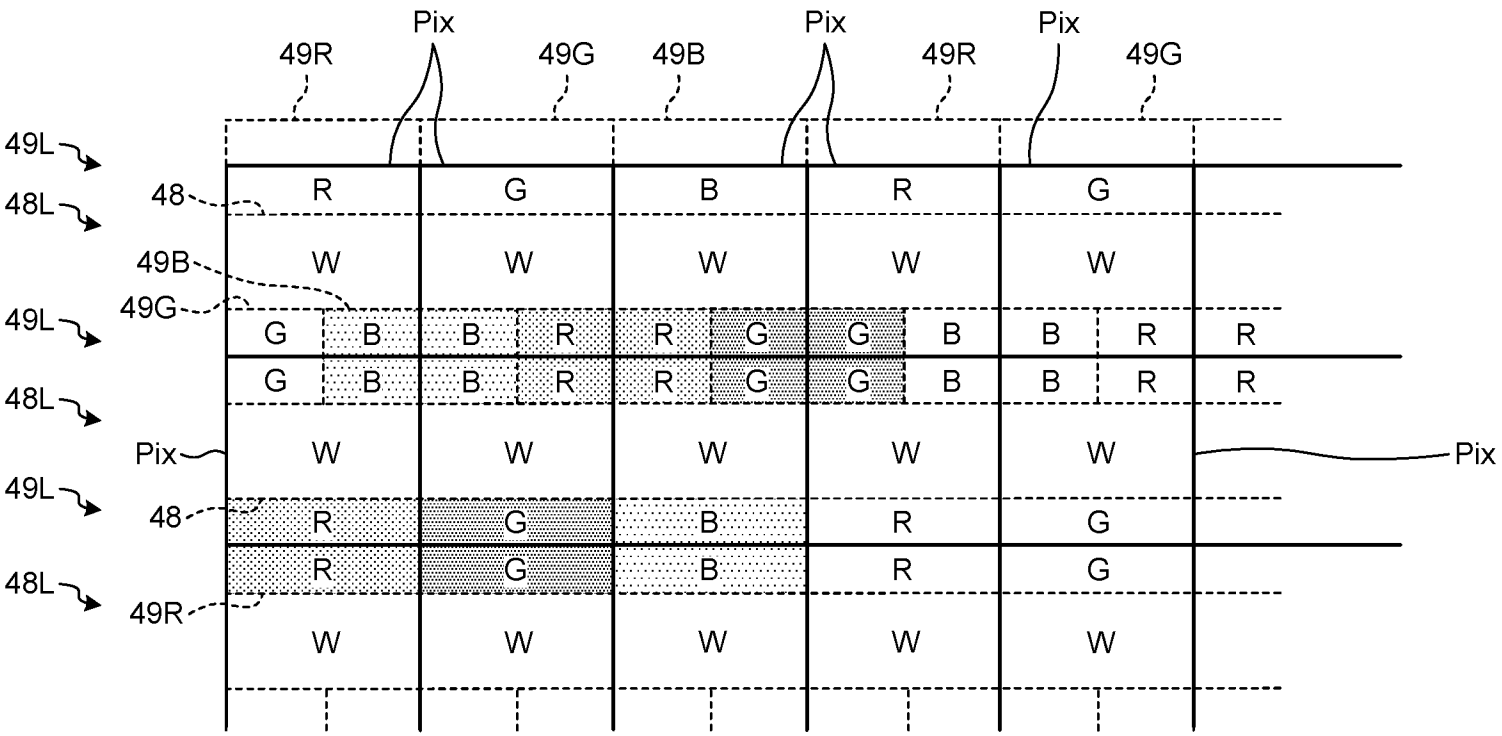
FIG. 7 is a diagram illustrating a relation between unit pixel regions and the arrangement of the pixels and the sub-pixels according to the first embodiment.
Figure 8:
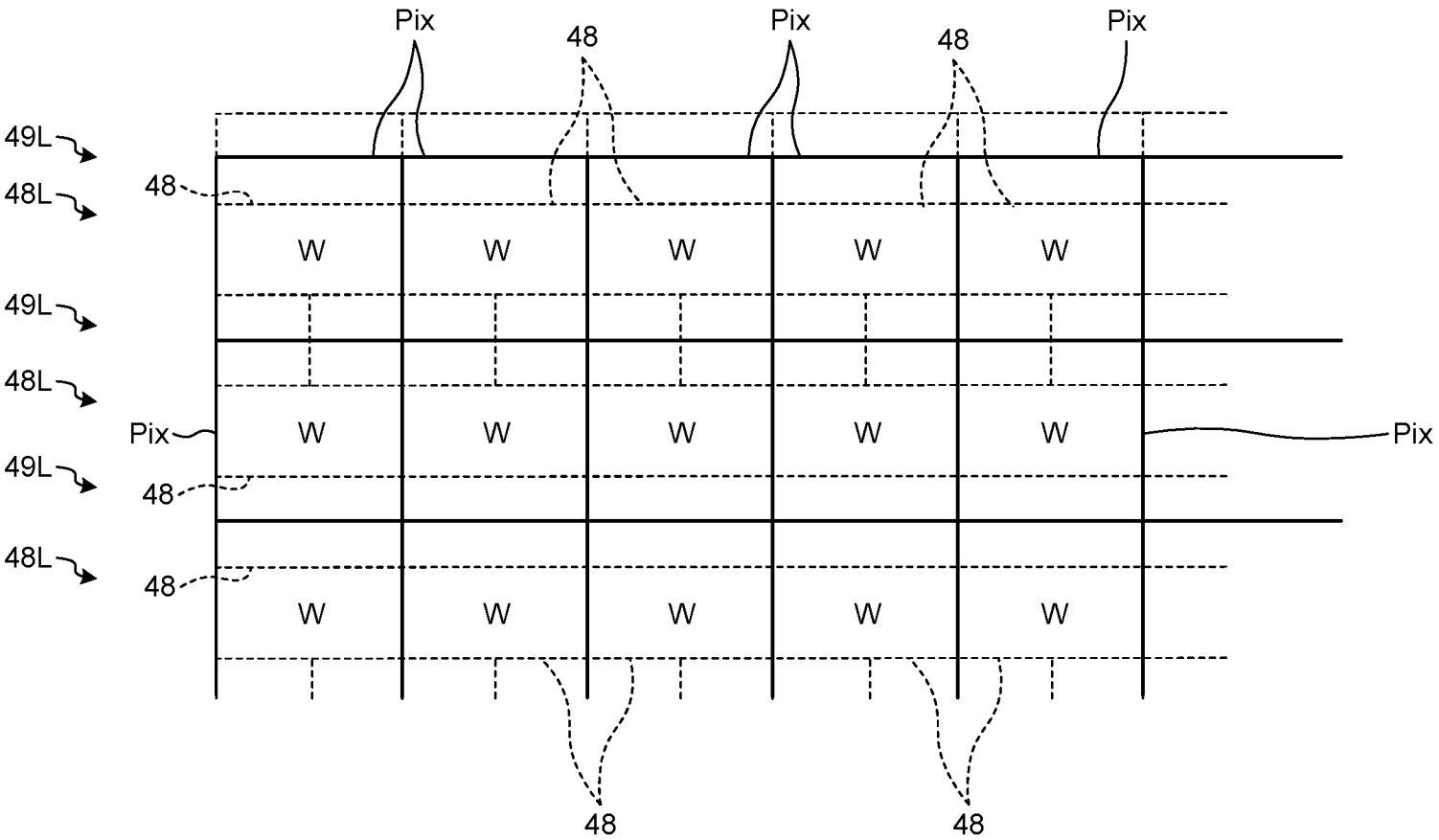
FIG. 8 is a diagram illustrating a relation between the unit pixel regions and the arrangement of the pixels.

The following describes a relation of the input signal with the pixel 48 and the sub-pixel 49. FIG. 7 is a diagram illustrating a relation between the unit pixel regions Pix and the arrangement of the pixels 48 and the sub-pixels 49 according to the first embodiment. FIG. 8 is a diagram illustrating a relation between the unit pixel regions Pix and the arrangement of the pixels 48. In the first embodiment, the numbers of the pixels 48 in the row and column directions are the same as the numbers of pixels (pixel data) constituting the image to be displayed by the display device 10 in the row and column directions. For example, when an arrangement of the pixel data constituting the image to be displayed by the display device 10 in the row and column directions is represented by coordinates (x, y), and the arrangement of the pixels 48 included in the image display panel 40 in the row and column directions is represented by coordinates (X, Y), the coordinates (x, y) of the pixel data correspond one-to-one with the coordinates (X, Y) of the pixels 48 of the image display panel 40. Accordingly, in the first embodiment, one pixel 48 is included in the unit pixel region Pix that performs output for display corresponding to one piece of pixel data, as illustrated in FIGS. 7 and 8.

As described above, the image display panel 40 according to the first embodiment includes the pixels 48 for the high-luminance color (such as white (W)) corresponding to the resolution of the image output for display. That is, the image display panel 40 according to the first embodiment can perform display output of the image at real resolution for the high-luminance color. In the first embodiment, the unit pixel regions Pix are arranged in a matrix along the row and column directions in the same manner as the arrangement of the pieces of pixel data constituting the image.

In the first embodiment, the sub-pixel having the first primary color, the sub-pixel having the second primary color, and the sub-pixel having the third primary color are adjacent to one pixel 48. Specifically, one pixel 48 is adjacent on either side in the row direction to a sub-pixel 49 having any one color of red (R), green (G), and blue (B), and is adjacent on the other side in the row direction to a sub-pixel 49 having another color. More specifically, for example, if only a sub-pixel 49 having any one color of red (R), green (G), and blue (B) is on the upper side of one pixel 48, sub-pixels 49 that have the other two colors and have staggered positional relations with the sub-pixel 49 having the one color are on the lower side of the pixel 48. If only a sub-pixel 49 having any one color of red (R), green (G), and blue (B) is on the lower side of one pixel 48, sub-pixels 49 that have the other two colors and have staggered positional relations with the sub-pixel 49 having the one color are on the upper side of the pixel 48.

Figure 9:
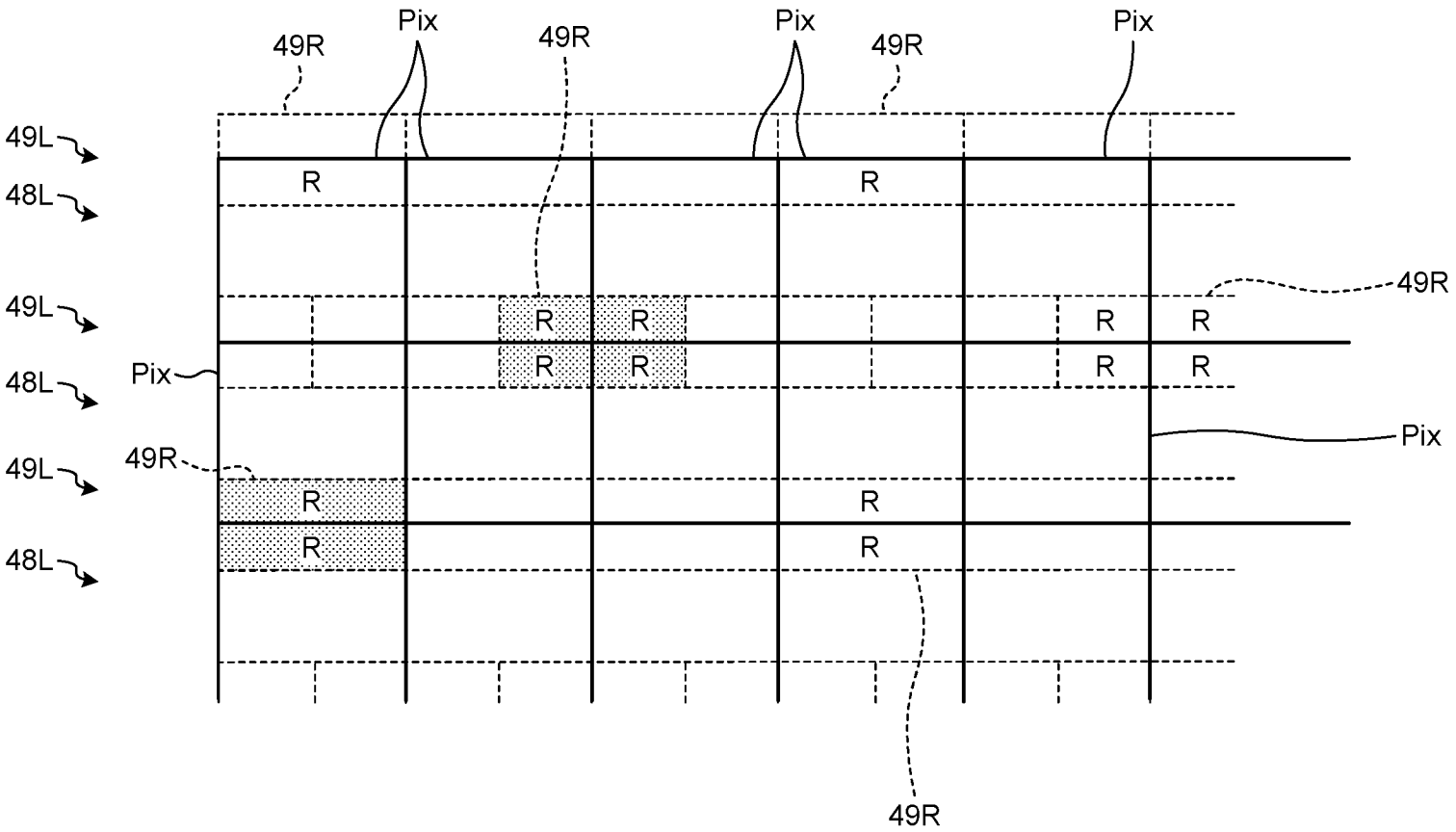
FIG. 9 is a diagram illustrating a relation between the unit pixel regions and the arrangement of first sub-pixels according to the first embodiment.
Figure 10:
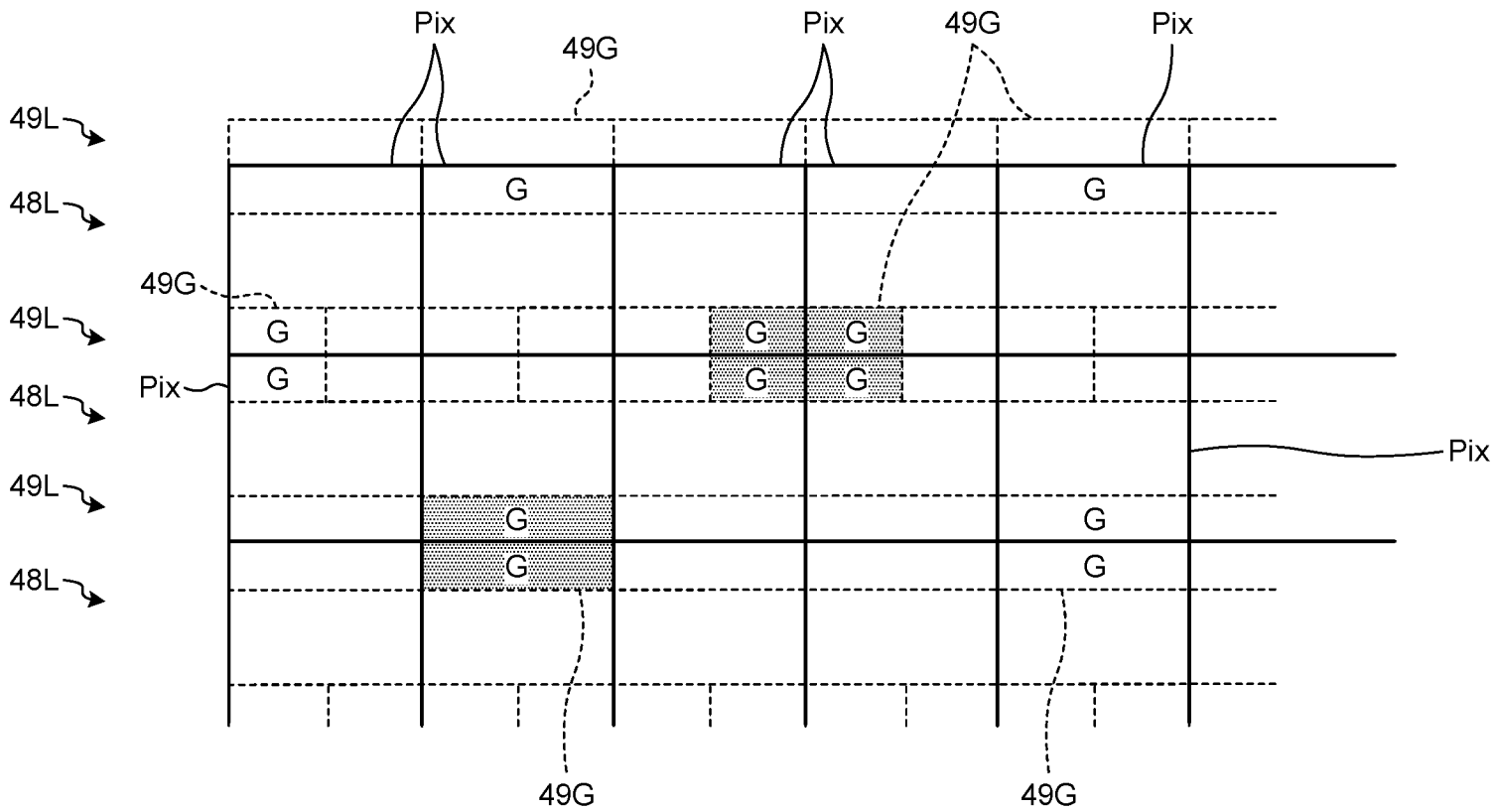
FIG. 10 is a diagram illustrating a relation between the unit pixel regions and the arrangement of second sub-pixels according to the first embodiment.
Figure 11:
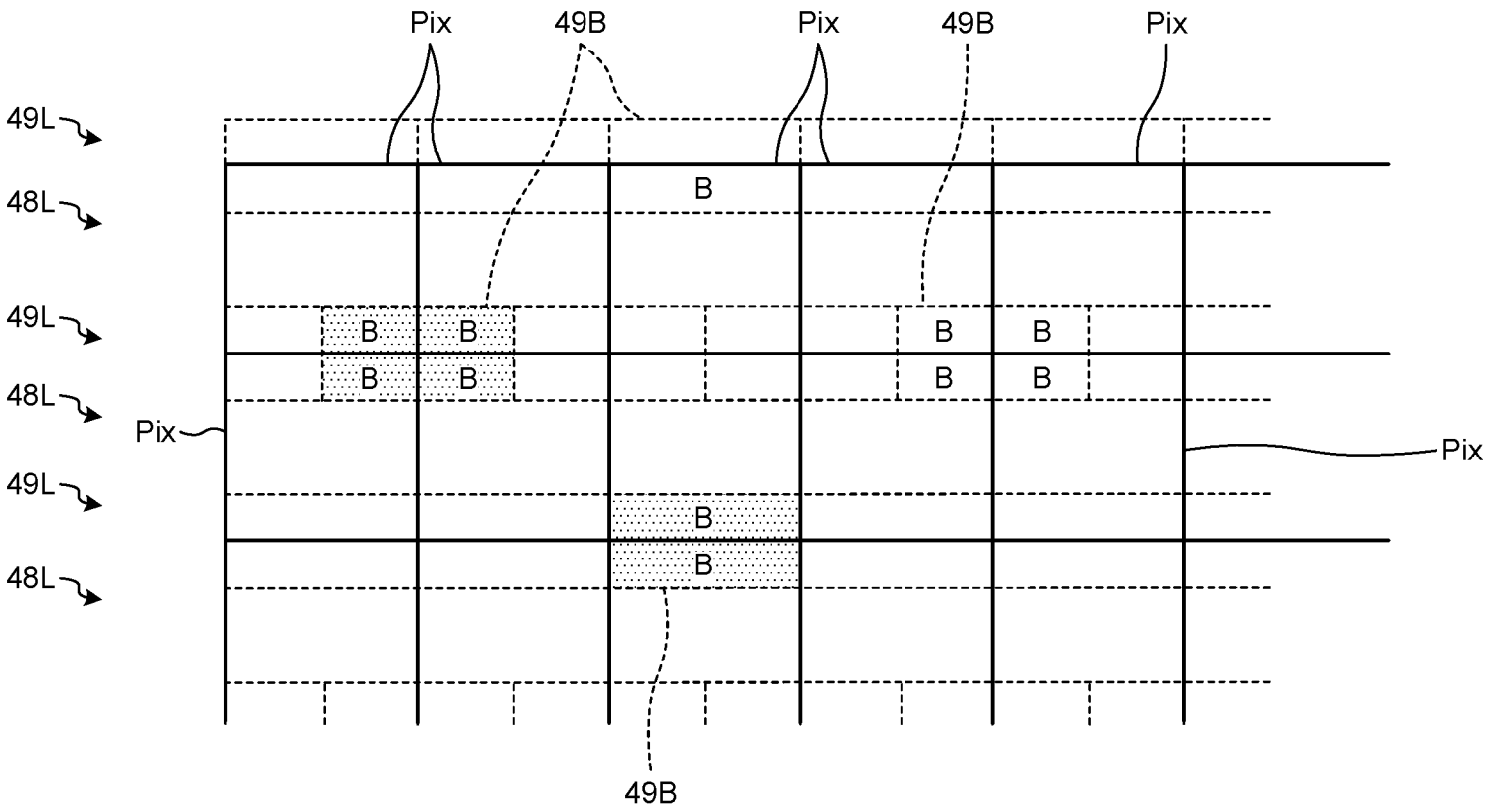
FIG. 11 is a diagram illustrating a relation between the unit pixel regions and the arrangement of third sub-pixels according to the first embodiment.

FIG. 9 is a diagram illustrating a relation between the unit pixel regions Pix and the arrangement of the first sub-pixels 49R according to the first embodiment. FIG. 10 is a diagram illustrating a relation between the unit pixel regions Pix and the arrangement of the second sub-pixels 49G according to the first embodiment. FIG. 11 is a diagram illustrating a relation between the unit pixel regions Pix and the arrangement of the third sub-pixels 49B according to the first embodiment. In the first embodiment, one unit pixel region Pix includes the sub-pixels 49 of all colors. Specifically, as illustrated in FIGS. 7 and 9, for example, each unit pixel region Pix invariably includes a part of the first sub-pixel 49R. Specifically, as illustrated in FIGS. 7 and 9, four unit pixel regions Pix include different parts of one first sub-pixel 49R. That is, the first sub-pixel 49R located at a place where boundary lines of the four unit pixel regions Pix intersect is one first sub-pixel 49R. In the same manner, as illustrated in FIGS. 7 and 10, each unit pixel region Pix invariably includes a part of the second sub-pixel 49G. As illustrated in FIGS. 7 and 11, each unit pixel region Pix invariably includes a part of the third sub-pixel 49B. In FIG. 7 and other figures, in order to indicate that the boundary lines of the unit pixel regions Pix do not divide the sub-pixel 49, different dot patterns are applied to the first sub-pixel 49R, the second sub-pixel 49G, and the third sub-pixel 49B to indicate areas each corresponding to one sub-pixel 49.

The signal processing unit 20 extracts a part or all of the white component as a component that can be output as white from among the color components indicated by the input signal, assigns the extracted white component to the pixel 48, and assigns components other than the extracted white component among the color components indicated by the input signal to the sub-pixels 49.

Figure 12:
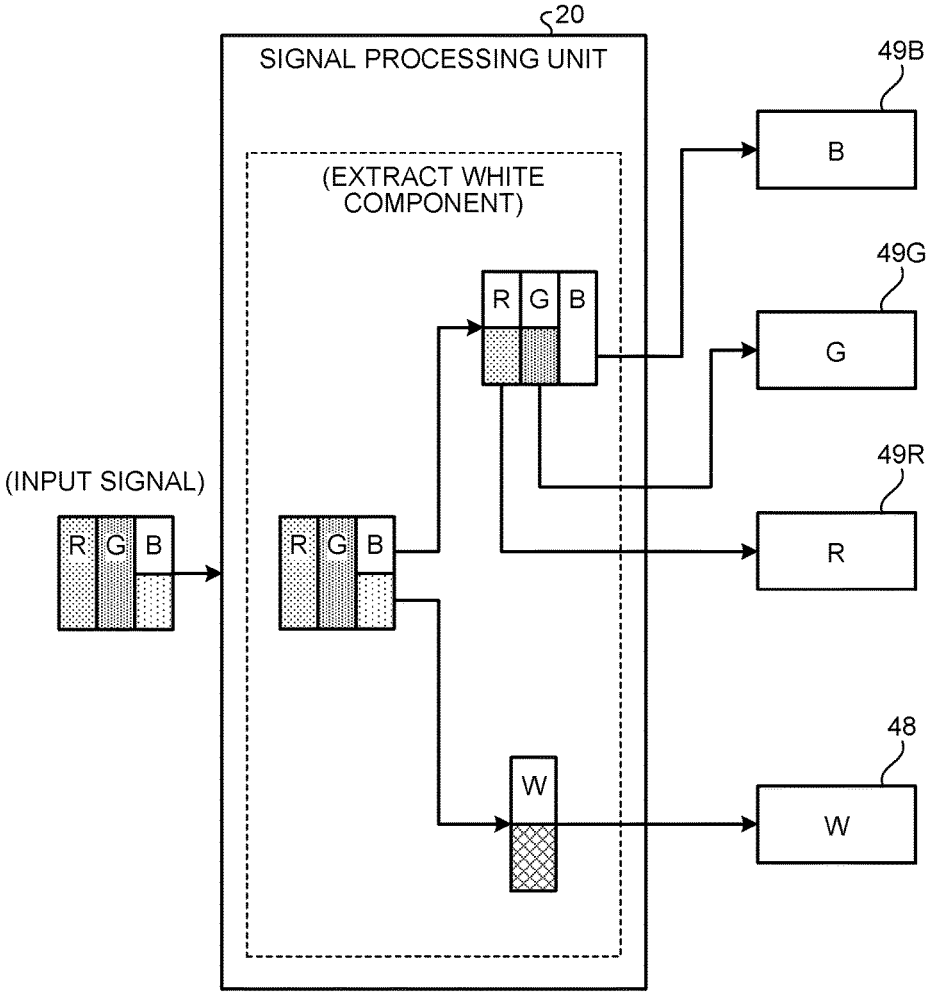
FIG. 12 is a diagram illustrating an example of a method for dividing an input signal into a white component and components other than the white component to be assigned to the pixels and the sub-pixels.

FIG. 12 is a diagram illustrating an example of a method for dividing the input signal into the white component and the components other than the white component to be assigned to the pixels 48 and the sub-pixels 49. For example, the input signal of (R, G, B)=(255, 255, 127) illustrated in FIG. 12 can be divided into the white component of (R, G, B)=(127, 127, 127) and the component of (R, G, B)=(128, 128, 0) other than the white component. The signal processing unit 20 extracts the white component from the color components indicated by the input signal to be assigned to the pixel 48. The signal processing unit 20 assigns the component of (R, G, B)=(128, 0, 0) in the component of (R, G, B)=(128, 128, 0) other than the white component to the first sub-pixel 49R. The signal processing unit 20 assigns the component of (R, G, B)=(0, 128, 0) in the component of (R, G, B)=(128, 128, 0) other than the white component to the second sub-pixel 49G. Two second sub-pixels 49G are adjacent to one pixel 48, so that the signal processing unit 20 assigns the component of (R, G, B)=(0, 128, 0) to be dispersed to the two second sub-pixels 49G. The signal processing unit 20 according to the first embodiment equally divides the green component to be assigned to the two second sub-pixels 49G. However, this is merely a specific example of a method for dispersing the component, and the embodiment is not limited thereto. A dispersion ratio of the green component with respect to the two second sub-pixels 49G can be appropriately changed.

In the example illustrated in FIG. 12, the blue component is not included in the component of (R, G, B)=(128, 128, 0) other than the white component, so that the third sub-pixel 49B is not lit. The white component need not be extracted as much as possible. For example, assuming that the white component extracted from the input signal of (255, 255, 127) is (R, G, B)=(100, 100, 100), the third sub-pixel 49B can be lit corresponding to the blue component (27) included in the component of (R, G, B)=(155, 155, 27) other than the white component. In the input signal, any amount of components can be extracted as a white component from components that can constitute white light. Specifically, assuming that d denotes a value equal to the minimum value of the gradation values a, b, and c of red (R), green (G), and blue (B) when represented in the form of (R, G, B)=(a, b, c), and that the input signal indicates (R, G, B)=(255, 255, 127) as illustrated in FIG. 12, the following results are obtained: a=255, b=255, c=127, and d=c=127. In addition, the white component that can be extracted from the input signal can be represented as a white component with the gradation values a, b, and c of red (R), green (G), and blue (B) equal to the minimum value (d). Assuming that "(R, G, B)min" denotes the RGB data represented by the gradation values of (R, G, B)=(d, d, d), the ratio of the component extracted as the white component (W) from the color components indicated by the input signal can be represented as Expression (1) below, using a coefficient K, where $0<K\leq 1$.

$$W=(R,G,B)\min\times K \tag{1}$$

The components other than the white component can be represented as Expressions (2) to (4) below, using a, b, c, d, and K given above.

$$R=a-(d\times K) \tag{2}$$

$$G=b-(d\times K) \tag{3}$$

$$B=c-(d\times K) \tag{4}$$

As illustrated in FIGS. 7 and 9, one first sub-pixel 49R is adjacent to one to four pixels 48. The signal processing unit 20 according to the first embodiment collects the red component from four unit pixel regions Pix at the maximum for one first sub-pixel 49R and assigns the collected red component to one first sub-pixel 49R. Similarly, the signal processing unit 20 collects the green component and the blue component from four unit pixel regions Pix at the maximum for one second sub-pixel 49G and one third sub-pixel 49B and assigns the collected green component and the collected blue component to one second sub-pixel 49G and one third sub-pixel 49B, respectively, as illustrated in FIGS. 7, 10, and 11. In FIGS. 7, 9, 10, and 11, "R", "G", and "B" respectively denote the first sub-pixel 49R, the second sub-pixel 49G, and the third sub-pixel 49B that are assigned with the components other than the white component in the color components indicated by the input signal. That is, the signal processing unit 20 according to the first embodiment assigns the components other than the white component from the unit pixel regions Pix to the first sub-pixel 49R, the second sub-pixel 49G, and the third sub-pixel 49B corresponding to positions of "R", "G", and "B" in the unit pixel regions Pix illustrated in FIGS. 7, 9, 10, and 11.

In the first embodiment, the components other than the white component in the color components indicated by the input signal are assigned to the sub-pixels 49 adjacent to the pixel 48 in the unit pixel region Pix at the coordinates of the input signal. However, the components of the input signal at any coordinates can be assigned to any sub-pixel 49, and the coordinates and the sub-pixel 49 can be determined based on an algorithm of signal processing performed by the signal processing unit 20.

A relation between the unit pixel region Pix and the position of the pixel 48 according to the first embodiment will be described. The center of the pixel 48 is located within a half pixel from the center of the unit pixel region Pix. Specifically, the center of the pixel 48 according to the first embodiment is located in the same position as the center of the unit pixel region Pix. The center of each of the pixel 48 and the unit pixel region Pix refers to a point at an equal distance from apexes of a shape forming each of them.

Figure 13:
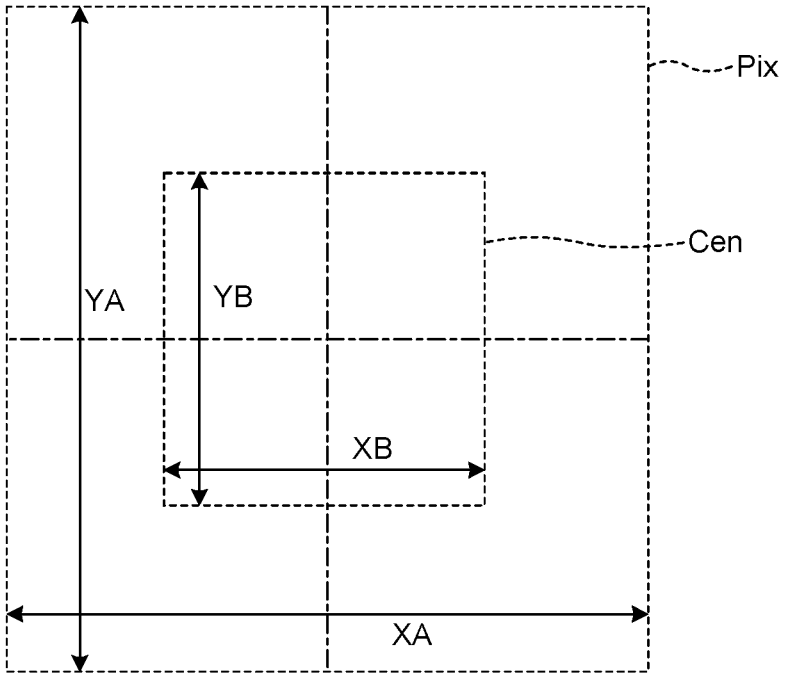
FIG. 13 is a diagram illustrating an example of conditions on the position of the center of a pixel in each of the unit pixel regions.

In the first embodiment, the center of the pixel 48 according to the first embodiment is located in the same position as the center of the unit pixel region Pix. However, the center of the pixel 48 need not coincide with the center of the unit pixel region Pix. FIG. 13 is a diagram illustrating an example of conditions on the position of the center of the pixel 48 in the unit pixel region Pix. The center of the pixel 48 may be located in a half-pixel region Cen in the unit pixel region Pix illustrated in FIG. 13. Each of the unit pixel region Pix and the half-pixel region Cen is a rectangular region. The center of the unit pixel region Pix is located in the same position as the center of the half-pixel region Cen. A width XA in the row direction of the unit pixel region Pix is twice a width XB in the row direction of the half-pixel region Cen. A width YA in the column direction of the unit pixel region Pix is twice a width YB in the column direction of the half-pixel region Cen.

The center of the pixel 48 according to the first embodiment is located in the same position as the center of the unit pixel region Pix, and thus can be said to be in the same position as the center of the half-pixel region Cen. Accordingly, the center of the pixel 48 according to the first embodiment can also be said to be in the half-pixel region Cen.

In the first embodiment, the light emitting capability of each of the sub-pixels 49 included in the display device 10 may be higher than the light emitting capability required for a color gamut of the display device 10 reproduced by combining the colors of the sub-pixels 49. In this case, the color gamut representing a color range that can be output by the display device 10 in which the colors of the sub-pixels 49 are vertexes is larger than a color gamut of an image visually recognized as a result of display output by the display device 10 and contains the color gamut of the image. The following describes such a color gamut with reference to FIG. 14.

Figure 14:
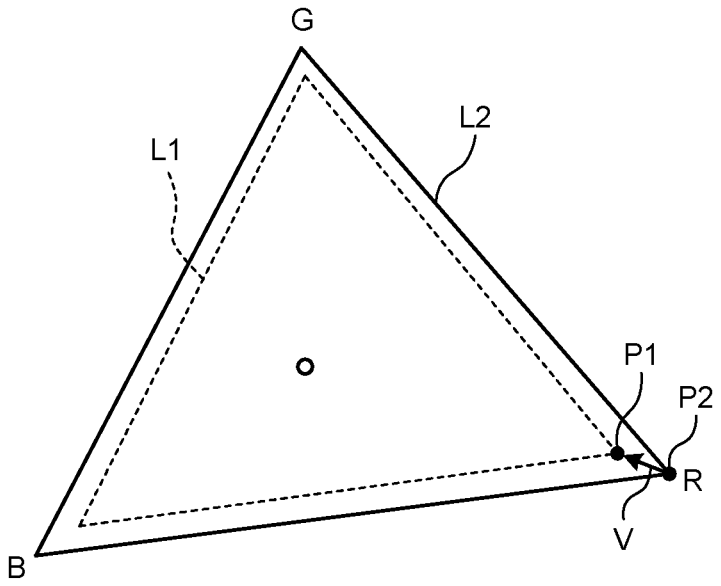
FIG. 14 is a diagram illustrating a relation between a color gamut that can be reproduced with a light emitting capability of each sub-pixel included in the display device and a color gamut of the display device that is actually output by combining colors of the sub-pixels.

FIG. 14 is a diagram illustrating a relation between the color gamut that can be reproduced with the light emitting capability of each sub-pixel 49 included in the display device 10 and the color gamut of the display device 10 that is actually output by combining the colors of the sub-pixels 49. Suppose that the color gamut that can be reproduced with the light emitting capability of each sub-pixel 49 included in the display device 10 and the color gamut of the display device 10 that is actually output by combining the colors of the sub-pixels 49 are the same color gamut L1, that is, suppose that a maximum color gamut based on potential of the light emitting capability of the sub-pixel 49 of the display device 10 is the same as an effective color gamut that can be visually recognized in the display output performed by the display device 10. In outputting one primary color having a maximum gradation value, the display device 10 causes the sub-pixel 49 of the primary color to be lit with a maximum light emitting capability. In other words, under the above hypothetical condition, the display device 10 cannot cause the sub-pixel 49 of another color to be lit in outputting one primary color having the maximum gradation value. This is because, if the sub-pixel 49 of another color is lit, a reproduced color of the display device 10 is shifted in a direction of the lit color, and an output as the primary color cannot be obtained. For example, if the sub-pixel 49 of another color is lit when red (R) is to be output with the maximum gradation value, the reproduced color is brought close to any of the colors other than red (R) and becomes a color not corresponding to the primary color of red (R). The same applies to the other primary colors. When the sub-pixel 49 of another color cannot be lit in outputting one primary color having the maximum gradation value, only the sub-pixel 49 of the one primary color is lit as content of display output, which may be visually recognized as granularity related to display depending on definition of the pixel 48 and the sub-pixel 49.

As a method for reducing such granularity, for example, as illustrated in FIG. 14, a color gamut (indicated by a reference sign L2) that can be reproduced with the light emitting capability of each sub-pixel 49 included in the display device 10 may be caused to be larger than the color gamut (indicated by a reference sign L1) of the display device 10 actually output by combining the colors of the sub-pixels 49 to cause the sub-pixels 49 of colors other than the primary color to be lit in outputting the one primary color having the maximum gradation value. For example, to output red (R) with the maximum gradation value of the "actually output color gamut of the display device 10", a target color corresponds to the reference sign P1 of the color gamut L1 in FIG. 14. Suppose that when the first sub-pixel 49R included in the display device 10 is lit with the maximum light emitting capability, the other sub-pixels 49 are not lit. The color to be output corresponds to the reference sign P2 positioned on an outer side than the reference sign P1 of the color gamut L1 in FIG. 14. In this case, the color is deviated from the "actually output color gamut of the display device 10". However, by causing the sub-pixel 49 of another color to be lit, a color component of light to be output can be brought close to the "actually output color gamut of the display device 10". For example, by causing both green (G) and blue (B) to be lit, the color can be shifted from the reference sign P2 toward the reference sign P1 as represented by the arrow V. The color can be shifted from the reference sign P2 toward the reference sign P1 also by causing the pixel 48 to be lit and outputting the white (W) component. Two or more lighting patterns as exemplified above for "shifting the color from P2 toward the reference sign P1" can be combined. A case of reproducing the color of red (R) has been described above as an example. Also in a case of outputting another primary color or another complementary color, the sub-pixel 49 of a color other than a "color intended to be reproduced" can be lit. That is, when the light emitting capability of each sub-pixel 49 is higher than the light emitting capability required for the color gamut of the display device 10 reproduced by combining the colors of the sub-pixels 49, more sub-pixels 49 can be lit irrespective of the output color. Accordingly, the granularity can be further reduced irrespective of the content of the display output, and the resolution corresponding to real resolution is easily exhibited.

In the present embodiment, as illustrated in FIG. 2, the shape of the pixel 48 is the same as the shape of the sub-pixel 49, and the size of one pixel 48 is the same as the size of one sub-pixel 49. However, this is an example, and the present invention is not limited thereto. For example, the width in the column direction may differ between the pixel 48 and the sub-pixel 49.

As described above, according to the first embodiment, the pixel 48 is individually included in each of the unit pixel regions Pix, so that the resolution of the displayed image can be obtained with a contrast corresponding to the gradation values of the pixel 48. That is, the real resolution can be ensured by the pixels 48 without depending on the number of sub-pixels 49 included in the display device. Hence, a correlation between the resolution and the number of sub-pixels 49 can be lowered. Thus, when the number of pixels 48 increases with increase in the resolution, the sub-pixels 49 can be restrained from increasing in number. Accordingly, the number of sub-pixels 49 can be easily limited to less than twice the number of pixels while ensuring the resolution. This means that an area assigned to one sub-pixel 49 can be easily secured. This is because the area assigned to one sub-pixel 49 increases as the number of sub-pixels 49 assigned per unit area decreases. From the above, according to the present embodiment, when a mounting area assigned to one sub-pixel 49 decreases with increase in the resolution, the degree of the decrease can be reduced.

Limiting the number of sub-pixels 49 to less than twice the number of pixels 48 can reduce the increase in the number of sub-pixels 49 associated with the increase in the resolution. This indicates that the number of sub-pixels 49 consuming power by being driven can be reduced in the display device with higher resolution. Hence, the increase in the power for driving the sub-pixels 49 with the increase in the resolution can be reduced.

One unit pixel region Pix includes the first, the second, and the third primary colors. This allows achievement of both color reproduction using the sub-pixel of the first primary color (first sub-pixel 49R), the sub-pixel of the second primary color (second sub-pixel 49G), and the sub-pixel of the third primary color (third sub-pixel 49B), and the resolution obtained by the pixels 48.

The sub-pixels 49 of the same color are arranged in a staggered manner. This can facilitate uniform dispersed arrangement of colors in an effective display region.

The sub-pixel of the first primary color (first sub-pixel 49R), the sub-pixel of the second primary color (second sub-pixel 49G), and the sub-pixel of the third primary color (third sub-pixel 49B) are adjacent to one pixel 48. As a result, the components of the first, the second, and the third primary colors assumed to be output in the position of the pixel 48 can be output by the sub-pixels 49 adjacent to the pixel 48, so that a color corresponding to the gradation values indicated by the input signal can be reproduced in an area closer to the position of the pixel 48.

The numbers of the pixels 48 in the row and the column directions are the same as the numbers of the pixels (pixel data) constituting the image to be displayed by the display device 10 in the row and the column directions. Hence, the image can be output for display at real resolution without a need for resampling.

By extracting the white component as a component that can be output as white from the color components indicated by the input signal and assigning the extracted white component to the pixel 48, and by assigning the components other than the white component in the color components indicated by the input signal to the sub-pixels 49, the color reproduction using the primary colors of the sub-pixels 49 and the resolution obtained by reproducing the contrast of white of the pixel 48 can both be achieved.

The color gamut that represents the color range outputtable by the display device 10 and that has vertices representing the color of the sub-pixels 49 is larger than the color gamut of the image that is visually recognized as a result of display output by the display device 10, and contains the color gamut of the image, so that granularity of the display can be reduced.

The high luminance color is white (W), so that output of contrast using intensity of white light can be performed with higher efficiency with the pixel 48. The efficiency herein means luminance and brightness with respect to power consumption.

As illustrated, for example, in FIG. 2, the pixels 48 are continuously arranged in one direction (such as in the row direction), so that the resolution can be more easily ensured with respect to such one direction. As a specific example, an image including a line segment of a high-luminance color, such as white, along such one direction can be displayed without producing undulation of the line segment toward another direction.

Modifications of First Embodiment

The following describes Modifications 1 to 8 as modifications according to the first embodiment. In the description of Modifications 1 to 8, the same configurations as those in the first embodiment may be denoted by the same reference signs, and descriptions thereof will not be repeated in some cases. The modifications of the first embodiment are the same as the first embodiment in that the sub-pixels 49 of the same color are arranged at even intervals in the row direction and at even intervals in the column direction. The modifications of the first embodiment are the same as the first embodiment in that the sub-pixels 49 of the same color are arranged in a staggered manner. The modifications of the first embodiment are the same as the first embodiment in that the sub-pixel having the first primary color, the sub-pixel having the second primary color, and the sub-pixel having the third primary color are adjacent to one pixel 48. The modifications of the first embodiment are the same as the first embodiment in that the unit pixel regions Pix are arranged in a matrix along the row and column directions.

Modification 1

Figure 15:
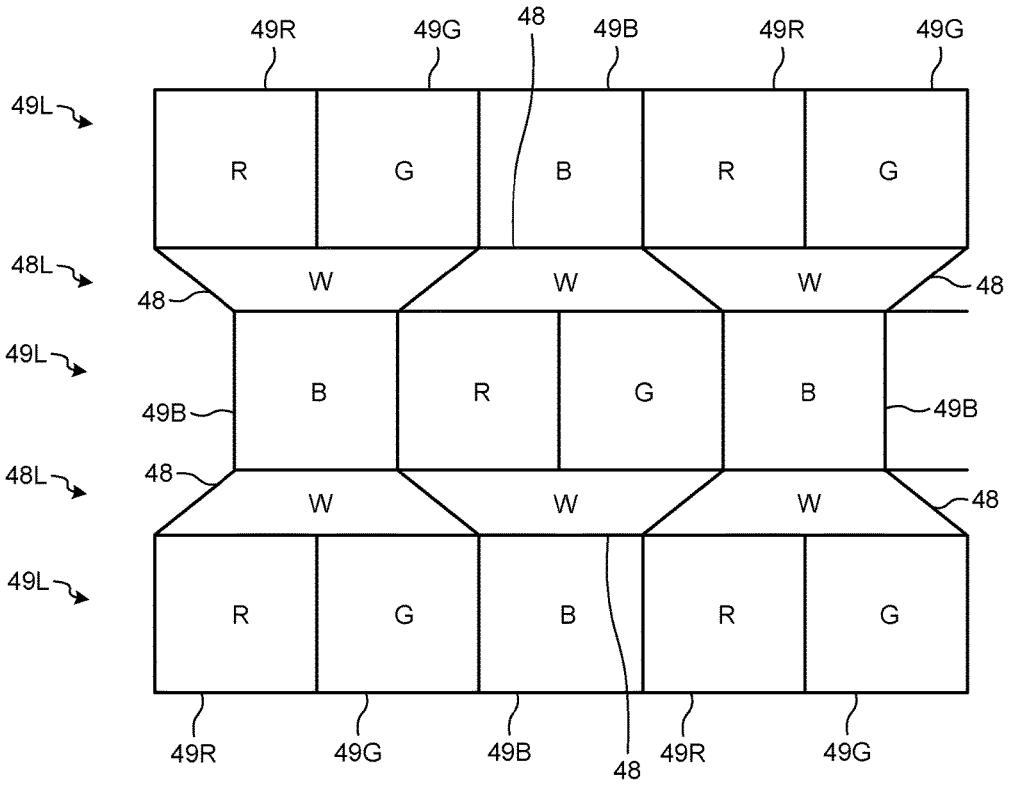
FIG. 15 is a diagram illustrating shapes and an arrangement of the pixels and the sub-pixels according to Modification 1.
Figure 16:
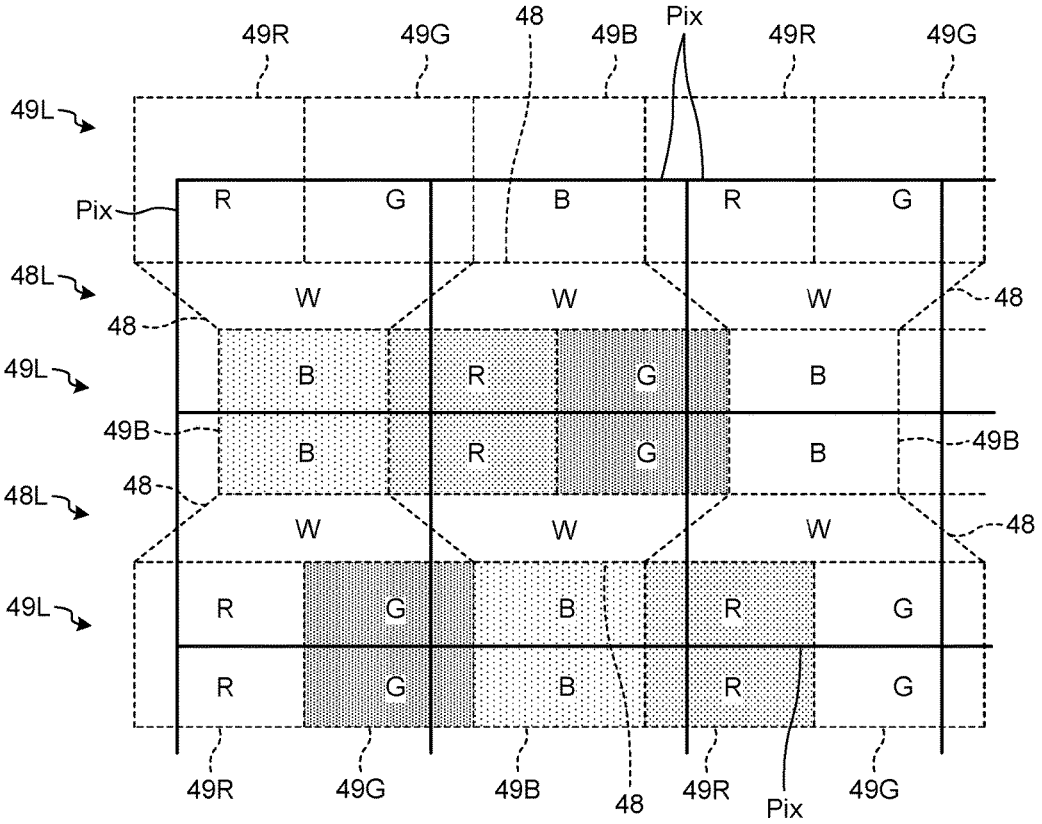
FIG. 16 is a diagram illustrating a relation between the unit pixel regions and the arrangement of the pixels and the sub-pixels according to Modification 1.

FIG. 15 is a diagram illustrating shapes and an arrangement of the pixels 48 and the sub-pixels 49 according to Modification 1. FIG. 16 is a diagram illustrating a relation between the unit pixel regions Pix and the arrangement of the pixels 48 and the sub-pixels 49 according to Modification 1. As illustrated in FIG. 15, the image display panel 40 may include the trapezoidal pixels 48 and the rectangular sub-pixels 49 provided adjacent to the trapezoidal pixels 48. Two parallel sides (upper and lower sides) of the pixel 48 according to Modification 1 that extend along a predetermined direction (along the row direction in FIG. 15) and that are adjacent to the sub-pixels 49 have lengths at a ratio of 1:2. Two sides of the sub-pixel 49 according to Modification 1 along a predetermined direction (for example, along the row direction) have the same length as the length of shorter one of the two parallel sides of the pixel 48.

The longer one of the upper and lower sides of the pixel 48 is adjacent to sub-pixels 49 of two of red (R), green (G), and blue (B), and the shorter thereof is adjacent to a sub-pixel 49 of the other one color. As described above, also in Modification 1, the sub-pixel having the first primary color, the sub-pixel having the second primary color, and the sub-pixel having the third primary color are adjacent to one pixel 48 in the same manner as in the first embodiment. As illustrated in FIG. 16, also in Modification 1, one unit pixel region Pix includes all colors of the sub-pixels 49 in the same manner as in the first embodiment. Thus, in the same manner as in the first embodiment, the signal processing unit 20 according to Modification 1 can assign the components other than the white component from the unit pixel regions Pix to the first sub-pixel 49R, the second sub-pixel 49G, and the third sub-pixel 49B included in the unit pixel region Pix in positions corresponding to the coordinates of the pixel data.

In Modification 1, the ratio of the number of sub-pixels 49 to the number of pixels 48 can be higher than that in the first embodiment. Specifically, in the first embodiment described with reference to FIG. 2, with a focus on one pixel row 48L and one sub-pixel row 49L, one sub-pixel 49 is disposed in a range in the row direction in which one pixel 48 is disposed. Consequently, the ratio between the number of pixels 48 and the number of sub-pixels 49 is substantially 1:1. Supposing that n denotes a ratio of an area of one sub-pixel 49 to an area of sub-pixels 49 included in one unit pixel region Pix, it follows that n=1 as illustrated in FIG. 7 and other figures in the case of the unit pixel region Pix according to the first embodiment. That is, an area for one sub-pixel 49 is in the unit pixel region Pix according to the first embodiment. When the pixel 48 is assumed as one of the sub-pixels 49 (fourth sub-pixel), an area for (n+1) sub-pixels 49, that is, two sub-pixels 49 is in the unit pixel region Pix according to the first embodiment. When (n+1) that indicates the number of the sub-pixels 49 in the unit pixel region Pix is expressed in a certain unit (for example, as "(n+1) [SB]"), the unit pixel region Pix according to the first embodiment has a value of 2 [SB]. In Modification 1, with a focus on one pixel row 48L and one sub-pixel row 49L, three sub-pixels 49 are disposed in a range in the row direction in which two pixels 48 are disposed, as illustrated in FIG. 15. Consequently, the ratio between the number of pixels 48 and the number of sub-pixels 49 is substantially 1:1.5. The unit pixel region Pix according to Modification 1 corresponds to 2.5 [SB].

The term "substantially" is used in the description of the ratio between the number of pixels 48 and the number of sub-pixels 49 because the ratio indicating the number of sub-pixels 49 exceeds the value given above, in an exact sense. For example, in the example illustrated in FIG. 2, the second sub-pixel 49G having an area half that of the other sub-pixels 49 is illustrated in the second sub-pixel row 49L from the top row. In addition, although not illustrated, the sub-pixel row 49L is arranged at each of the upper and lower ends of the image display panel 40, so that the number of sub-pixel rows 49L is larger than the number of pixel rows 48L by one. In this manner, in the first embodiment, the ratio between the number of pixels 48 and the number of sub-pixels 49 is exactly 1:(1+α). However, α is a small increment due to such an exceptional arrangement, and the ratio can be assumed to be substantially 1:1. Also, in Modification 1, although the ratio slightly deviates due to the staggered arrangement of the sub-pixels 49 and the relation between the number of pixel rows 48L and the number of sub-pixel rows 49L, the ratio between the number of pixels 48 and the number of sub-pixels 49 can be assumed to be substantially 1:1.5. In each of the first embodiment and Modification 1, the number of sub-pixels 49 is smaller than twice the number of pixels 48. Since the number of sub-pixels 49 is smaller than twice the number of pixels 48, (n+1) [SB] has a value smaller than 3. Hereinafter, the ratio between the number of pixels 48 and the number of sub-pixels 49 will be mentioned as a substantial ratio.

Modification 1 is the same as the first embodiment except in the feature described above. For example, in the same manner as in the first embodiment, the center of the pixel 48 according to Modification 1 is located in the half-pixel region Cen in the unit pixel region Pix. Also, in Modification 1, in the same manner as in the first embodiment, the center of the pixel 48 can be located in the same position as the center of the unit pixel region Pix.

Modification 2

Figure 17:
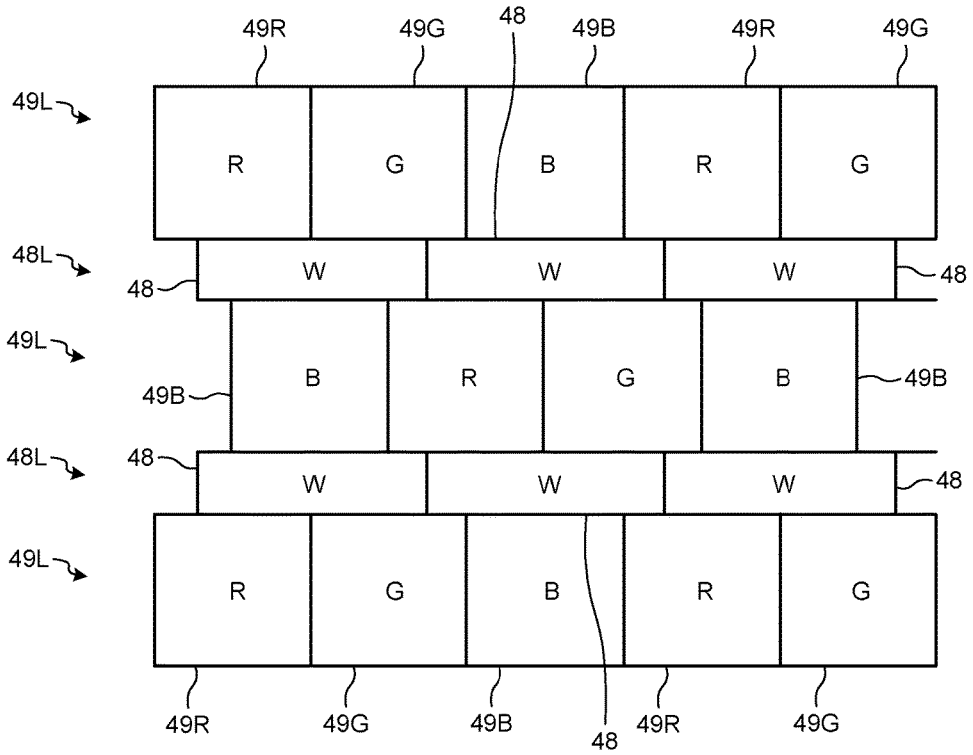
FIG. 17 is a diagram illustrating shapes and an arrangement of the pixels and the sub-pixels according to Modification 2.

FIG. 17 is a diagram illustrating shapes and an arrangement of the pixels 48 and the sub-pixels 49 according to Modification 2. In Modification 1, the image display panel 40 includes the trapezoidal pixels 48. The pixels 48 may have another shape without changing the ratio between the number of pixels 48 and the number of sub-pixels 49 and (n+1) [SB] of the unit pixel region Pix, as illustrated in Modification 2. Specifically, as illustrated in FIG. 17, the shape of the pixels 48 may be a rectangular shape that has two sides (upper and lower sides) along a predetermined direction (for example, along the row direction) having lengths at a ratio of 1:1, and the lengths of the two sides may be each 1.5 times the length of each side along the predetermined direction of the sub-pixels 49. That is, in the arrangement of the pixels 48 and the sub-pixels 49 according to Modification 2, the width in the predetermined direction of the pixel 48 only needs to be 1.5 times the width in the predetermined direction of each of the sub-pixels 49. The image display panel 40 according to Modification 2 is the same as the image display panel 40 according to Modification 1 except in the shape of the pixels 48.

Modification 3

Figure 18:
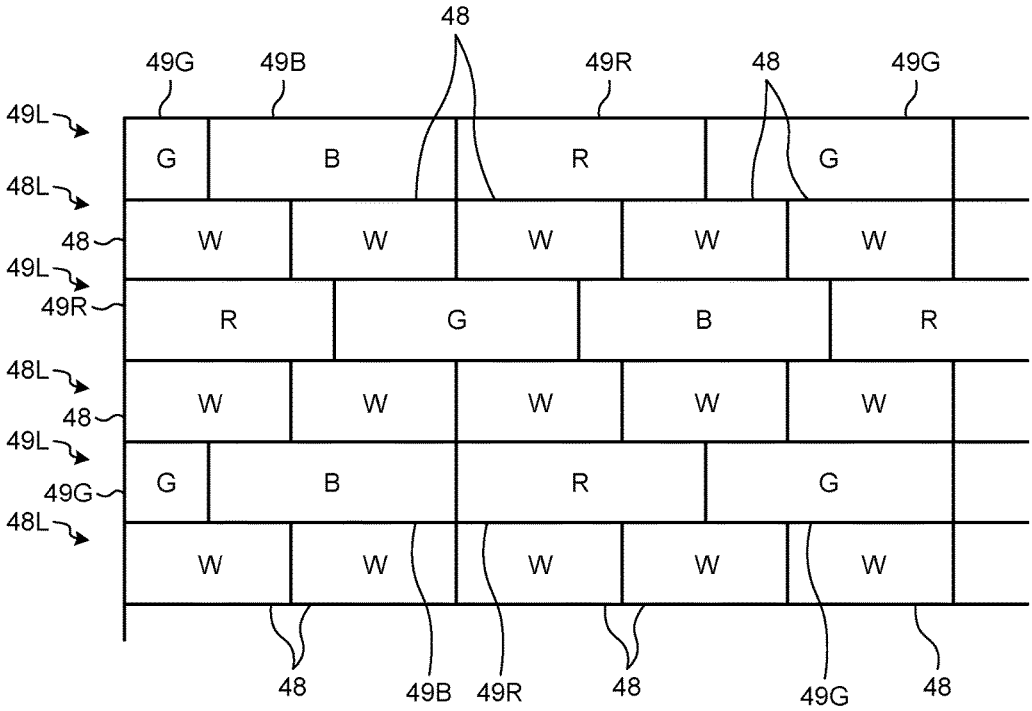
FIG. 18 is a diagram illustrating shapes and an arrangement of the pixels and the sub-pixels according to Modification 3.
Figure 19:
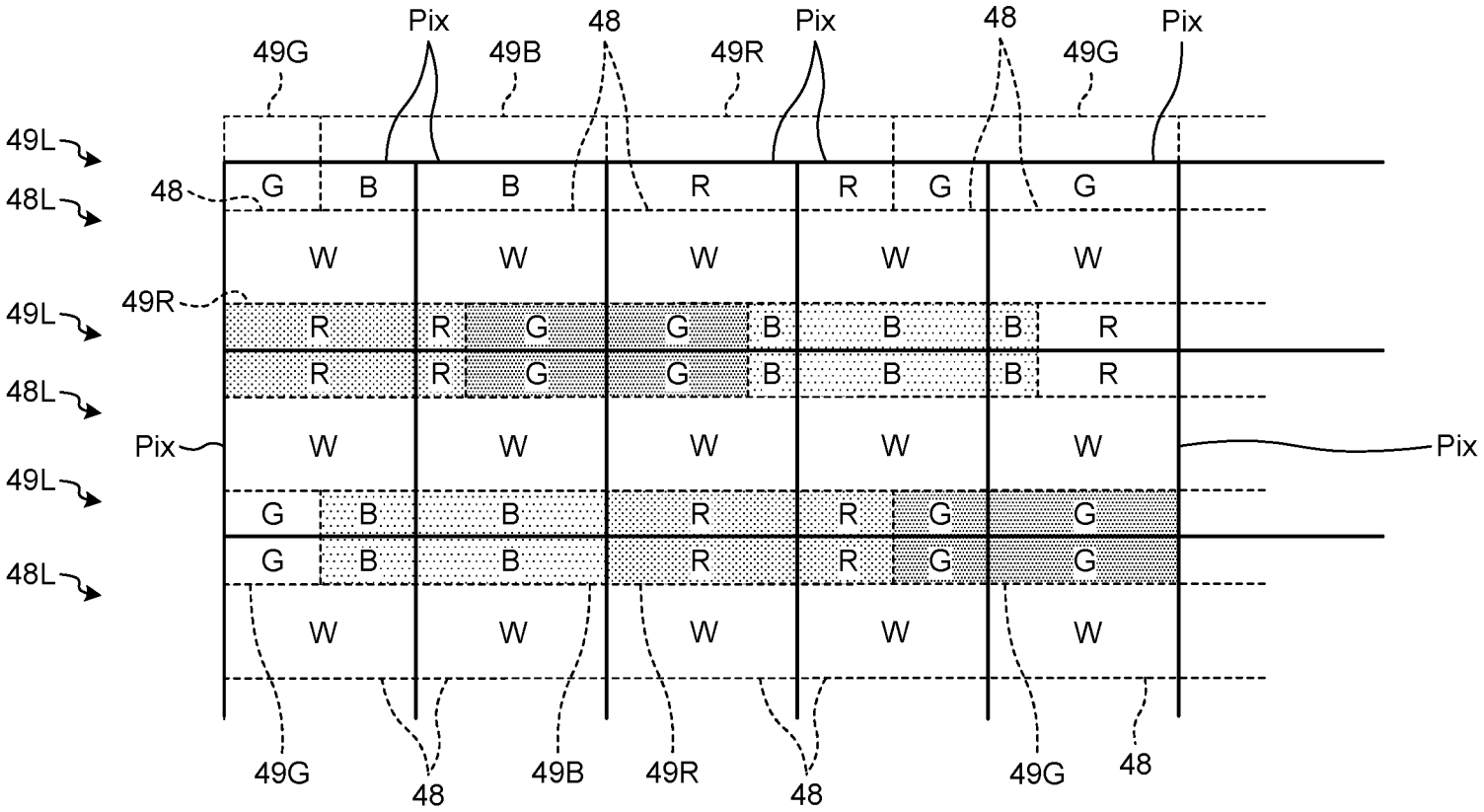
FIG. 19 is a diagram illustrating a relation between the unit pixel regions and the arrangement of the pixels and the sub-pixels according to Modification 3.

FIG. 18 is a diagram illustrating shapes and an arrangement of the pixels 48 and the sub-pixels 49 according to Modification 3. FIG. 19 is a diagram illustrating a relation between the unit pixel regions Pix and the arrangement of the pixels 48 and the sub-pixels 49 according to Modification 3. The width in a predetermined direction (for example, in the row direction) of each of the sub-pixels 49 may be 1.5 times the width in the predetermined direction of the pixel 48, as illustrated in FIG. 18. When the width in the row direction of the sub-pixel 49 is equal to or larger than the width in the row direction of the pixel 48 and is smaller than twice the width in the row direction of the pixel 48 as illustrated in Modification 3, the sub-pixels 49 are arranged so that, when an intermediate line between two sub-pixels 49 corresponding to two colors of red (R), green (G), and blue (B) in one of two sub-pixel rows 49L facing each other with one pixel row 48L interposed therebetween is extended along the column direction, an intermediate position in the row direction of one sub-pixel 49 corresponding to the other one color in the other row is on the extended line. As a result, as illustrated in FIG. 19, the sub-pixel having the first primary color, the sub-pixel having the second primary color, and the sub-pixel having the third primary color can be adjacent to one pixel 48, and one unit pixel region Pix can include all colors of the sub-pixels 49.

The unit pixel region Pix according to Modification 3 has a value of 1.67 [SB]. According to Modification 3, the number of sub-pixels 49 can be smaller than that in the first embodiment. Modification 3 is the same as the first embodiment except in the feature described above.

Modification 4

Figure 20:
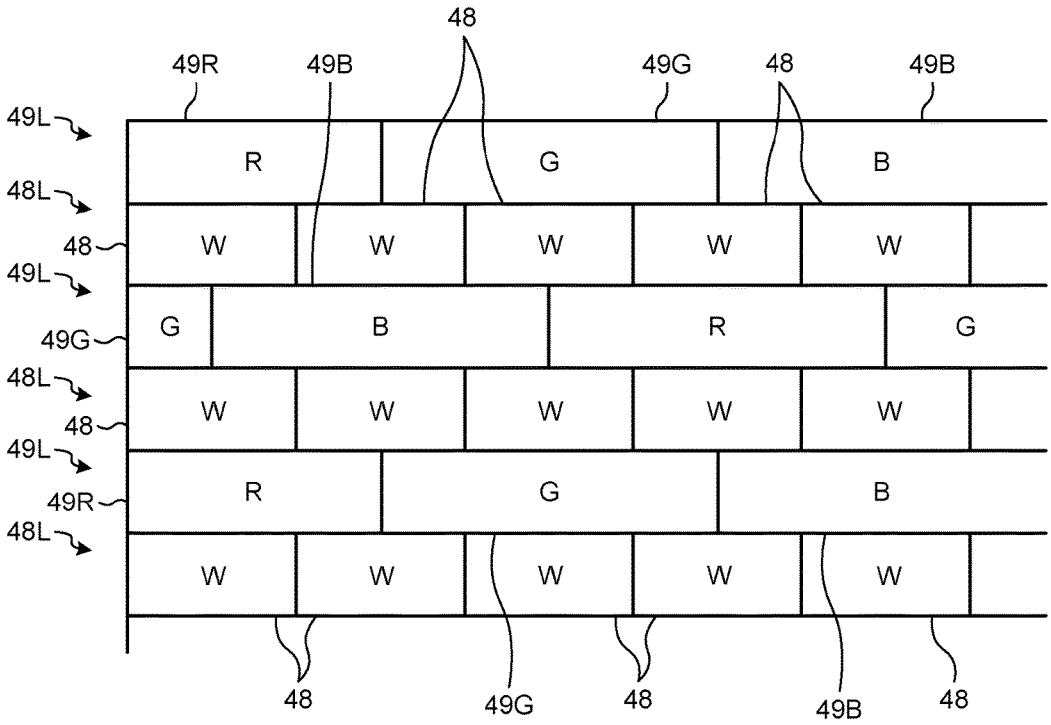
FIG. 20 is a diagram illustrating shapes and an arrangement of the pixels and the sub-pixels according to Modification 4.
Figure 21:
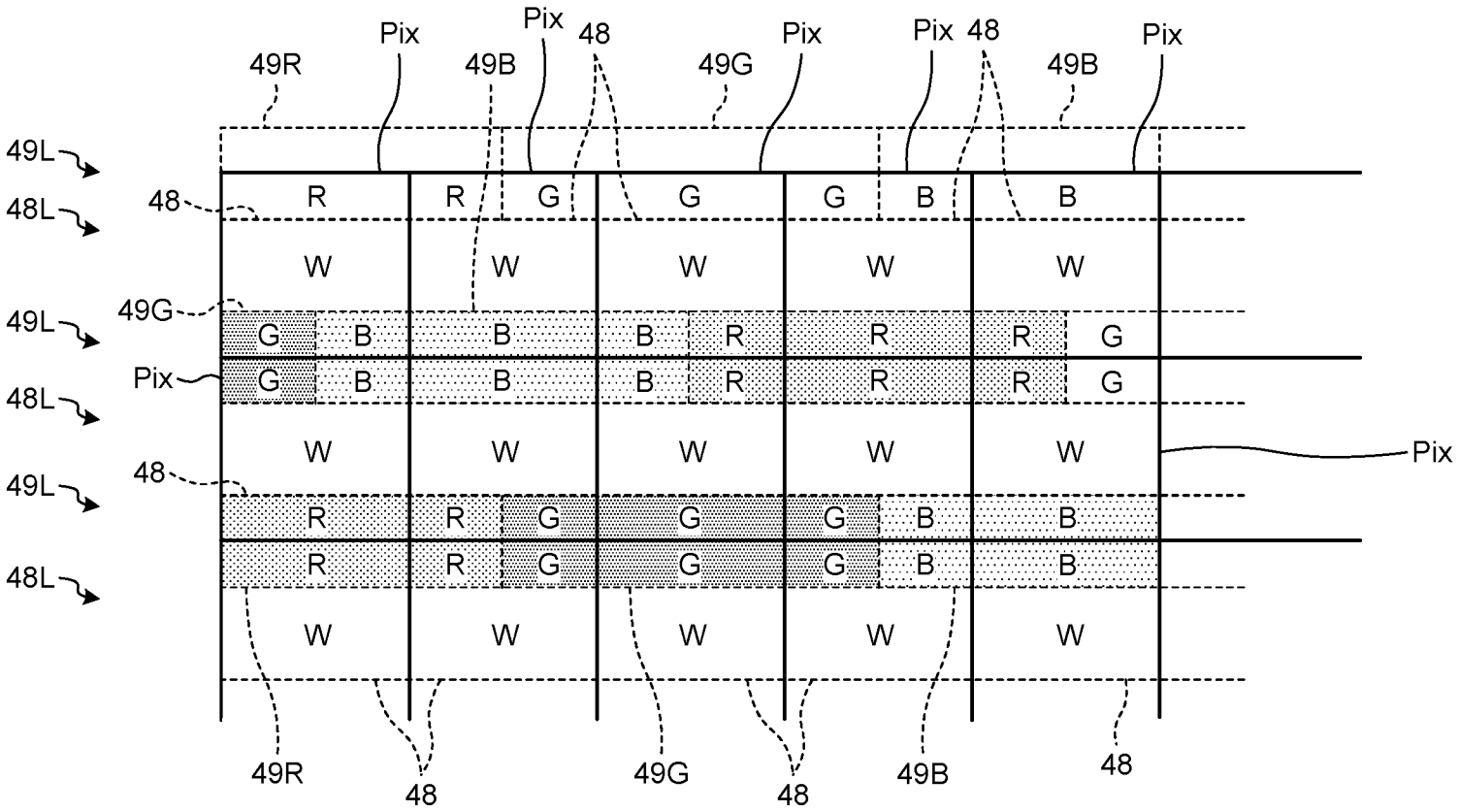
FIG. 21 is a diagram illustrating a relation between the unit pixel regions and the arrangement of the pixels and the sub-pixels according to Modification 4.

FIG. 20 is a diagram illustrating shapes and an arrangement of the pixels 48 and the sub-pixels 49 according to Modification 4. FIG. 21 is a diagram illustrating a relation between the unit pixel regions Pix and the arrangement of the pixels 48 and the sub-pixels 49 according to Modification 4. The width in the row direction of each of the sub-pixels 49 may be twice the width in the row direction of the pixel 48, as illustrated in FIG. 20. In the case of Modification 4, the sub-pixels 49 are arranged so that, when an intermediate line between two sub-pixels 49 corresponding to two colors of red (R), green (G), and blue (B) in one of two sub-pixel rows 49L facing each other with one pixel row 48L interposed therebetween is extended along the column direction, an intermediate position in the row direction of one sub-pixel 49 corresponding to the other one color in the other row is on the extended intermediate line, and the pixels 48 are arranged so that a boundary line between two pixels 48 in the pixel row 48L is not located on the extended intermediate line. As a result, as illustrated in FIG. 21, the sub-pixel having the first primary color, the sub-pixel having the second primary color, and the sub-pixel having the third primary color can be adjacent to one pixel 48, and one unit pixel region Pix can include all colors of the sub-pixels 49.

The unit pixel region Pix according to Modification 4 has a value of 1.5 [SB]. According to Modification 4, the number of sub-pixels 49 can be smaller than that in Modification 3. Modification 4 is the same as the first embodiment except in the feature described above.

Modification 5

Figure 22:
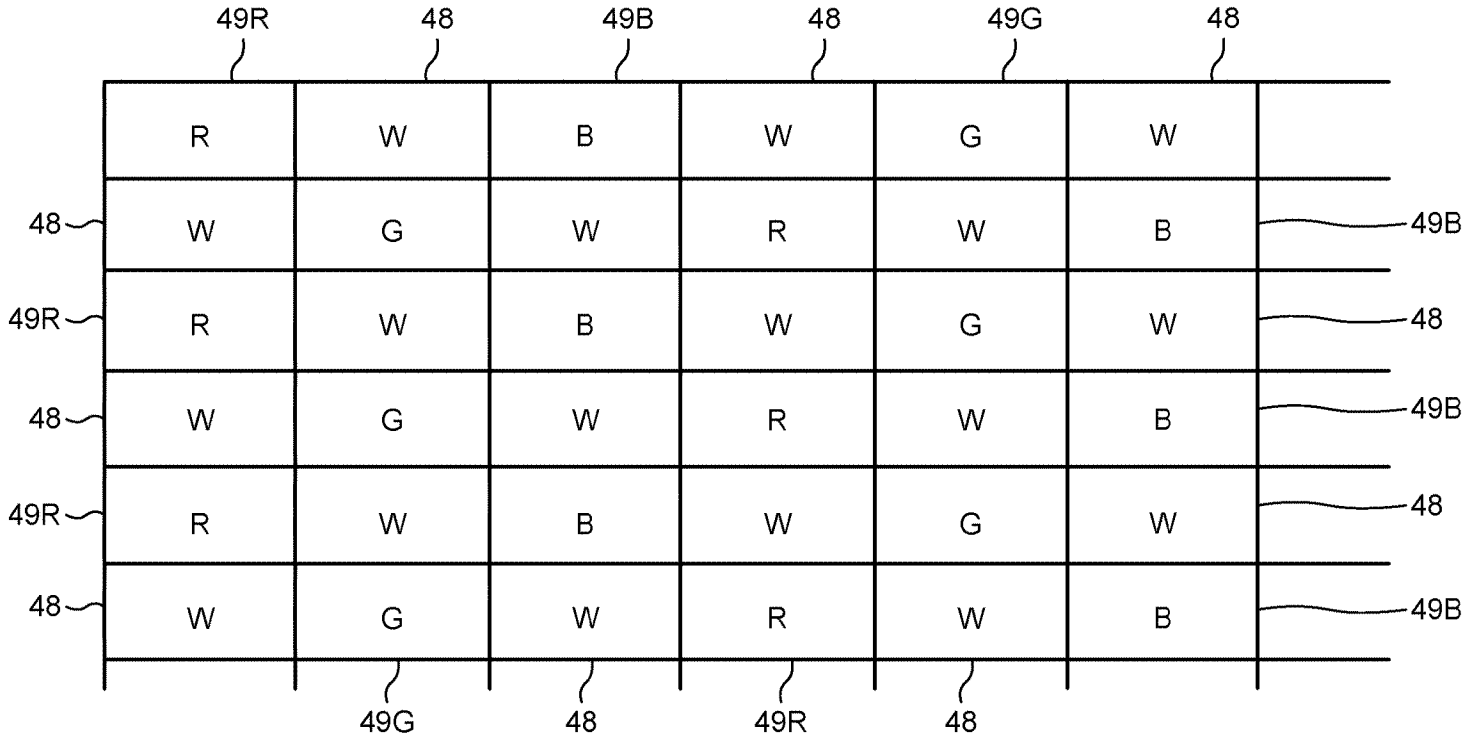
FIG. 22 is a diagram illustrating shapes and an arrangement of the pixels and the sub-pixels according to Modification 5.
Figure 23:
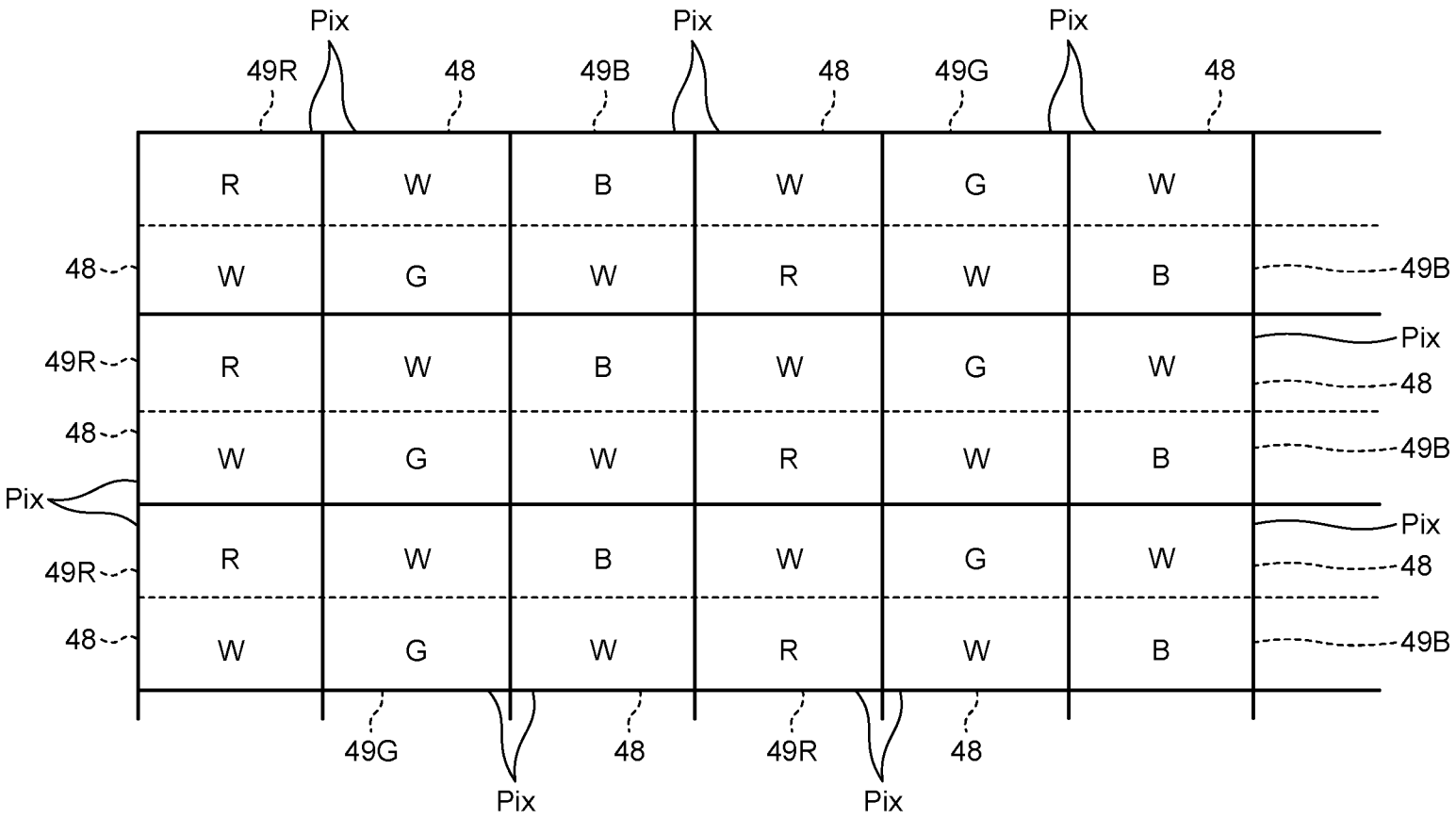
FIG. 23 is a diagram illustrating a relation between the unit pixel regions and the arrangement of the pixels and the sub-pixels according to Modification 5.

FIG. 22 is a diagram illustrating shapes and an arrangement of the pixels 48 and the sub-pixels 49 according to Modification 5. FIG. 23 is a diagram illustrating a relation between the unit pixel regions Pix and the arrangement of the pixels 48 and the sub-pixels 49 according to Modification 5. The pixels 48 and the sub-pixels 49 may be alternately arranged with respect to the row and column directions, as illustrated in FIG. 22. In this case, the pixels 48 are arranged in a staggered manner. The sub-pixels 49 are also arranged in a staggered manner. The sub-pixels 49 of the same color according to Modification 5 are arranged at even intervals in the row direction and at even intervals in the column direction, in the same manner as in the first embodiment. The sub-pixels 49 of the same color in the sub-pixel rows 49L parallel to each other according to Modification 5 are arranged in a staggered manner. As illustrated in FIG. 23, the unit pixel regions Pix according to Modification 5 are arranged in a matrix along the row and column directions. Based on such an arrangement of the unit pixel regions Pix, the pixels 48 are arranged in a staggered manner so that one unit pixel region Pix contains one pixel 48.

Exceptionally among the modifications of the first embodiment, the arrangement in Modification 5 is not such that one unit pixel region Pix includes all colors of the sub-pixels 49.

As illustrated in FIG. 23, the unit pixel region Pix according to Modification 5 is constituted by, for example, one pixel 48 and one sub-pixel 49 adjacent to the pixel 48. The combinations of the pixel 48 and the sub-pixel 49 in the respective unit pixel regions Pix differ from one another. In the case of Modification 5, one unit pixel region Pix does not include all colors of the sub-pixels 49. However, as illustrated in FIG. 22, the sub-pixel having the first primary color, the sub-pixel having the second primary color, and the sub-pixel having the third primary color are adjacent to one pixel 48. Hence, color assignment can be easily performed, for example, by assigning a color component not included in the unit pixel region Pix among components other than the white component indicated by the input signal corresponding to the unit pixel region Pix to a sub-pixel 49 adjacent to the pixel 48 in the unit pixel region Pix. Modification 5 is the same as the first embodiment except in the feature described above.

Modification 6

Figure 24:
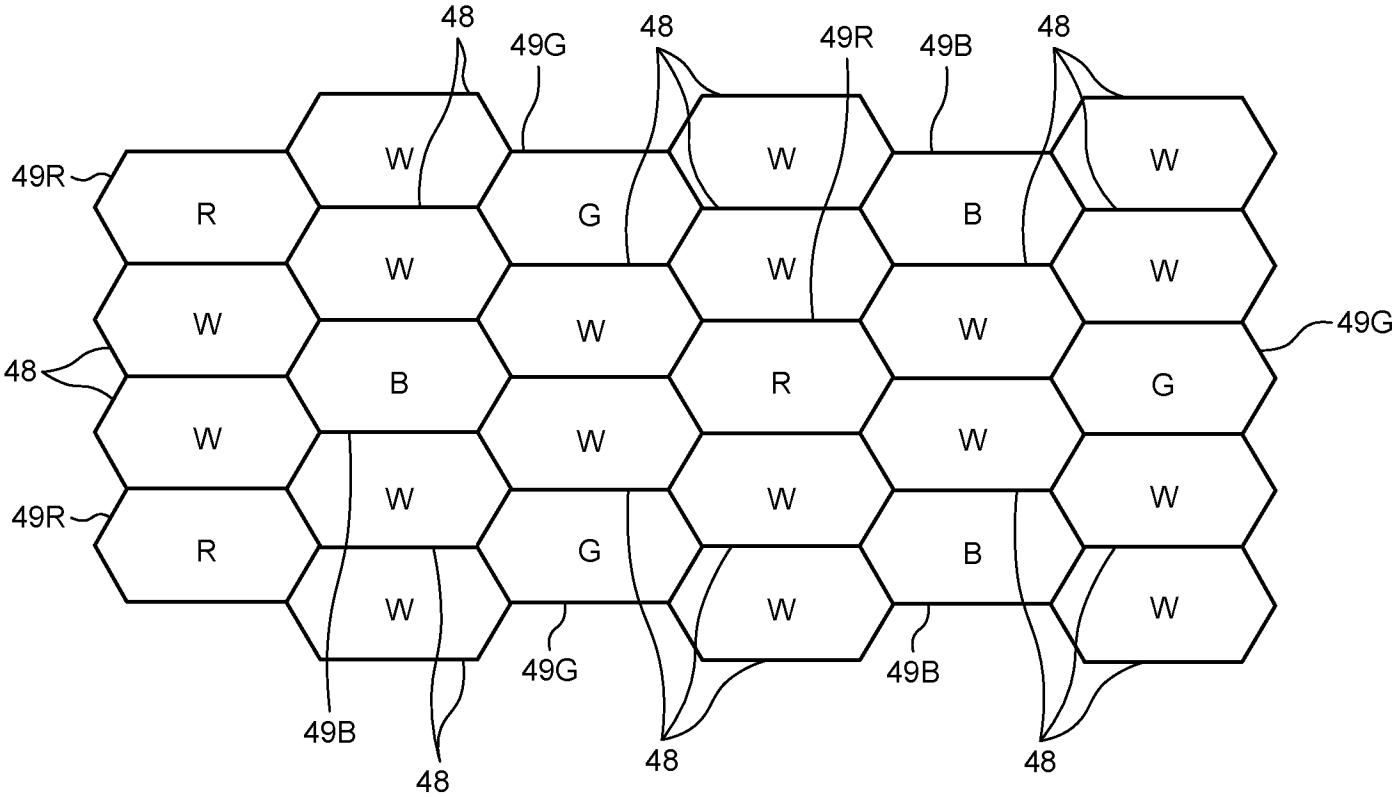
FIG. 24 is a diagram illustrating shapes and an arrangement of the pixels and the sub-pixels according to Modification 6.
Figure 25:
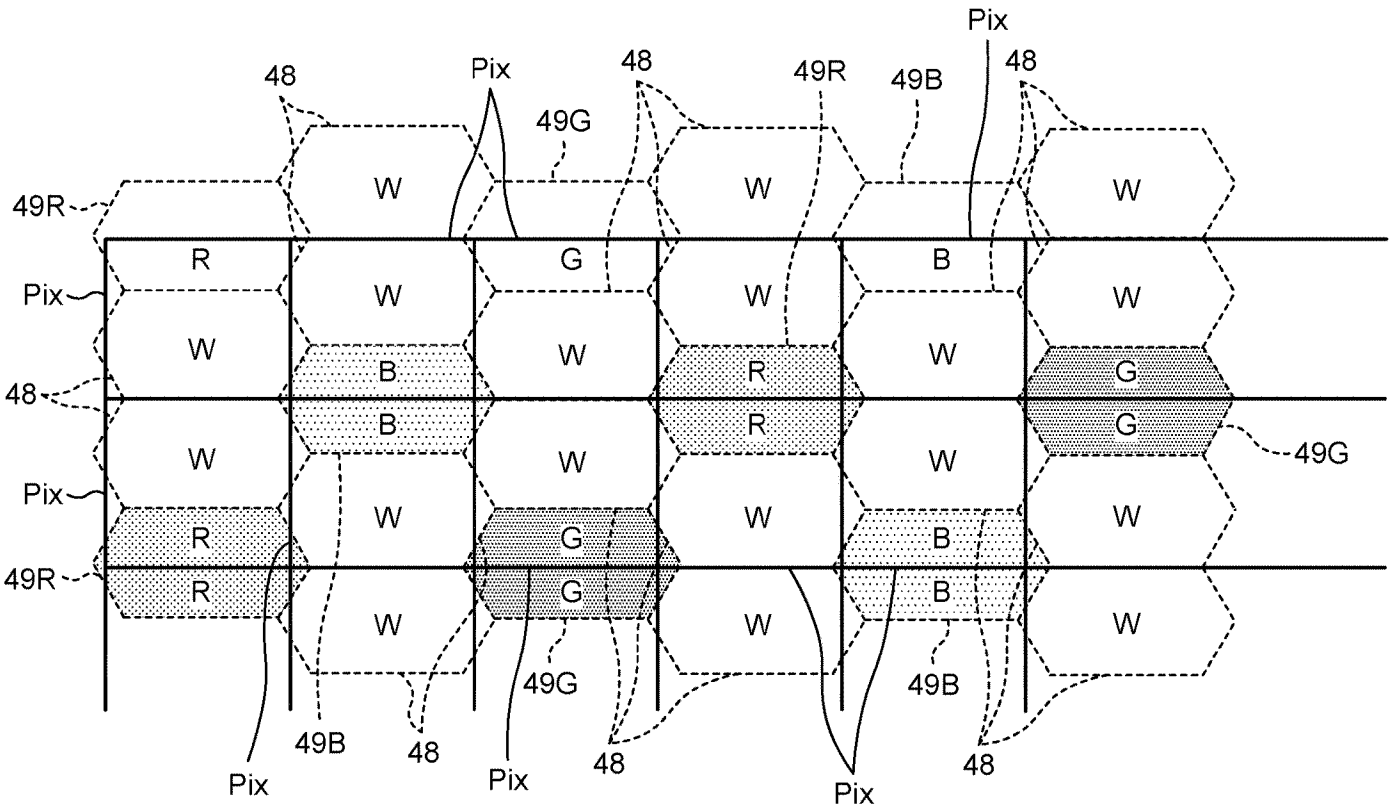
FIG. 25 is a diagram illustrating a relation between the unit pixel regions and the arrangement of the pixels and the sub-pixels according to Modification 6.

FIG. 24 is a diagram illustrating shapes and an arrangement of the pixels 48 and the sub-pixels 49 according to Modification 6. FIG. 25 is a diagram illustrating a relation between the unit pixel regions Pix and the arrangement of the pixels 48 and the sub-pixels 49 according to Modification 6. The pixels 48 and the sub-pixels 49 may have a shape other than a rectangular shape, such as a hexagonal shape, as illustrated in FIG. 24. The pixels 48 and the sub-pixels 49 having such a hexagonal shape can be used to perform the output according to the unit pixel regions Pix having a rectangular shape and arranged in a matrix, as illustrated in FIG. 25. That is, a display device according to Modification 6 can also perform the output according to the image constituted by the pixel data arranged in a matrix. The unit pixel region Pix according to Modification 6 has a value of 1.5 [SB]. According to Modification 6, the number of sub-pixels 49 can be smaller than that in Modification 3.

In the example illustrated in FIG. 24, a region including two pixels 48 adjacent in the column direction serves as one unit region, and one unit region and one sub-pixel 49 are periodically arranged along the column direction. The unit regions are arranged in a staggered manner. The sub-pixels 49 are arranged in a staggered manner. The shape of the pixel 48 is the same as the shape of the sub-pixel 49. The adjacent pixels 48 or the pixel 48 and the sub-pixel 49 adjacent in the row direction are arranged so as to establish a positional relation in which a side of a black matrix forming hexagonal sides is shared. In other words, the black matrix partitioning the adjacent pixels 48 and the sub-pixels 49 forms a shape corresponding to what is called a honeycomb structure in Modification 6. The hexagon forming a shape corresponding to the honeycomb structure is not limited to a regular hexagon. The sub-pixels 49 of the same color according to Modification 6 are arranged at even intervals in the row direction and at even intervals in the column direction, in the same manner as in the first embodiment. The sub-pixels 49 of the same color in the sub-pixel rows 49L parallel to each other according to Modification 6 are arranged in a staggered manner. Also, in Modification 6, the sub-pixel having the first primary color, the sub-pixel having the second primary color, and the sub-pixel having the third primary color are adjacent to one pixel 48, so that one unit pixel region Pix can include all colors of the sub-pixels 49, as illustrated in FIG. 25. In Modification 6, even if any one of the unit pixel regions Pix does not include all colors of the sub-pixels 49, color assignment can be easily performed, for example, by assigning a color component not included in the unit pixel region Pix among components other than the white component indicated by the input signal corresponding to the unit pixel region Pix to a sub-pixel 49 adjacent to the pixel 48 in the unit pixel region Pix, in the same manner as in Modification 5.

As illustrated, for example, in Modification 6, the pixels 48 are adjacent both in the row and column directions, and the sub-pixel having the first primary color, the sub-pixel having the second primary color, and the sub-pixel having the third primary color are adjacent to each of the pixels 48. Hence, colors can be more easily arranged so as to be uniformly dispersed in the effective display region. Consequently, according to Modification 6, irregular color can be more strictly reduced.

The unit pixel regions Pix according to Modification 6 are arranged in a matrix along the row and column directions. Based on such an arrangement of the unit pixel regions Pix, the hexagonal pixels 48 in Modification 6 are arranged so that one unit pixel region Pix contains one pixel 48. In Modification 6, the pixels 48 and the sub-pixels 49 have a hexagonal shape, and the unit pixel regions Pix have a rectangular shape. Modification 6 is a modification of the first embodiment, and the sub-pixel having the first primary color, the sub-pixel having the second primary color, and the sub-pixel having the third primary color are adjacent to one pixel 48. Consequently, one unit pixel region Pix includes all colors of the sub-pixels 49, as illustrated in FIG. 25. Specifically, of the first color, the second color, and the third color serving as the colors of the sub-pixels 49, only one of the colors has a relatively larger area included in the unit pixel region Pix than that of the other colors.

Modification 7

Figure 26:
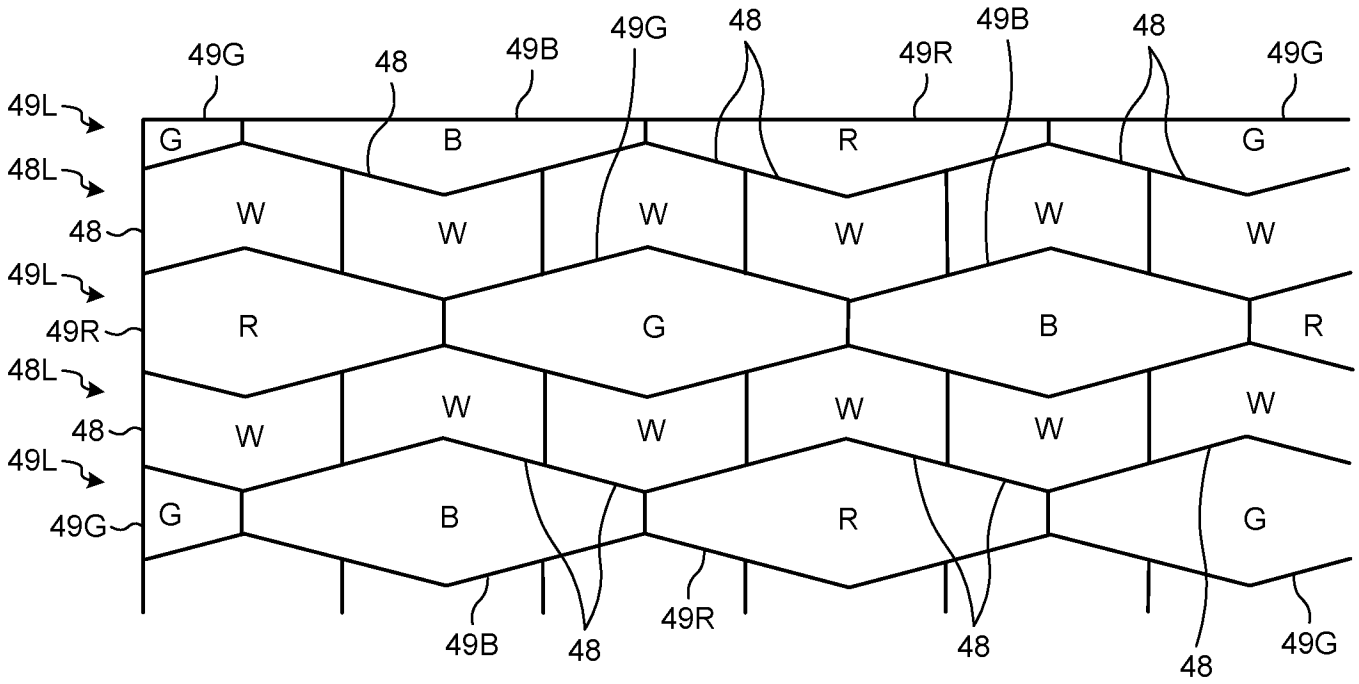
FIG. 26 is a diagram illustrating shapes and an arrangement of the pixels and the sub-pixels according to Modification 7.
Figure 27:
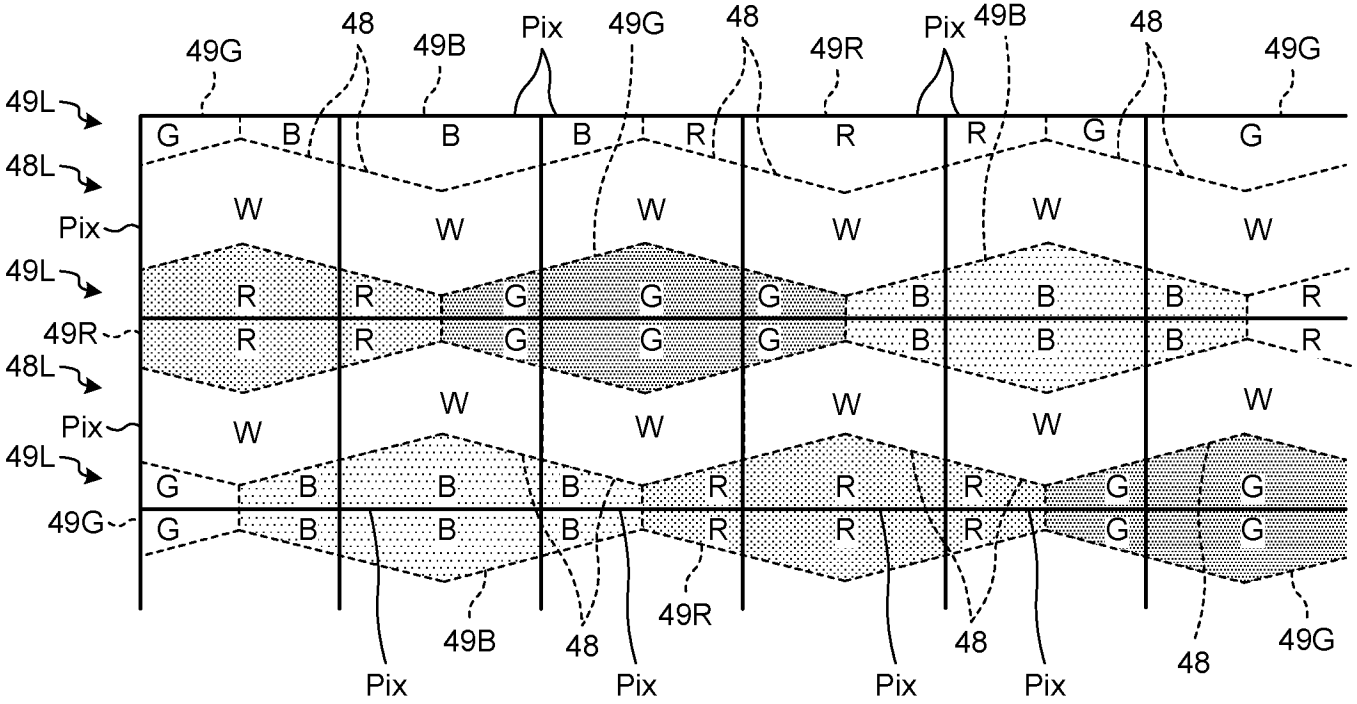
FIG. 27 is a diagram illustrating a relation between the unit pixel regions and the arrangement of the pixels and the sub-pixels according to Modification 7.

FIG. 26 is a diagram illustrating shapes and an arrangement of the pixels 48 and the sub-pixels 49 according to Modification 7. FIG. 27 is a diagram illustrating a relation between the unit pixel regions Pix and the arrangement of the pixels 48 and the sub-pixels 49 according to Modification 7. As illustrated in FIG. 26, the black matrix serving as boundaries between the pixel rows 48L and the sub-pixel rows 49L need not be linear. Specifically, the image display panel 40 may include the pixels 48 having a hexagonal shape having acute angles on one side and obtuse angles on the other side in the column direction, and include the sub-pixels 49 having a shape (such as a pentagonal shape or a hexagonal shape) meshing with the hexagonal pixels 48. Modification 7 is the same as Modification 4 except in the shape of the black matrix serving as the boundaries between the pixel rows 48L and the sub-pixel rows 49L. The unit pixel region Pix according to Modification 7 has a value of 1.5 [SB].

As illustrated in FIG. 26, when the pixels 48 constituting the pixel row 48L are arranged so that the upper-lower relation of the acute angles and the obtuse angles alternates along the row direction, and the pixel rows 48L parallel to each other are not adjacent to each other, the shape of the sub-pixels 49 constituting the sub-pixel row 49L between the pixel rows 48L parallel to each other is hexagonal, and the shape of the sub-pixels 49 at the upper and lower ends is pentagonal.

Modification 7 is the same as Modification 4 in the positional relation between the pixels 48 and the sub-pixel 49 and in the relation between the unit pixel regions Pix and the arrangement of the pixels 48 and the sub-pixels 49. In Modification 7, the position of a boundary line of the unit pixel region Pix is set so that one pixel 48 is in each of the unit pixel regions Pix with respect to the row direction, and so that the sub-pixel 49 in the sub-pixel row 49L between the pixel rows 48L parallel to each other is divided into two in the column direction. As a result, in the same manner as in Modification 4, the sub-pixel having the first primary color, the sub-pixel having the second primary color, and the sub-pixel having the third primary color can be adjacent to one pixel 48, and one unit pixel region Pix can include all colors of the sub-pixels 49, as illustrated in FIG. 27.

Modification 8

Figure 28:
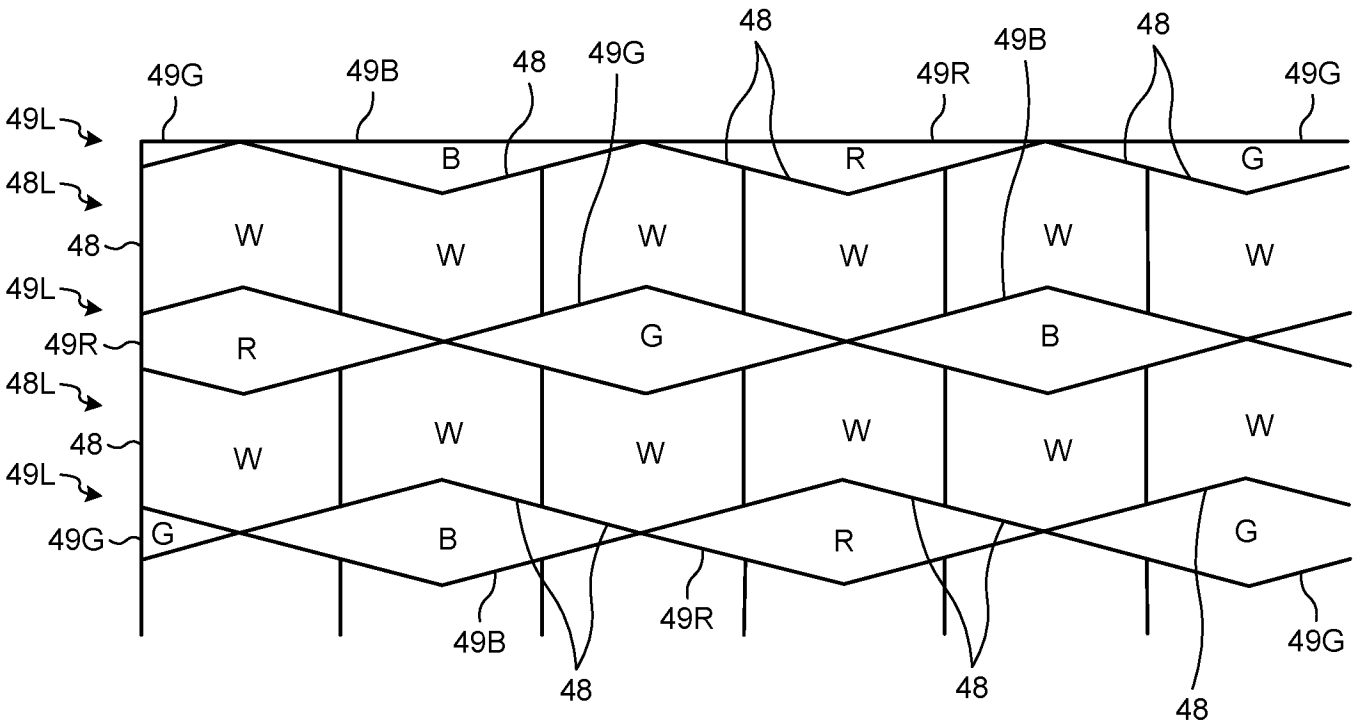
FIG. 28 is a diagram illustrating shapes and an arrangement of the pixels and the sub-pixels according to Modification 8.
Figure 29:
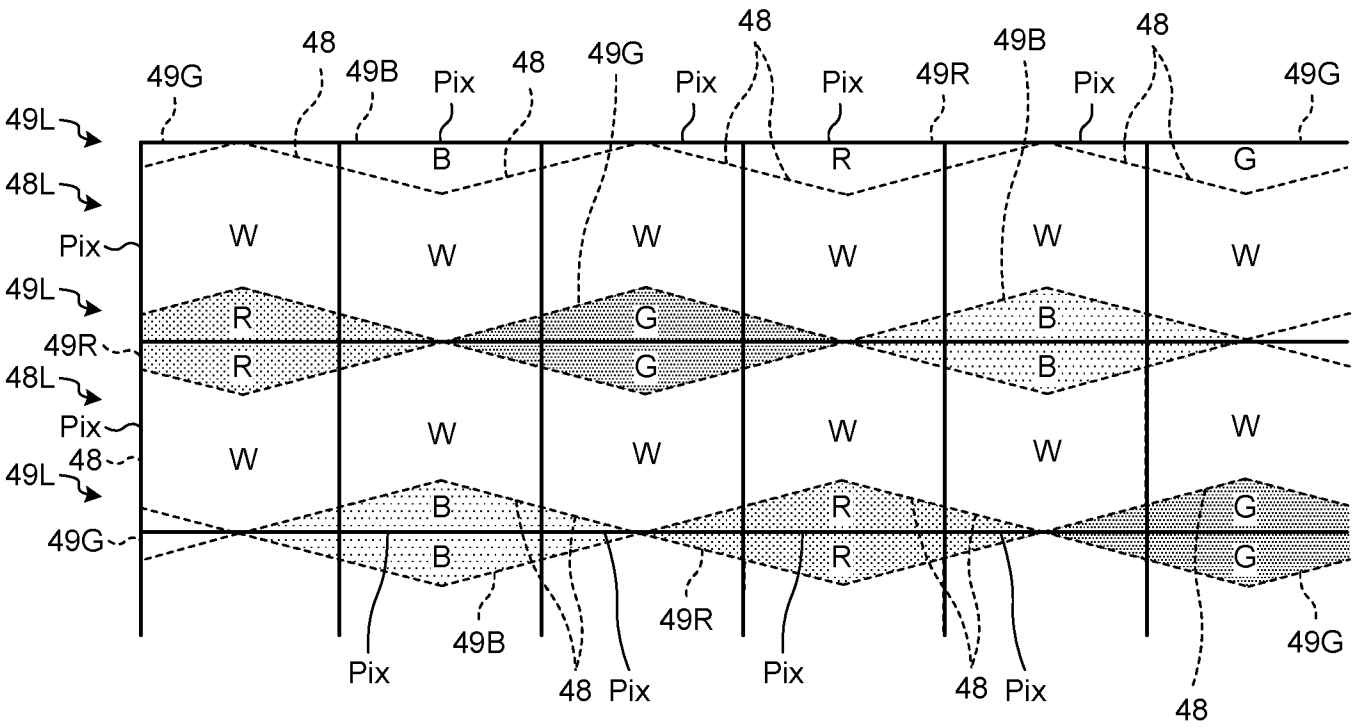
FIG. 29 is a diagram illustrating a relation between the unit pixel regions and the arrangement of the pixels and the sub-pixels according to Modification 8.

FIG. 28 is a diagram illustrating shapes and an arrangement of the pixels 48 and the sub-pixels 49 according to Modification 8. FIG. 29 is a diagram illustrating a relation between the unit pixel regions Pix and the arrangement of the pixels 48 and the sub-pixels 49 according to Modification 8. The sub-pixels 49 may have a quadrilateral shape, such as a rhombic shape, or a triangular shape, as illustrated in FIG. 28. Modification 8 is the same as Modification 7 except in the shape of the sub-pixel 49. The unit pixel region Pix according to Modification 8 has a value of 1.5 [SB]. Specifically, as illustrated in FIG. 28, when the pixels 48 constituting the pixel row 48L are arranged so that the upper-lower relation of the acute angles and the obtuse angles alternates along the row direction, and the acute angles of the pixels 48 in the pixel rows 48L parallel to each other are adjacent to each other, the shape of the sub-pixels 49 constituting the sub-pixel row 49L between the pixel rows 48L parallel to each other is a quadrilateral shape, such as a rhombic shape, and the shape of the sub-pixels 49 at the upper and lower ends is triangular.

In Modification 8, in the same manner as in Modification 7, the position of a boundary line of the unit pixel region Pix is set so that one pixel 48 is in each of the unit pixel regions Pix with respect to the row direction, and so that the sub-pixel 49 in the sub-pixel row 49L between the pixel rows 48L parallel to each other is divided into two in the column direction. As a result, in the same manner as in Modification 4, the sub-pixel having the first primary color, the sub-pixel having the second primary color, and the sub-pixel having the third primary color can be adjacent to one pixel 48, and one unit pixel region Pix can include all colors of the sub-pixels 49, as illustrated in FIG. 29.

Second Embodiment

The following describes a display device according to a second embodiment. In the description of the second embodiment, the same configurations as those in the first embodiment may be denoted by the same reference signs, and descriptions thereof will not be repeated in some cases.

Figure 30:
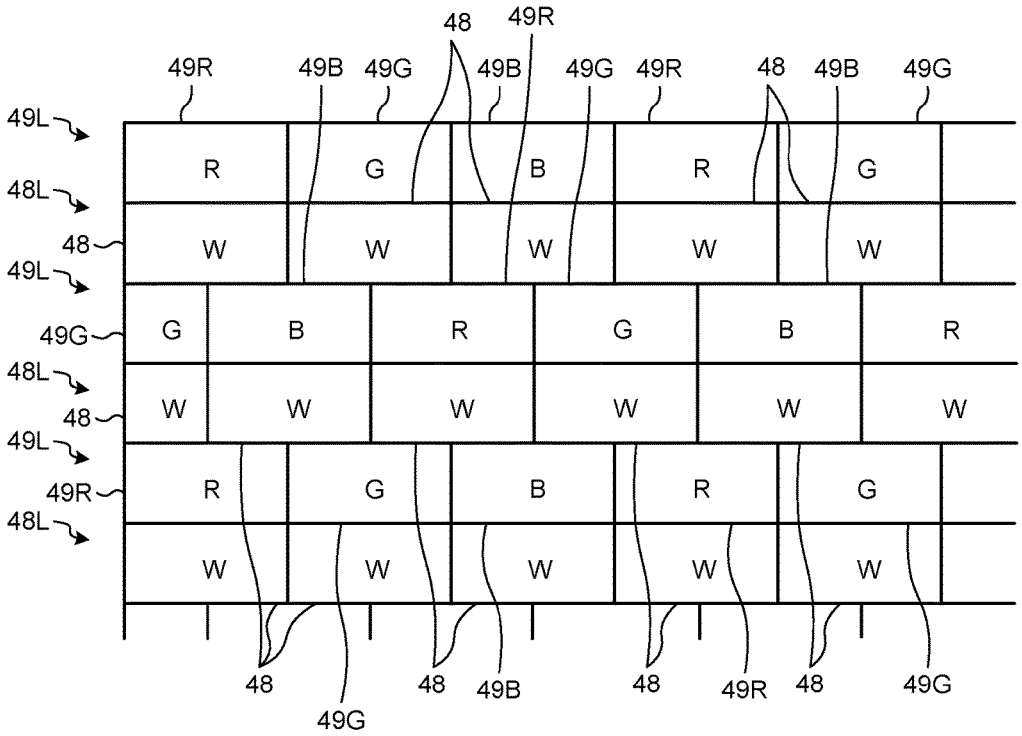
FIG. 30 is a diagram illustrating shapes and an arrangement of the pixels and the sub-pixels according to a second embodiment.
Figure 31:
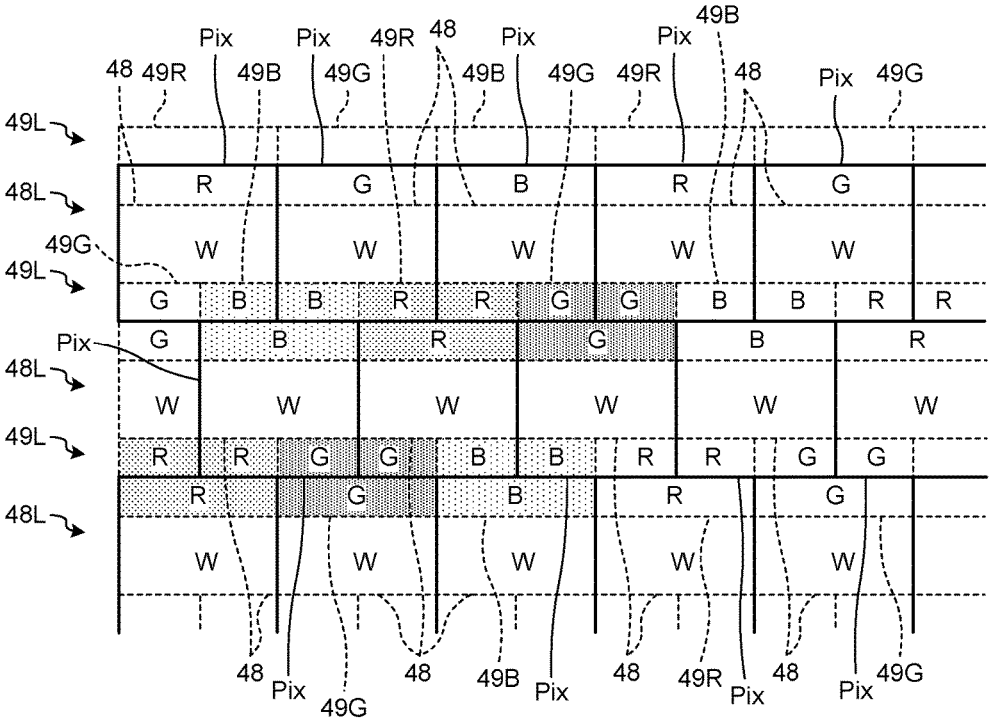
FIG. 31 is a diagram illustrating a relation between the unit pixel regions and the arrangement of the pixels and the sub-pixels according to the second embodiment.

FIG. 30 is a diagram illustrating shapes and an arrangement of the pixels 48 and the sub-pixels 49 according to the second embodiment. FIG. 31 is a diagram illustrating a relation between the unit pixel regions Pix and the arrangement of the pixels 48 and the sub-pixels 49 according to the second embodiment. In the first embodiment, the unit pixel regions Pix are arranged in a matrix along the row and column directions. In the second embodiment, however, the unit pixel regions Pix are arranged in a staggered manner. Specifically, as illustrated in FIG. 30, the pixels 48 constituting the pixel rows 48L are arranged to be shifted on a basis of per pixel row 48L so as to be arranged in a staggered manner. Consequently, in the second embodiment, one sub-pixel 49 is adjacent to one to three pixels 48.

The signal processing unit 20 according to the second embodiment assigns the color components of the sub-pixels 49 so as to collect components other than the white component from three unit pixel regions Pix at the maximum for one sub-pixel 49. The unit pixel region Pix in FIGS. 30 and 31 has a value of 2 [SB]. The second embodiment is the same as the first embodiment except in the feature described above. The first embodiment and the second embodiment differ in whether the unit pixel regions Pix are arranged in a matrix along the row and column directions or in a staggered manner. The first embodiment and the second embodiment differ in the arrangement of the pixels 48 according to such a difference in terms of the unit pixel regions Pix. The second embodiment is the same as the first embodiment in that the sub-pixel having the first primary color, the sub-pixel having the second primary color, and the sub-pixel having the third primary color are adjacent to one pixel 48.

Modifications of Second Embodiment

The following describes Modifications 9 to 11 as modifications according to the second embodiment. In the description of Modifications 9 to 11, the same configurations as those in the second embodiment may be denoted by the same reference signs, and descriptions thereof will not be repeated in some cases. The modifications of the second embodiment are the same as the second embodiment in that the sub-pixels 49 of the same color are arranged at even intervals in the row direction and at even intervals in the column direction. The modifications of the second embodiment are the same as the second embodiment in that the sub-pixels 49 of the same color are arranged in a staggered manner. The modifications of the second embodiment are the same as the second embodiment in that the unit pixel regions Pix are arranged in a staggered manner.

Modification 9

Figure 32:
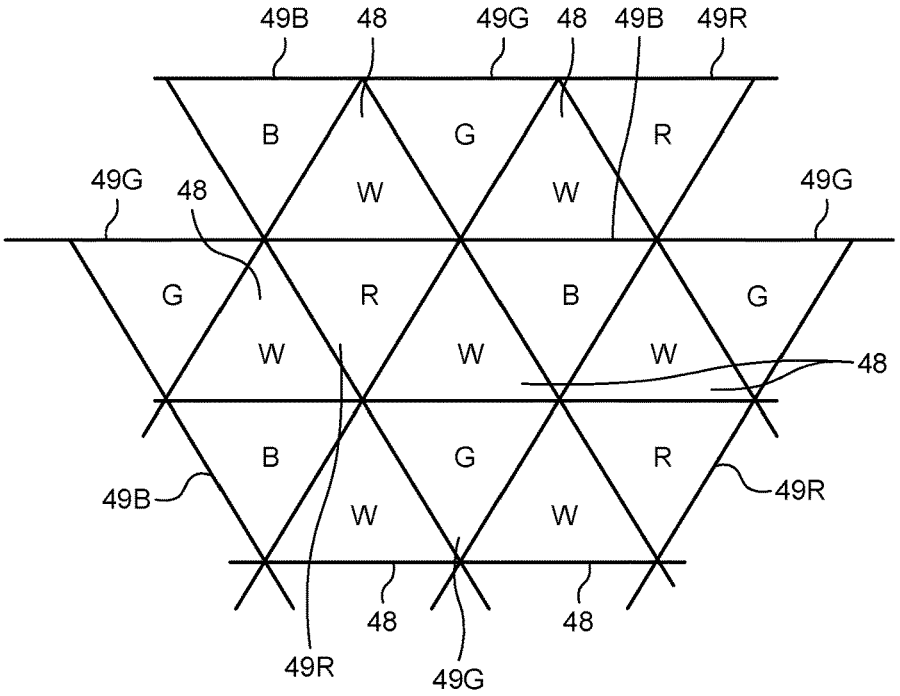
FIG. 32 is a diagram illustrating shapes and an arrangement of the pixels and the sub-pixels according to Modification 9.
Figure 33:
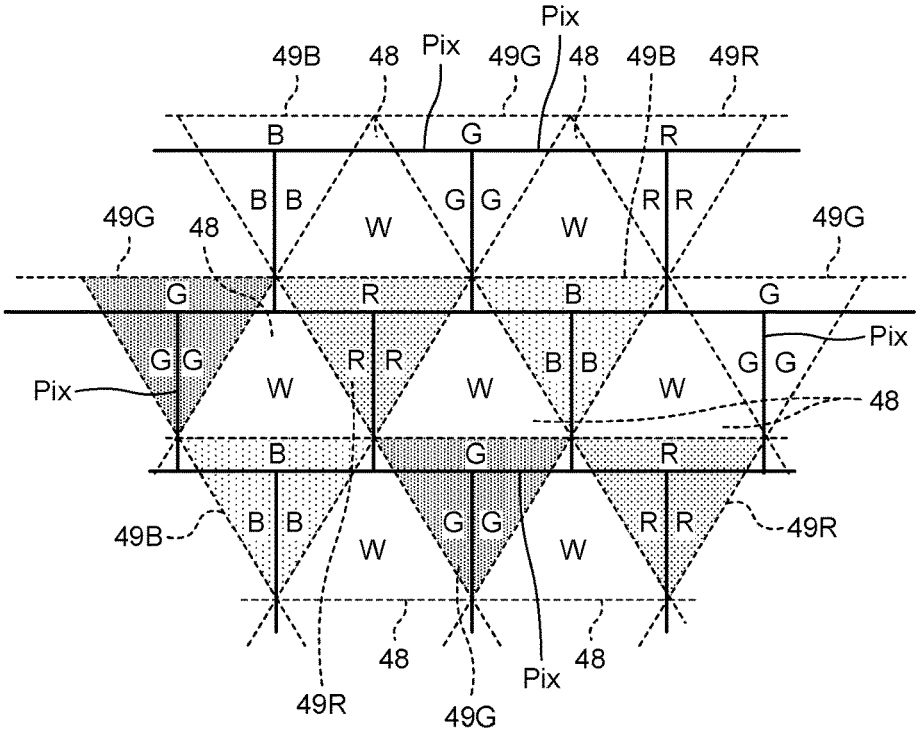
FIG. 33 is a diagram illustrating a relation between the unit pixel regions and the arrangement of the pixels and the sub-pixels according to Modification 9.

FIG. 32 is a diagram illustrating shapes and an arrangement of the pixels 48 and the sub-pixels 49 according to Modification 9. FIG. 33 is a diagram illustrating a relation between the unit pixel regions Pix and the arrangement of the pixels 48 and the sub-pixels 49 according to Modification 9. The pixels 48 and the sub-pixels 49 may have a triangular shape, as illustrated in FIG. 32. The pixels 48 and the sub-pixels 49 having such a triangular shape can be used to perform the output corresponding to the unit pixel regions Pix having a rectangular shape and arranged in a staggered manner, as illustrated in FIG. 33. In Modification 9, the sub-pixel having the first primary color, the sub-pixel having the second primary color, and the sub-pixel having the third primary color are adjacent to one pixel 48.

Specifically, in Modification 9, as illustrated in FIG. 32, the pixels 48 and the sub-pixels 49 are alternately arranged along the row direction, the pixels 48 are arranged in a staggered manner in both of the row direction and the column direction, and the sub-pixels 49 are arranged in a staggered manner in both of the row direction and the column direction. In FIG. 32, the arrangements are such that the pixels 48 have a triangular shape with the base at the bottom, and the sub-pixels 49 have an inverted triangular shape with the base at the top. However, the arrangements of the pixels 48 and the sub-pixel 49 may be exchanged.

The sub-pixels 49 of the same color according to Modification 9 are arranged at even intervals in the row direction and at even intervals in the column direction, in the same manner as in the second embodiment. The sub-pixels 49 of the same color in the sub-pixel rows 49L parallel to each other according to Modification 9 are arranged in a staggered manner. Also, in Modification 9, the sub-pixel having the first primary color, the sub-pixel having the second primary color, and the sub-pixel having the third primary color are adjacent to one pixel 48, so that one unit pixel region Pix can include all colors of the sub-pixels 49, as illustrated in FIG. 33. Modification 9 is the same as the second embodiment except in the feature described above. The unit pixel region Pix according to FIGS. 32 and 33 has a value of 2 [SB].

Modification 10

Figure 34:
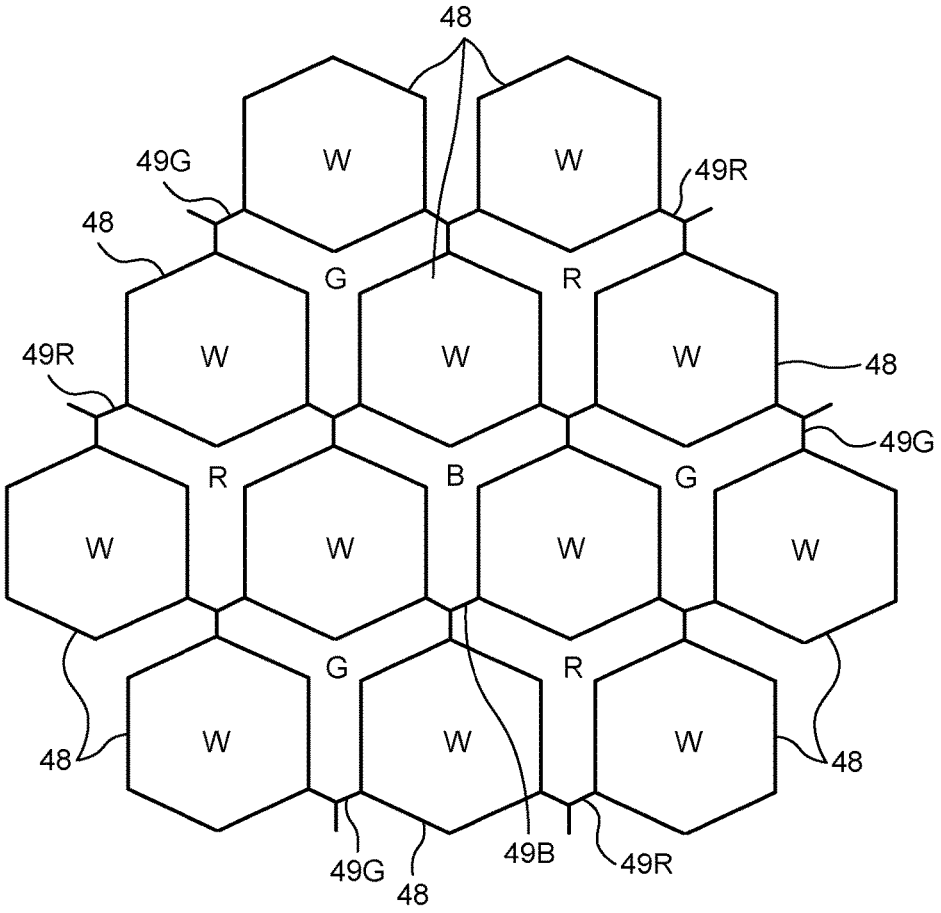
FIG. 34 is a diagram illustrating shapes and an arrangement of the pixels and the sub-pixels according to Modification 10.
Figure 35:
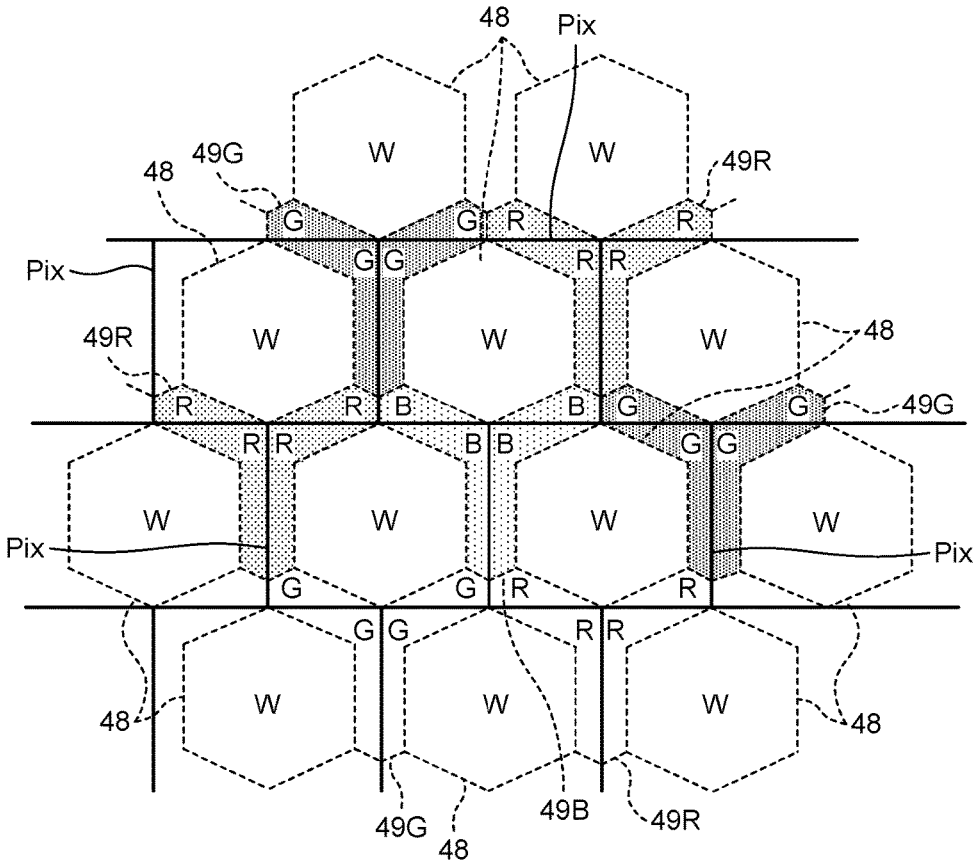
FIG. 35 is a diagram illustrating a relation between the unit pixel regions and the arrangement of the pixels and the sub-pixels according to Modification 10.

FIG. 34 is a diagram illustrating shapes and an arrangement of the pixels 48 and the sub-pixels 49 according to Modification 10. FIG. 35 is a diagram illustrating a relation between the unit pixel regions Pix and the arrangement of the pixels 48 and the sub-pixels 49 according to Modification 10. The pixels 48 may have a polygonal shape, such as a hexagonal shape, having five or more apexes, as illustrated in FIG. 34. The sub-pixels 49 may have a shape (such as a Y-shape) that fills gaps between such polygonal pixels 48. The Modification 10 is the same as the Modification 9 except in the specific shapes of the pixels 48 and the sub-pixels 49. For example, as illustrated in FIG. 35, the unit pixel regions Pix are set so that the centers of the unit pixel regions Pix coincide with the centers of the pixels 48. As a result, the output can be performed corresponding to the unit pixel regions Pix having a rectangular shape and arranged in a staggered manner, in the same manner as in Modification 9. The unit pixel region Pix according to FIGS. 34 and 35 has a value of 2 [SB]. In Modification 10, the sub-pixel having the first primary color, the sub-pixel having the second primary color, and the sub-pixel having the third primary color are adjacent to one pixel 48.

Modification 11

Figure 36:
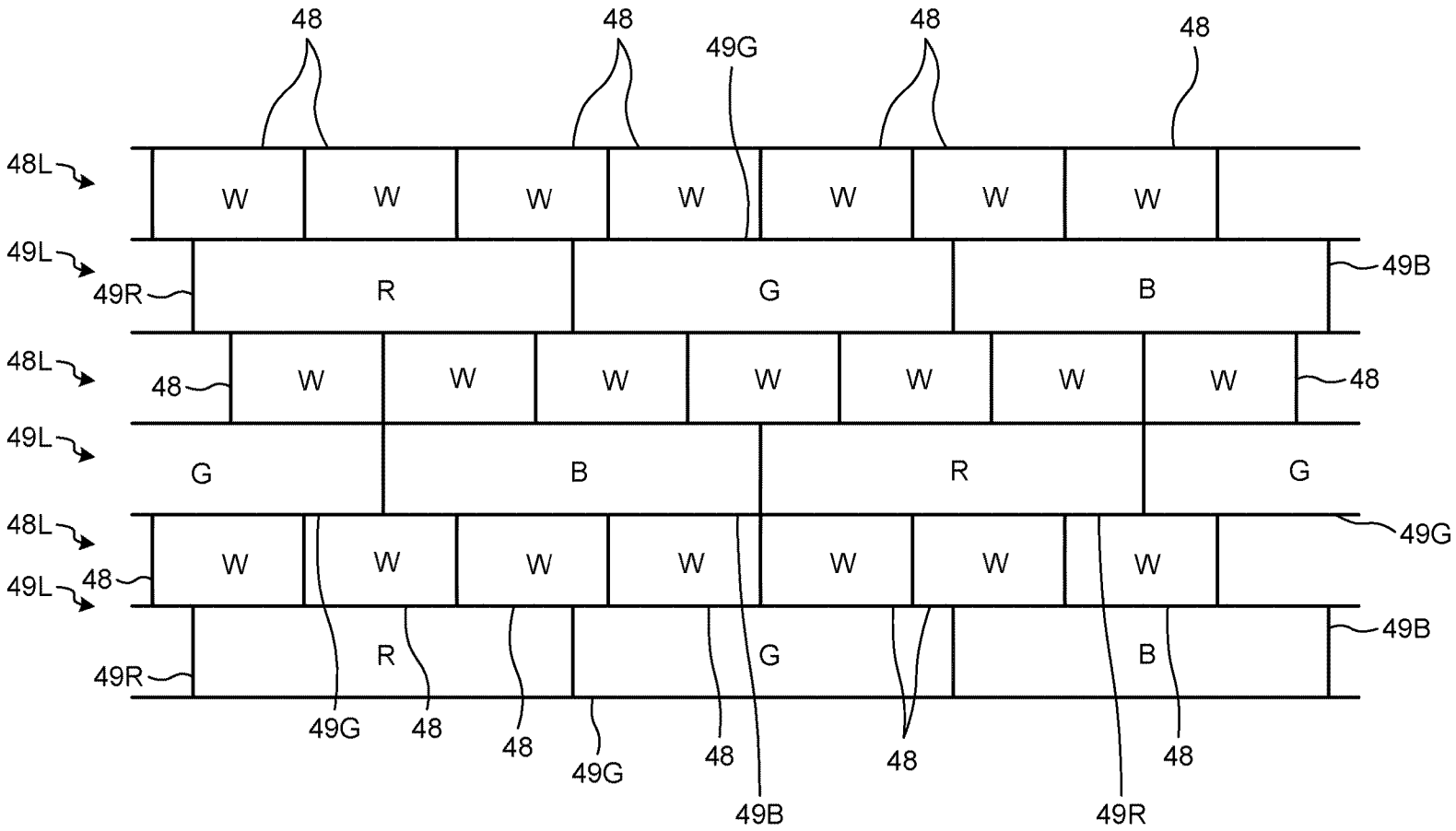
FIG. 36 is a diagram illustrating shapes and an arrangement of the pixels and the sub-pixels according to Modification 11.
Figure 37:
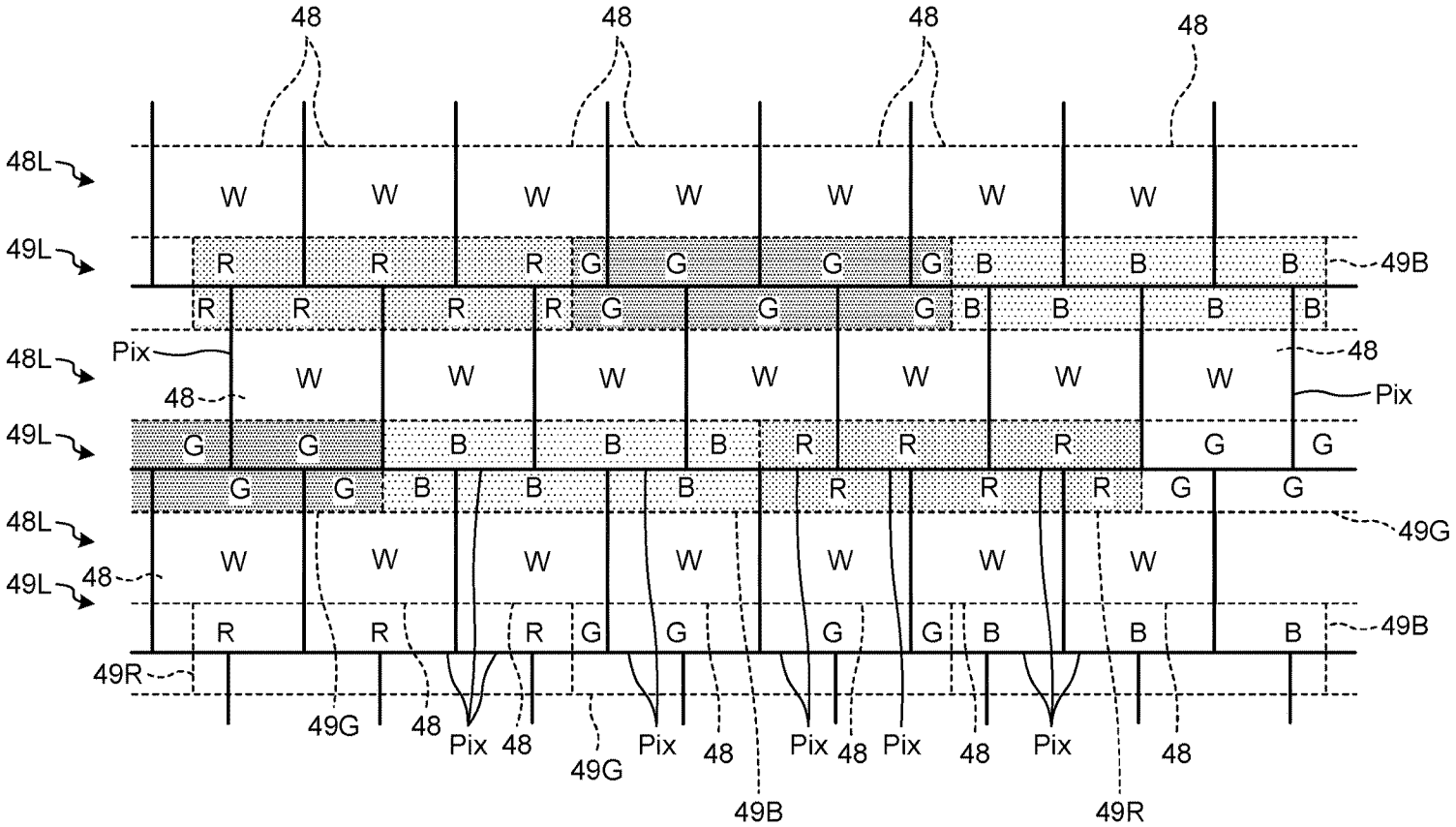
FIG. 37 is a diagram illustrating a relation between the unit pixel regions and the arrangement of the pixels and the sub-pixels according to Modification 11.

FIG. 36 is a diagram illustrating shapes and an arrangement of the pixels 48 and the sub-pixels 49 according to Modification 11. FIG. 37 is a diagram illustrating a relation between the unit pixel regions Pix and the arrangement of the pixels 48 and the sub-pixels 49 according to Modification 11. The width in the row direction of the sub-pixels 49 may exceed twice (for example, may be 2.5 times) the width in the row direction of the pixels 48, as illustrated in FIG. 36. In Modification 11, the sub-pixel having the first primary color, the sub-pixel having the second primary color, and the sub-pixel having the third primary color cannot be adjacent to every pixel 48, but are adjacent to some of the pixels 48. However, two or one of the first, the second, and the third primary colors can be adjacent to every pixel 48. Consequently, in Modification 11, one unit pixel region Pix can include two or more colors of the sub-pixels 49, as illustrated in FIG. 37. In other words, in Modification 11, each of the pixels 48 is not necessarily adjacent to all of the sub-pixel having the first primary color, the sub-pixel having the second primary color, and the sub-pixel having the third primary color.

The signal processing unit 20 according to Modification 11 assigns a color component not included in the unit pixel region Pix among components other than the white component indicated by the input signal corresponding to the unit pixel region Pix to a sub-pixel 49 located outside the unit pixel region Pix. Specifically, the signal processing unit 20 according to Modification 11 assigns a color component not included in the unit pixel region Pix to, for example, a sub-pixel 49 that is a sub-pixel 49 for the color and is closest to the unit pixel region Pix.

The unit pixel region Pix according to Modification 11 has a value of 1.4 [SB]. According to Modification 11, the number of sub-pixels 49 can be smaller than that in the second embodiment. Modification 11 is the same as the second embodiment except in the feature described above.

Third Embodiment

The following describes a display device according to a third embodiment. In the description of the third embodiment, the same configurations as those in the first embodiment may be denoted by the same reference signs, and descriptions thereof will not be repeated in some cases.

Figure 38:
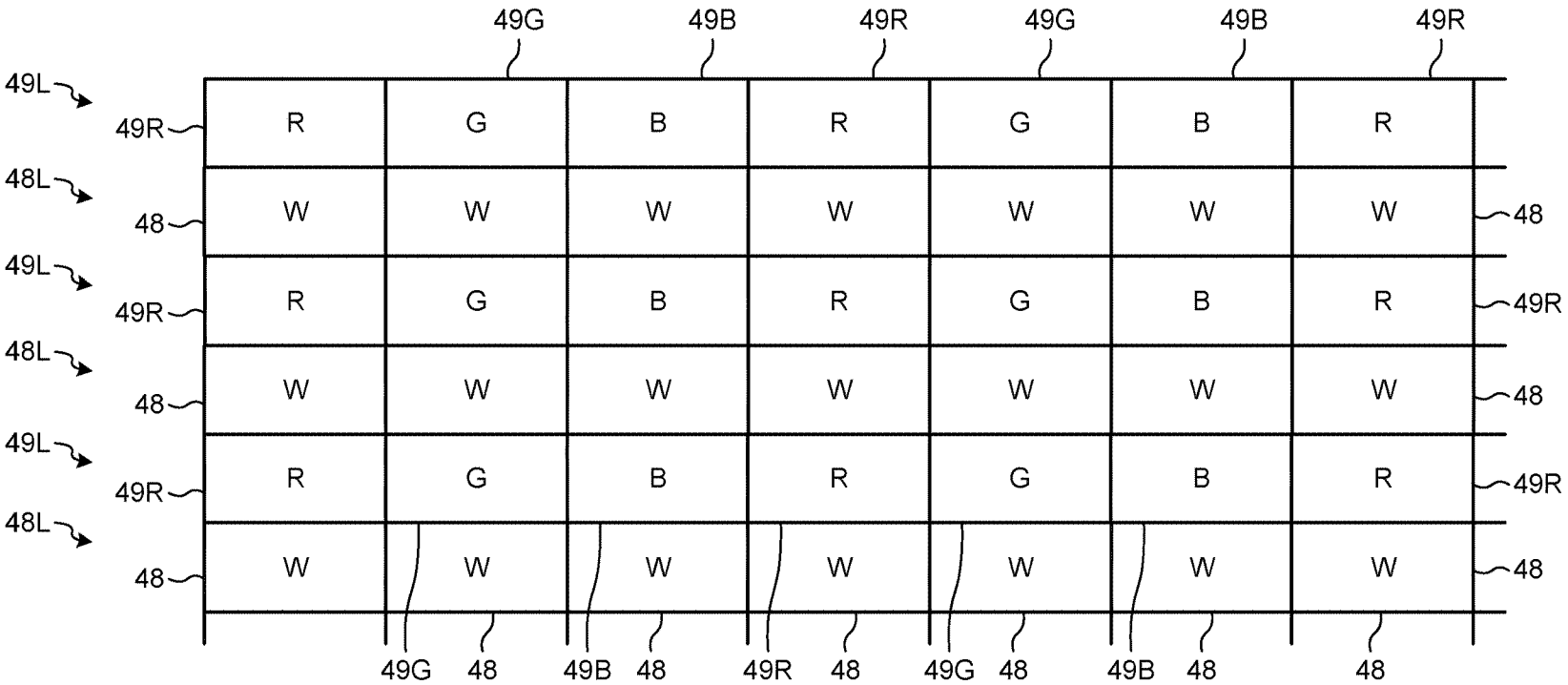
FIG. 38 is a diagram illustrating shapes and an arrangement of the pixels and the sub-pixels according to a third embodiment.
Figure 39:
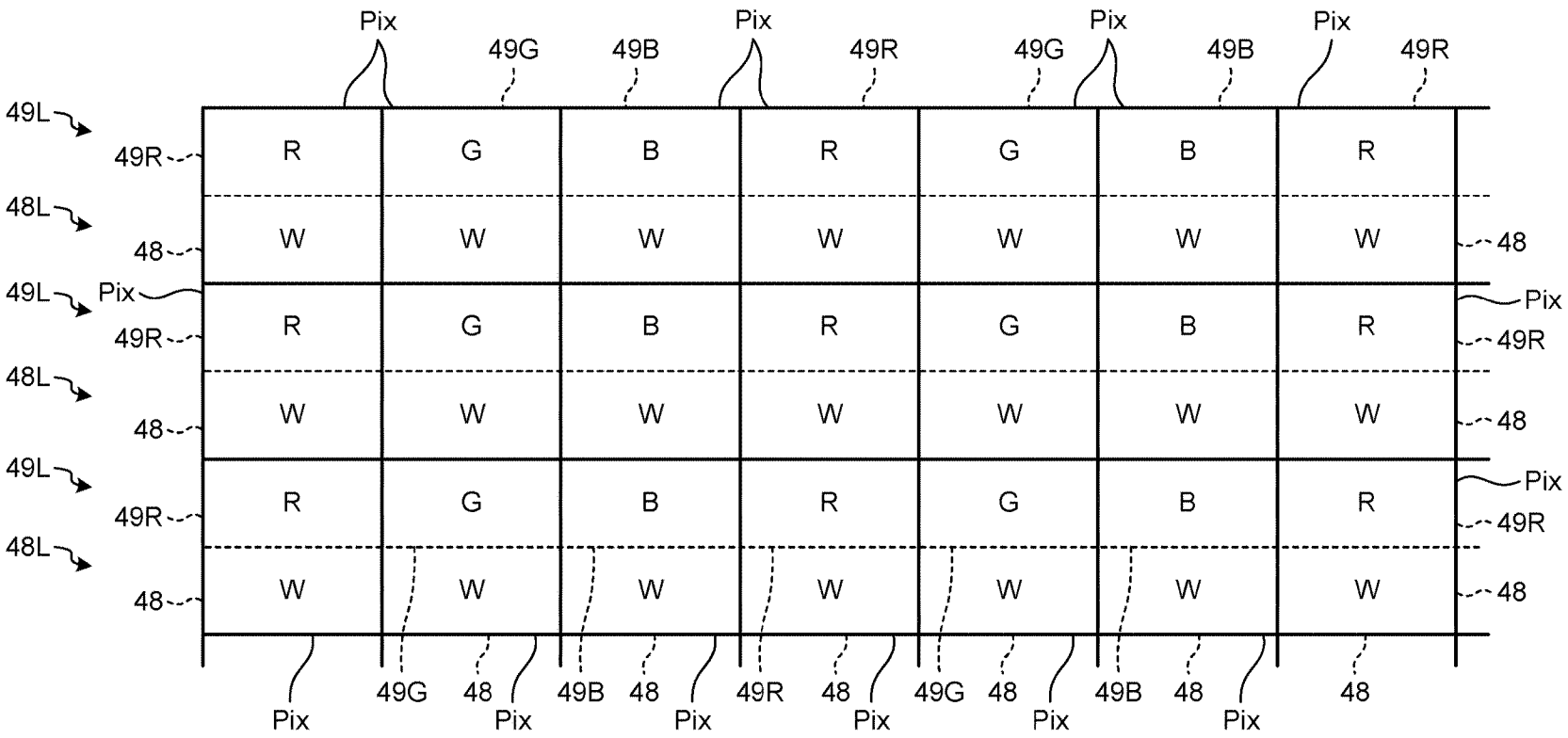
FIG. 39 is a diagram illustrating a relation between the unit pixel regions and the arrangement of the pixels and the sub-pixels according to the third embodiment.

FIG. 38 is a diagram illustrating shapes and an arrangement of the pixels 48 and the sub-pixels 49 according to the third embodiment. FIG. 39 is a diagram illustrating a relation between the unit pixel regions Pix and the arrangement of the pixels 48 and the sub-pixels 49 according to the third embodiment. In the third embodiment, the sub-pixels 49 are arranged in a matrix. Specifically, as illustrated in FIG. 38, the sub-pixels 49 constituting the sub-pixel rows 49L parallel to each other with the pixel row 48L interposed therebetween are arranged so that the sub-pixels 49 closest to each other with respect to the column direction are arranged along the column direction.

As illustrated in FIG. 39, the unit pixel region Pix according to the third embodiment is constituted by, for example, one pixel 48 and one sub-pixel 49 adjacent to the pixel 48. The combinations of the pixel 48 and the sub-pixel 49 in the respective unit pixel regions Pix differ from one another. In the case of the third embodiment, one unit pixel region Pix does not include all colors of the sub-pixels 49. Hence, the signal processing unit 20 according to the third embodiment assigns, for example, a color component not included in the unit pixel region Pix among components other than the white component indicated by the input signal corresponding to the unit pixel region Pix to a sub-pixel 49 located outside the unit pixel region Pix. Specifically, the signal processing unit 20 according to the third embodiment assigns a color component not included in the unit pixel region Pix to, for example, a sub-pixel 49 that is a sub-pixel 49 for the color and is closest to the unit pixel region Pix. The unit pixel region Pix according to FIG. 38 has a value of 2 [SB].

Figure 40:
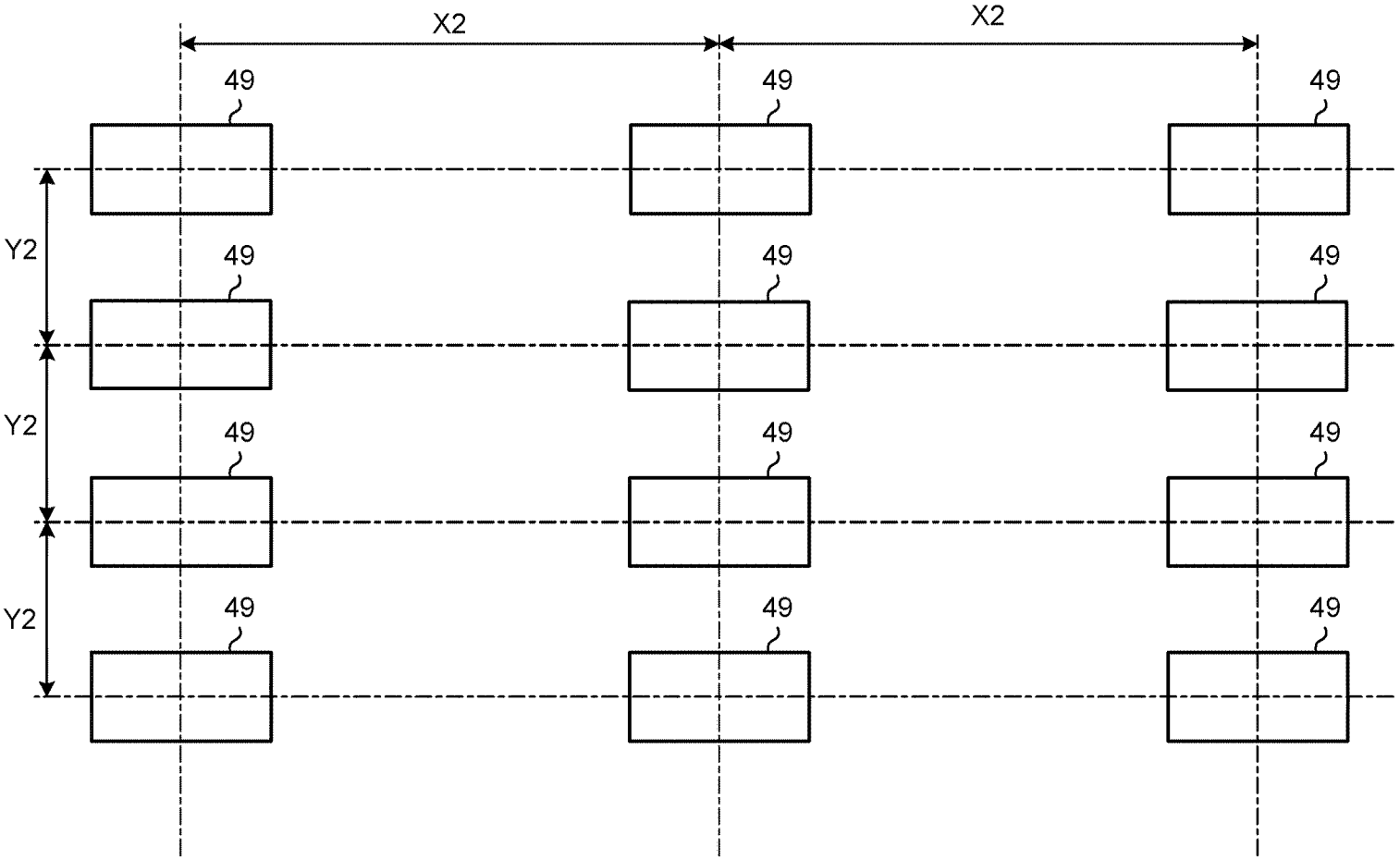
FIG. 40 is a diagram illustrating an arrangement of the sub-pixels of the same color according to the third embodiment.

FIG. 40 is a diagram illustrating an arrangement of the sub-pixels 49 of the same color according to the third embodiment. In the third embodiment, the sub-pixels 49 of the same color are arranged in a matrix along the row and column directions. Specifically, as illustrated in FIG. 40, the sub-pixels 49 of the same color in the sub-pixel rows 49L parallel to each other are arranged along the column direction. The sub-pixels 49 of the same color are spaced at uniform distances X2 in the row direction, thus being arranged at even intervals in the row direction. The sub-pixels 49 of the same color are spaced at uniform distances Y2 in the column direction, thus being arranged at even intervals in the column direction.

The third embodiment is the same as the first embodiment except in the feature described above. The first embodiment and the third embodiment differ in whether the sub-pixels 49 of the same color are arranged in a staggered manner, or arranged in a matrix along the row and column directions. Since the sub-pixels 49 of the same color are arranged in a matrix, the third embodiment includes no pattern in which all of the sub-pixel having the first primary color, the sub-pixel having the second primary color, and the sub-pixel having the third primary color are adjacent to one pixel 48. In the third embodiment, sub-pixels 49 of two colors can be adjacent to one pixel 48 among the sub-pixel having the first primary color, the sub-pixel having the second primary color, and the sub-pixel having the third primary color.

Modifications of Third Embodiment

The following describes Modifications 12 and 13 as modifications according to the third embodiment. In the description of Modifications 12 and 13, the same configurations as those in the third embodiment may be denoted by the same reference signs, and descriptions thereof will not be repeated in some cases. The modifications of the third embodiment are the same as the third embodiment in that the sub-pixels 49 of the same color are arranged at even intervals in the row direction and at even intervals in the column direction. The modifications of the third embodiment are the same as the third embodiment in that the sub-pixels 49 of the same color are arranged in a matrix. The modifications of the third embodiment are the same as the third embodiment in that the unit pixel regions Pix are arranged in a matrix along the row and column directions.

Modification 12

Figure 41:
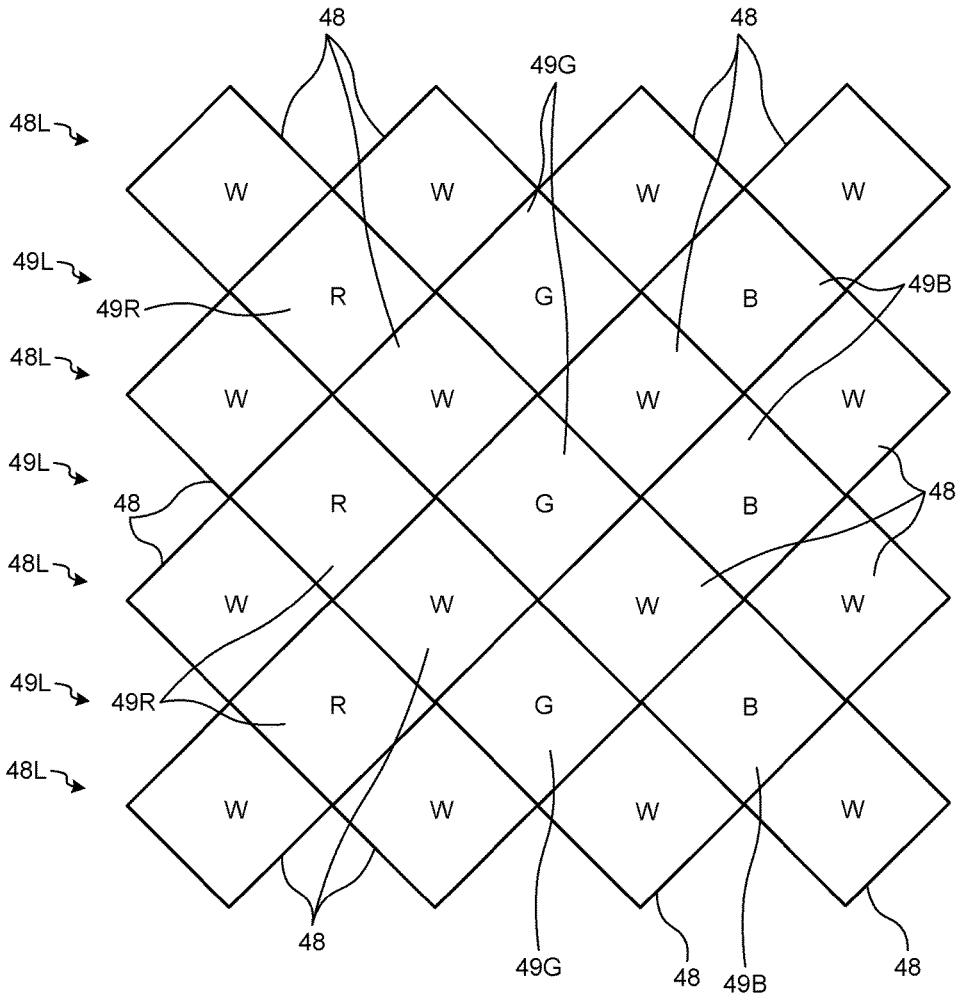
FIG. 41 is a diagram illustrating shapes and an arrangement of the pixels and the sub-pixels according to Modification 12.
Figure 42:
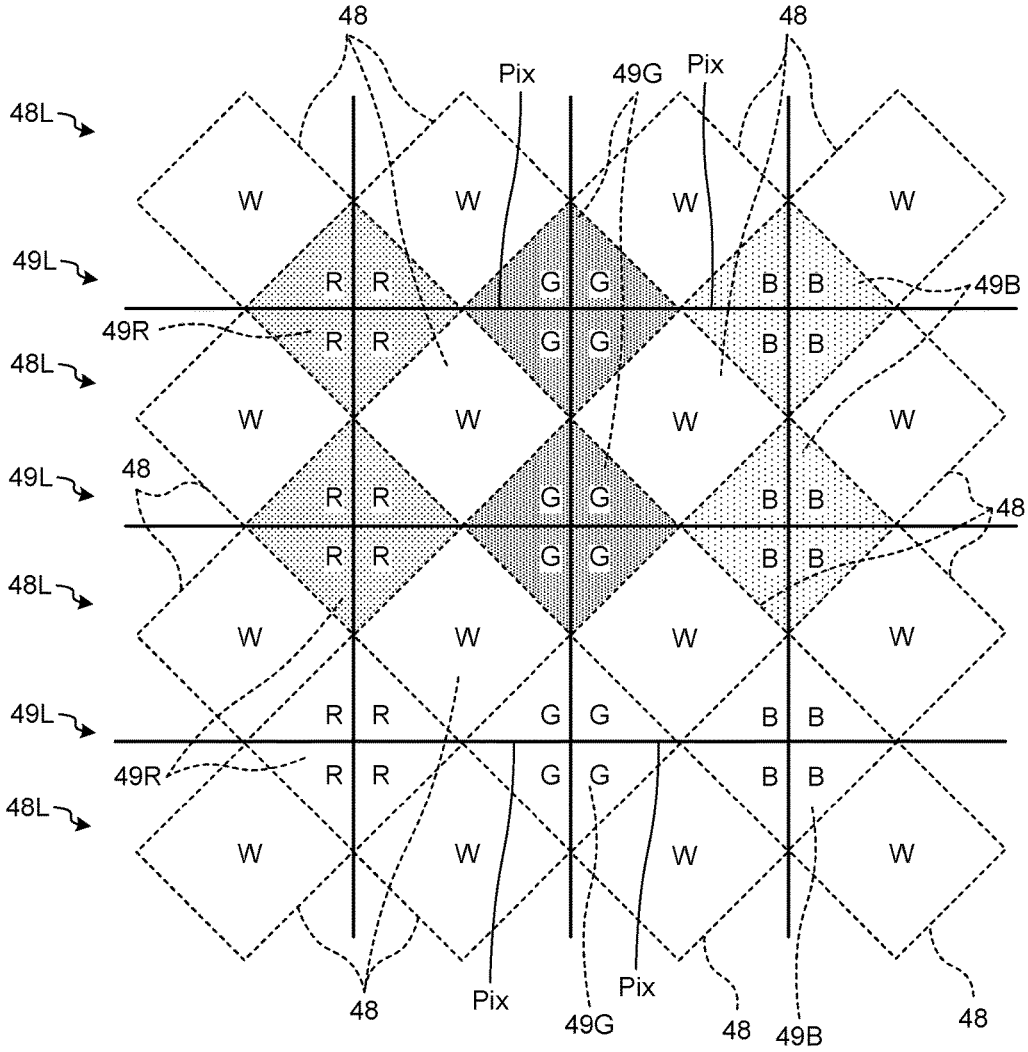
FIG. 42 is a diagram illustrating a relation between the unit pixel regions and the arrangement of the pixels and the sub-pixels according to Modification 12.

FIG. 41 is a diagram illustrating shapes and an arrangement of the pixels 48 and the sub-pixels 49 according to Modification 12. FIG. 42 is a diagram illustrating a relation between the unit pixel regions Pix and the arrangement of the pixels 48 and the sub-pixels 49 according to Modification 12. The black matrix partitioning the pixels 48 and the sub-pixels 49 may be along directions intersecting the row and column directions. Specifically, the pixels 48 may be adjacent to each other at apexes of the shapes (polygons) of the respective pixels 48, and the sub-pixels 49 may be adjacent to each other at apexes of the shapes (polygons) of the respective sub-pixels 49. More specifically, for example, the shape of the pixels 48 and the sub-pixels 49 may be such that the diagonals of the pixels 48 and the sub-pixels 49 are along the row and column directions. In this case, the shape of the pixels 48 and the sub-pixels 49 can be square as illustrated in FIG. 41, or can be rhombic. The pixels 48 and the sub-pixels 49 having such a shape are arranged in a matrix along the row and column directions, as illustrated in FIG. 41. The unit pixel region Pix according to FIG. 41 has a value of 2 [SB].

In Modification 12, two or one of the first, the second, and the third primary colors can be adjacent to every pixel 48. Consequently, in Modification 12, one unit pixel region Pix can include two or more colors of the sub-pixels 49, as illustrated in FIG. 42. Modification 12 is the same as the third embodiment except in the feature described above.

Modification 13

Figure 43:
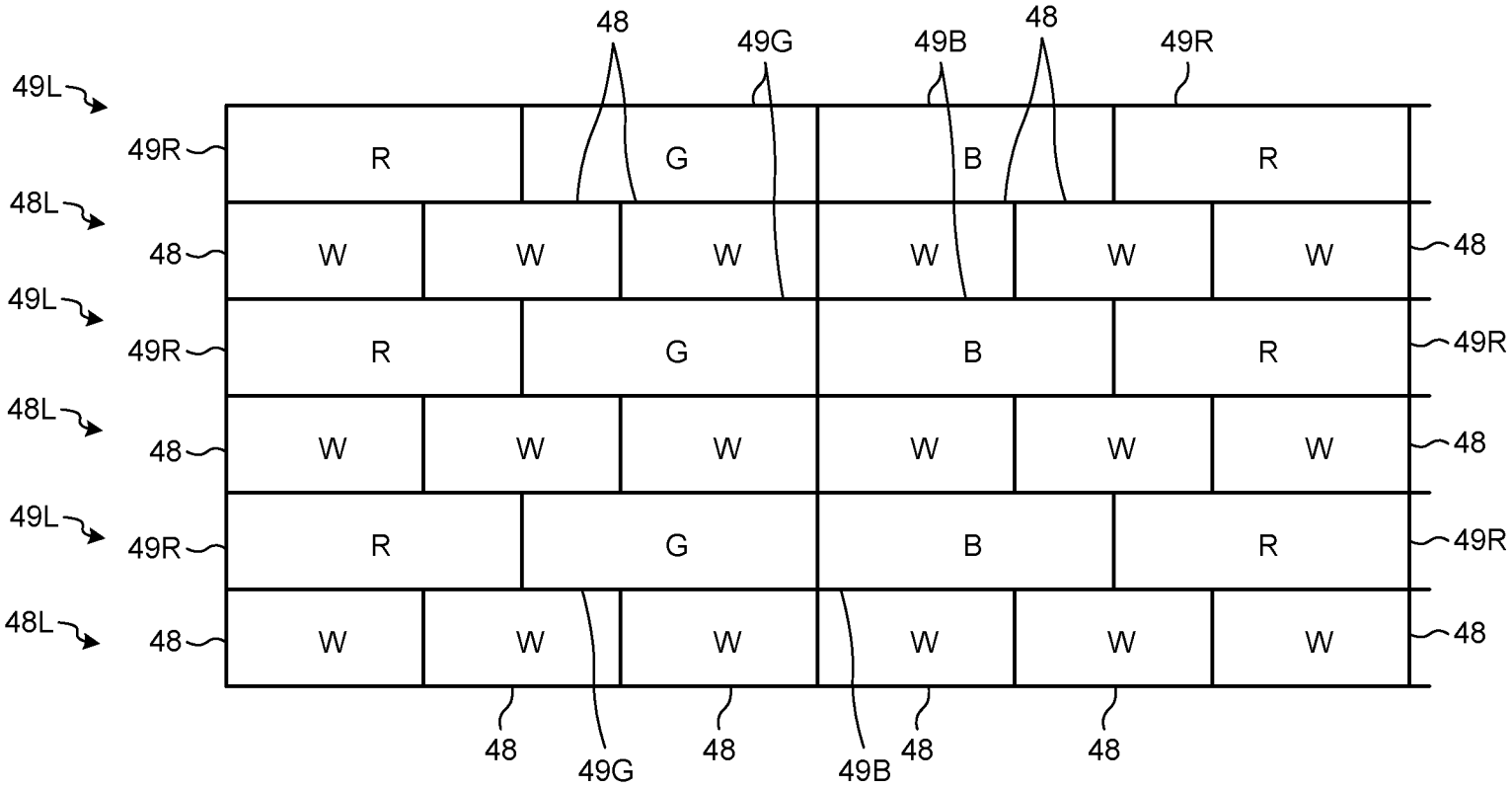
FIG. 43 is a diagram illustrating shapes and an arrangement of the pixels and the sub-pixels according to Modification 13.
Figure 44:
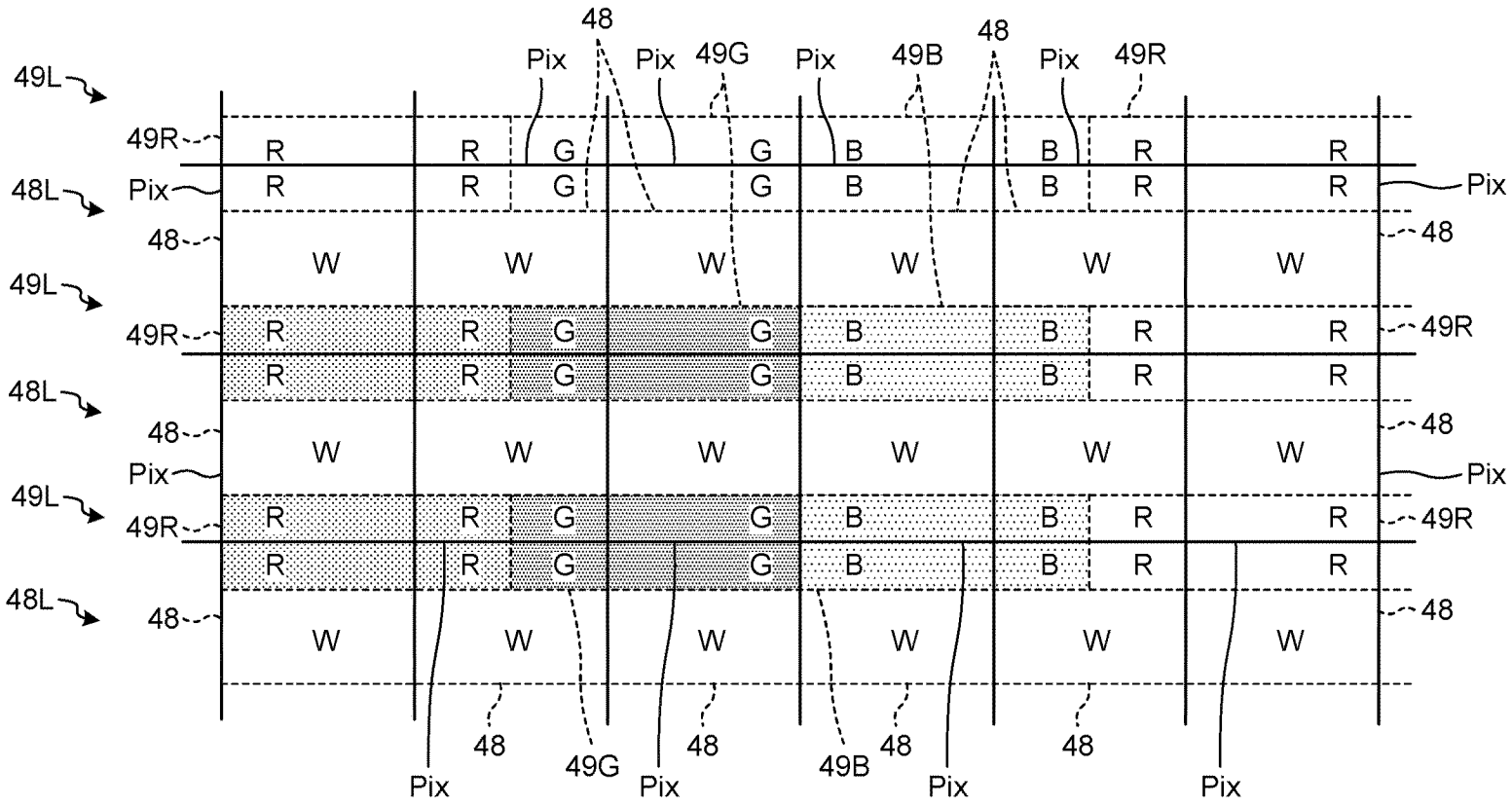
FIG. 44 is a diagram illustrating a relation between the unit pixel regions and the arrangement of the pixels and the sub-pixels according to Modification 13.

FIG. 43 is a diagram illustrating shapes and an arrangement of the pixels 48 and the sub-pixels 49 according to Modification 13. FIG. 44 is a diagram illustrating a relation between the unit pixel regions Pix and the arrangement of the pixels 48 and the sub-pixels 49 according to Modification 13. The width in the row direction of the sub-pixels 49 may differ from (for example, may be 1.5 times) the width in the row direction of the pixels 48, as illustrated in FIG. 43. When the width in the row direction of the sub-pixels 49 is 1.5 times the width in the row direction of the pixels 48, the unit pixel region Pix has a value of 1.67 [SB].

Fourth Embodiment

The following describes a fourth embodiment. In the description of the fourth embodiment, the same configurations as those in the first embodiment may be denoted by the same reference signs, and descriptions thereof will not be repeated in some cases.

Figure 45:
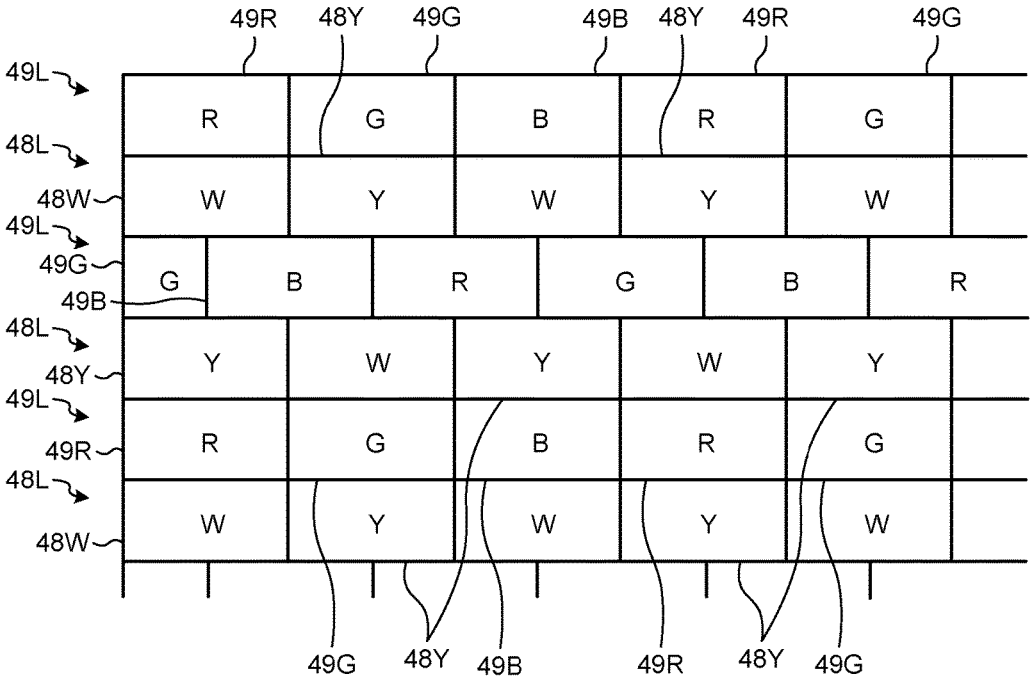
FIG. 45 is a diagram illustrating an example of an arrangement and colors of the pixels and the sub-pixels according to a fourth embodiment.
Figure 46:
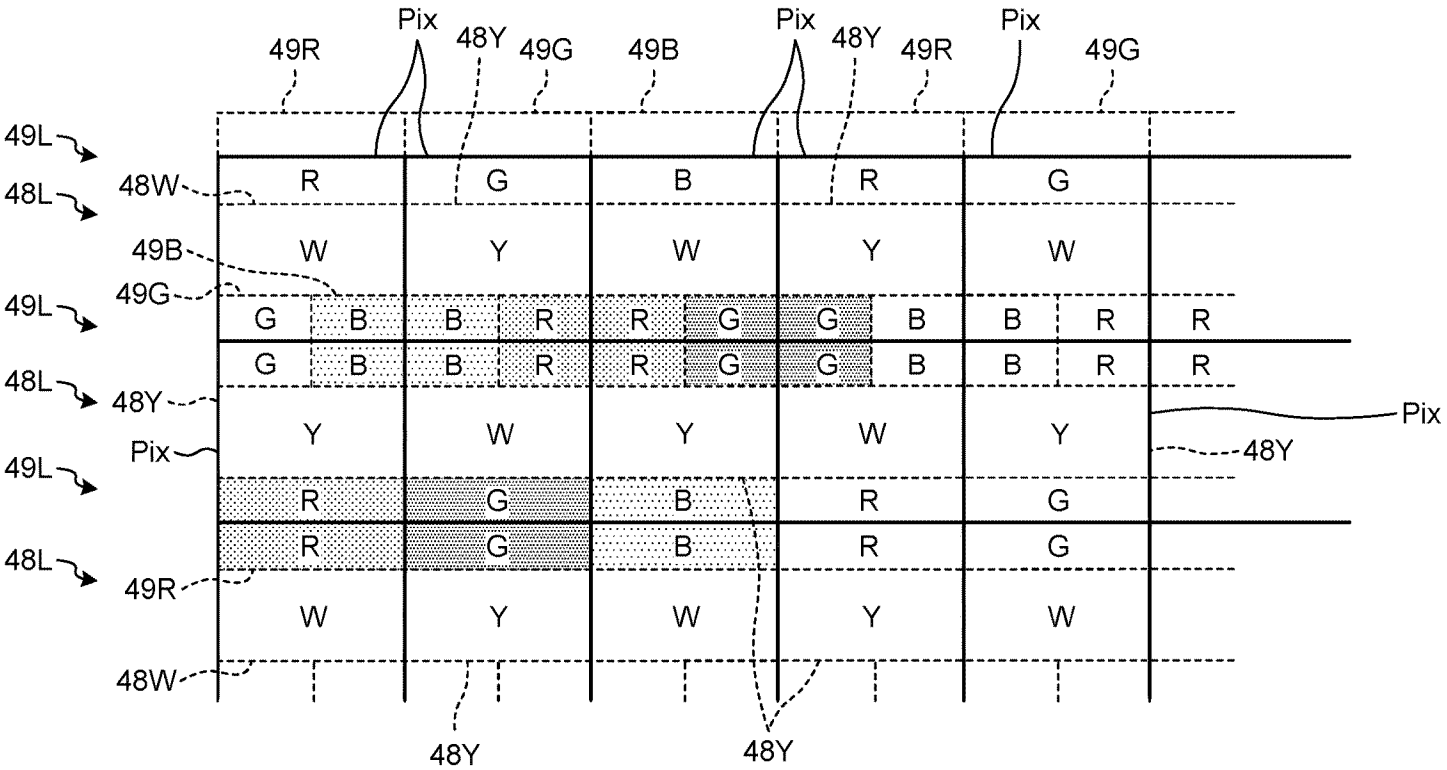
FIG. 46 is a diagram illustrating a relation between the unit pixel regions and the arrangement of the pixels and the sub-pixels according to the fourth embodiment.
Figure 47:
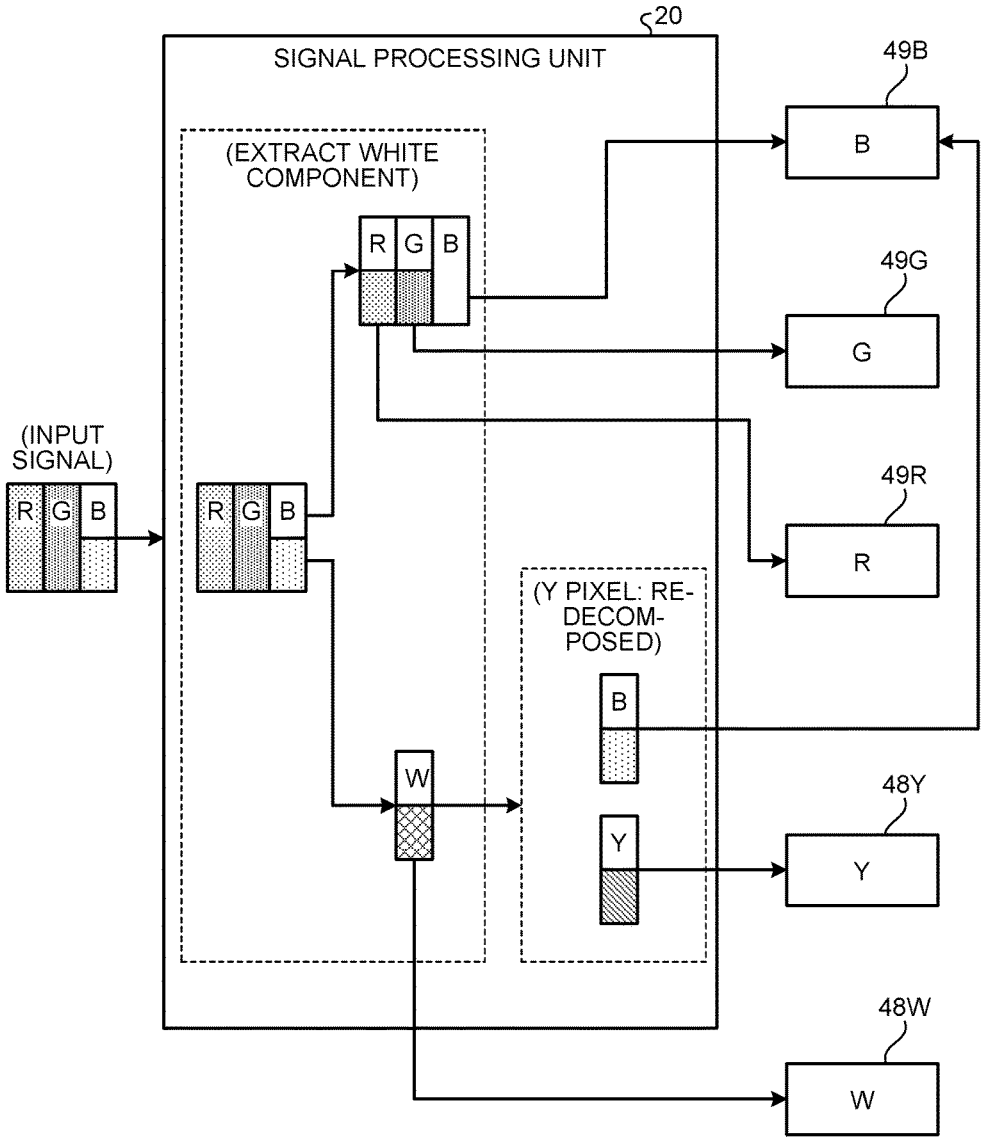
FIG. 47 is a diagram illustrating an example of details of processing performed by a signal processing unit according to the fourth embodiment.

FIG. 45 is a diagram illustrating an example of an arrangement and colors of the pixels 48 and the sub-pixels 49 according to the fourth embodiment. FIG. 46 is a diagram illustrating a relation between the unit pixel regions Pix and the arrangement of the pixels 48 and the sub-pixels 49 according to the fourth embodiment. FIG. 47 is a diagram illustrating an example of details of processing performed by the signal processing unit 20 according to the fourth embodiment. In the fourth embodiment, as illustrated in FIG. 45, white (W) and yellow (Y) are employed as colors of the pixels 48. In this manner, the high-luminance color can be a color other than white (W). In order to distinguish the colors of the pixels 48, a pixel of white (W) is referred to as a pixel 48W, and a pixel of yellow (Y) is referred to as a pixel 48Y.

The signal processing unit 20 according to the fourth embodiment extracts the white component as a component that can be output as white from the color components indicated by the input signal, assigns, to the pixel 48W as the white pixel (W), the white component extracted from the input signal of coordinates at which the white pixel is disposed, assigns, to a yellow pixel 48Y and the sub-pixel of the third primary color, the white component extracted from the input signal of coordinates at which the pixel of yellow (Y) is disposed, and assigns, to the sub-pixels 49, the components other than the white component in the color components indicated by the input signal. Specifically, the signal processing unit 20 according to the fourth embodiment performs processing related to output from the pixel 48W as the white pixel (W) similarly to the processing related to output from the pixel 48 according to the first embodiment. Regarding the pixel 48Y as the pixel of yellow (Y), the signal processing unit 20 re-decomposes the white component into the blue component and the yellow component, assigns the blue component to the third sub-pixel 49B, and assigns the yellow component to the pixel 48Y.

The pixel 48Y as the pixel of yellow (Y) has higher luminance than the colors of the sub-pixels 49 of red (R), green (G), and blue (B). Due to this, luminance center of gravity is present on the pixel 48Y side when both of the third sub-pixel 49B and the pixel 48Y emit light for reproducing the white component. When visually recognizing such a display region including the third sub-pixel 49B and the pixel 48Y, a user recognizes that a light source of white light is lit at the position of the pixel 48Y. Due to this mechanism, the display device according to the fourth embodiment obtains real resolution.

The pixel 48Y is provided, so that, in outputting the yellow component, the yellow component can be output with higher efficiency by causing the pixel of yellow (Y) to be lit as compared with a case of outputting the yellow component by causing the sub-pixels of red (R) and green (G) to be lit. Specifically, light emission efficiency of yellow (Y) in the display device of organic light emitting diode (OLED) type as illustrated in FIG. 3 is as high as that of white (W), so that display output including the yellow component can be performed with higher efficiency and lower power consumption.

The fourth embodiment can be combined with any one of the first to the third embodiments and the modifications thereof. The fourth embodiment is the same as the first embodiment except in the feature described above.

As illustrated in FIGS. 45 and 46, one of the adjacent unit pixel regions Pix includes the pixel 48W and the other thereof includes the pixel 48Y. In the fourth embodiment, as illustrated in FIG. 47, for one of the adjacent unit pixel regions Pix, the signal processing unit 20 extracts the white component from the color components indicated by the input signal, and assigns the white component to the pixel 48W. For the other of the adjacent unit pixel regions Pix, the signal processing unit 20 re-decomposes the white component into the blue component and the yellow component, and assigns the yellow component to the pixel 48Y and the blue component to the third sub-pixel 49B.

FIGS. 45 and 46 exemplify a configuration in which the color of some of the pixels 48 that are all white (W) in FIGS.

2 and 9 is replaced with yellow (Y). However, the specific shapes and arrangement of the pixels 48 and the sub-pixels 49 according to the fourth embodiment are not limited to this example. The feature of the fourth embodiment can be applied to the second and the third embodiments and the modifications of the first to the third embodiments.

The high luminance colors are white (W) and yellow (Y) in the fourth embodiment, so that resolution obtained by reproducing contrast and the display output with high efficiency and low power consumption due to presence of yellow (Y) can both be achieved.

Fifth Embodiment

The following describes a fifth embodiment. In the description of the fifth embodiment, the same configurations as those in the first embodiment may be denoted by the same reference signs, and descriptions thereof will not be repeated in some cases.

Figure 48:
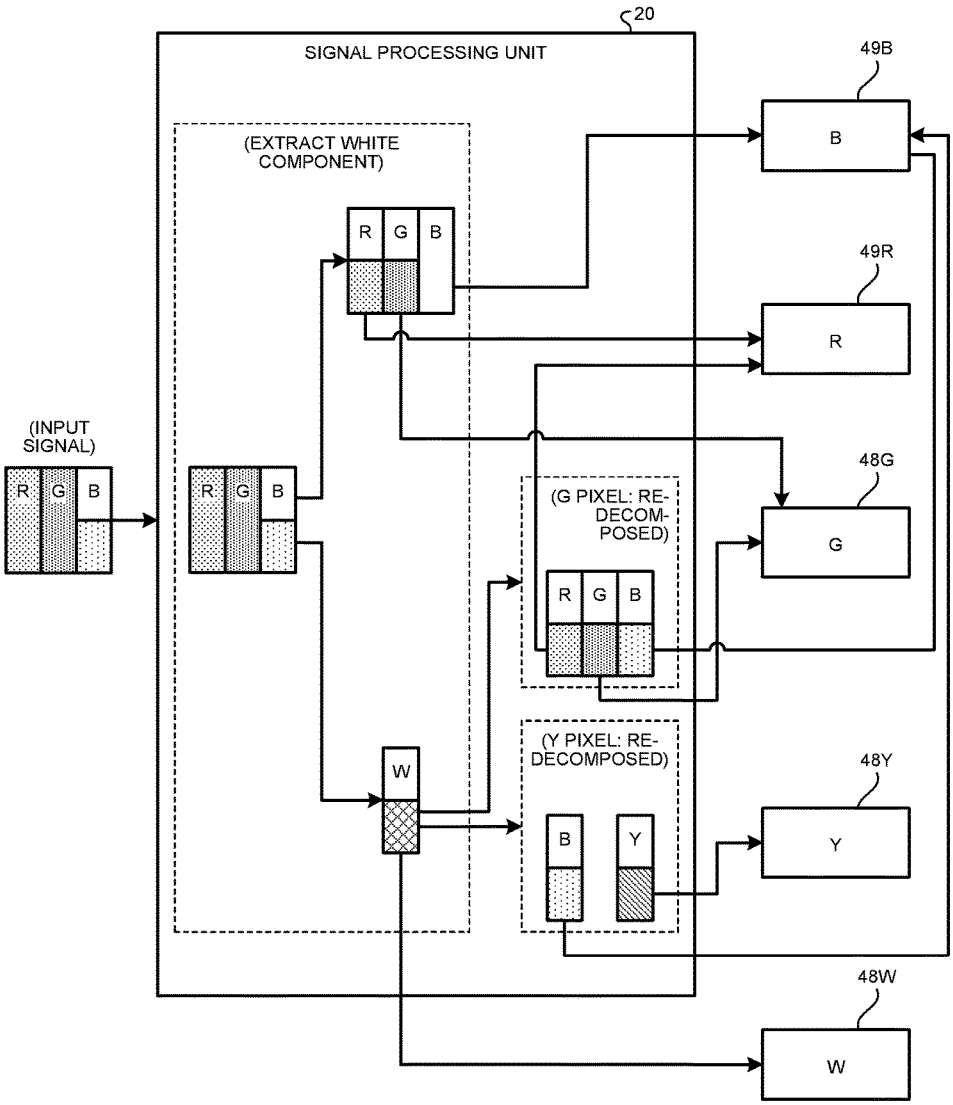
FIG. 48 is a diagram illustrating an example of details of processing performed by a signal processing unit according to a fifth embodiment.

FIG. 48 is a diagram illustrating an example of details of processing performed by the signal processing unit 20 according to the fifth embodiment. In the fifth embodiment, white (W), yellow (Y), and green (G) are employed as colors of the pixels 48. The signal processing unit 20 according to the fifth embodiment extracts the white component as a component that can be output as white from the color components indicated by the input signal, assigns the extracted white component to the pixel 48W serving as the pixel of white (W), or to either the pixel 48Y serving as the pixel of yellow (Y) or a pixel 48G serving as a pixel of green (G) and a sub-pixel 49 of a color that can reproduce intensity of white light by being combined with a color of either of the pixels, and assigns, to the sub-pixels 49, the components other than the white component that can be reproduced with the colors of the sub-pixels 49 in the color components indicated by the input signal. Specifically, the signal processing unit 20 according to the fifth embodiment performs processing related to output from the pixel 48W in a similar manner to the processing related to the output from the pixel 48 according to the first embodiment. The signal processing unit 20 according to the fifth embodiment performs processing related to output from the pixel 48Y as the pixel of yellow (Y) in a similar manner to the processing related to the output from the pixel 48Y according to the fourth embodiment. Regarding the pixel 48G as the pixel of green (G), the signal processing unit 20 re-decomposes the white component into the red component, the green component, and the blue component, assigns the red component to the first sub-pixel 49R, the green component to the pixel 48G, and the blue component to the third sub-pixel 49B.

The pixel 48G as the pixel of green (G) has higher luminance than that of the first sub-pixel 49R as the sub-pixel of red (R) and the third sub-pixel 49B as the sub-pixel of blue (B). Due to this, the luminance center of gravity is present on the pixel 48G side when the pixel 48G, the first sub-pixel 49R, and the third sub-pixel 49B emit light for reproducing the white component. When visually recognizing such a display region including the pixel 48G, the first sub-pixel 49R, and the third sub-pixel 49B, the user recognizes that the light source of white light is lit at the position of the pixel 48G. Due to this mechanism, the display device according to the fifth embodiment obtains real resolution.

The fifth embodiment can be combined with any one of the first to the third embodiments and the modifications thereof. The fifth embodiment is the same as the first embodiment except in the feature described above.

As described above, according to the fifth embodiment, green (G) is assigned to pixels 48, so that the numbers of sub-pixels of red (R) and blue (B) can more easily be increased than in the other embodiments. Hence, a larger number of sub-pixels 49 can be used to output the red component and the blue component among the color components indicated by the input signal, and the resolution can be more easily increased in the output related to these color components.

Sixth Embodiment

Next, the following describes a sixth embodiment. A display device 10*c* according to the sixth embodiment is different from the display device 10 according to the first to the third embodiments in that the image display panel is a reflective liquid crystal display panel. The display device 10*c* according to the sixth embodiment has the same configurations as those in the first to the third embodiments except for the image display panel, so that descriptions thereof will not be repeated.

Figure 49:
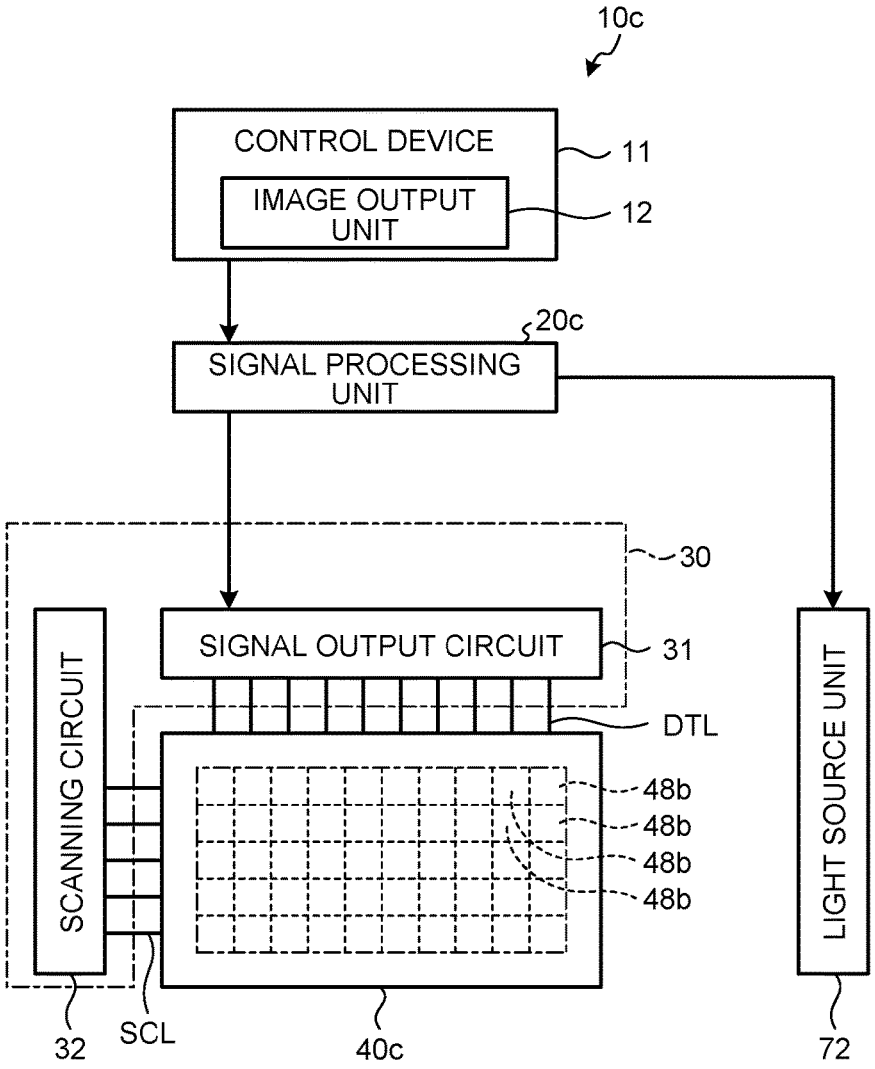
FIG. 49 is a block diagram illustrating an example of a configuration of a display device according to a sixth embodiment.

FIG. 49 is a block diagram illustrating an example of the configuration of the display device 10*c* according to the sixth embodiment. As illustrated in FIG. 49, the display device 10*c* according to the sixth embodiment includes a signal processing unit 20*c*, an image display panel 40*c*, and a light source unit 72. The display device 10*c* causes the image display panel 40*c* to reflect external light to display an image. In a case of being used outdoors at night or used in a dark place in which external light is insufficient, the display device 10*c* can display an image by reflecting light emitted from the light source unit 72 on the image display panel 40*c*.

Figure 50:
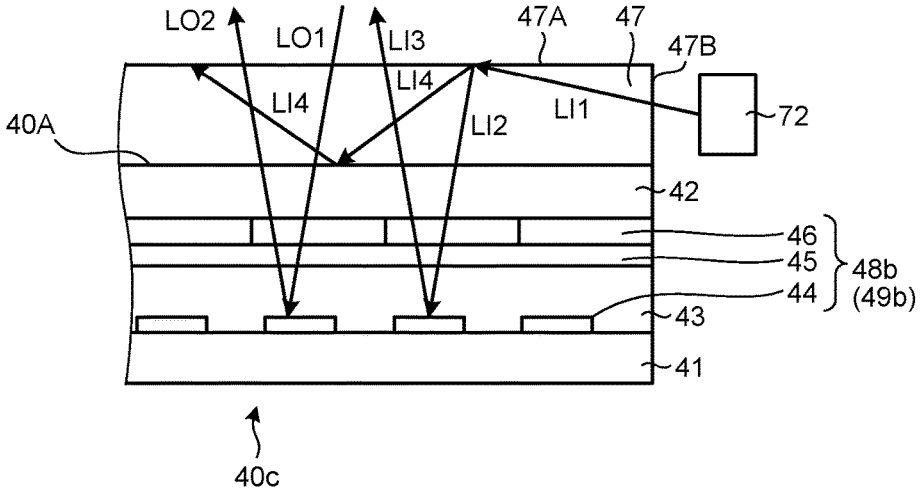
FIG. 50 is a sectional view schematically illustrating a structure of an image display panel according to the sixth embodiment.

FIG. 50 is a sectional view schematically illustrating a structure of the image display panel according to the sixth embodiment. As illustrated in FIG. 50, the image display panel 40*c* includes an array substrate 41 and a counter substrate 42 opposed to each other, and a liquid crystal layer 43 in which liquid crystal elements are sealed is arranged between the array substrate 41 and the counter substrate 42.

A plurality of pixel electrodes 44 are arranged on a surface of the array substrate 41 on the liquid crystal layer 43 side. The pixel electrode 44 is coupled to the signal line DTL via the switching element, and receives an image output signal as a video signal applied thereto. Each of the pixel electrodes 44 is, for example, a reflective member made of aluminum or silver, and reflects external light or light from the light source unit 72. That is, in the sixth embodiment, the pixel electrode 44 constitutes a reflection unit, and the reflection unit reflects light emitted from a front surface (a surface on which an image is displayed) of the image display panel 40*c* to display an image.

The counter substrate 42 is a transparent substrate made of glass, for example. The counter substrate 42 includes a counter electrode 45 and a color filter 46 arranged on a surface thereof on the liquid crystal layer 43 side. More specifically, the counter electrode 45 is arranged on a surface of the color filter 46 on the liquid crystal layer 43 side.

The counter electrode 45 is made of a transparent conductive material such as indium tin oxide (ITO) or indium zinc oxide (IZO), for example. The counter electrode 45 is coupled to the switching element to which the pixel electrode 44 is coupled. The pixel electrode 44 and the counter electrode 45 are arranged being opposed to each other, so that, when a voltage caused by the image output signal is applied between the pixel electrode 44 and the counter electrode 45, the pixel electrode 44 and the counter electrode 45 generate an electric field in the liquid crystal layer 43. The liquid crystal elements are twisted due to the electric field generated in the liquid crystal layer 43 and a double refractive index is changed. The display device 10*c* adjusts an amount of light reflected from the image display panel 40*c*. The image display panel 40*c* is what is called a vertical electric field type image display panel. Alternatively, the image display panel 40*c* may be a horizontal electric field type image display panel that causes an electric field to be generated in a direction parallel with a display surface of the image display panel 40*c*.

A plurality of color filters 46 are arranged corresponding to the pixel electrodes 44. The pixel electrode 44, the counter electrode 45, and the color filter 46 constitute a pixel 48*b* and a sub-pixel 49*b* according to the sixth embodiment. A light guide plate 47 is arranged on a surface of the counter substrate 42 opposite to the liquid crystal layer 43 side. The light guide plate 47 is made of a transparent plate member such as an acrylic resin, a polycarbonate (PC) resin, and a methylmethacrylate-styrene copolymer (MS resin), for example. Prism processing is performed on an upper surface 47A of the light guide plate 47 opposite to the counter substrate 42 side.

The light source unit 72 is an LED in the sixth embodiment. As illustrated in FIG. 50, the light source unit 72 is arranged along a side surface 47B of the light guide plate 47. The light source unit 72 irradiates the image display panel 40*c* with light from the front surface of the image display panel 40*c* via the light guide plate 47. The light source unit 72 is turned ON/OFF through an operation performed by an image observer, or using an external light sensor and the like that is attached to the display device 10*c* to measure external light. The light source unit 72 emits light in an ON state, and does not emit light in an OFF state. For example, when the image observer feels that the image is dark, the image observer turns ON the light source unit 72, and causes the light source unit 72 to irradiate the image display panel 40*c* with light to brighten the image. When the external light sensor determines that external light intensity is smaller than a predetermined value, for example, the signal processing unit 20*c* turns ON the light source unit 72 and causes the light source unit 72 to irradiate the image display panel 40*c* with light to brighten the image.

Next, the following describes reflection of light from the image display panel 40*c*. As illustrated in FIG. 50, external light LO1 is incident on the image display panel 40*c*. The external light LO1 is incident on the pixel electrode 44 through the light guide plate 47 and the inside of the image display panel 40*c*. The external light LO1 incident on the pixel electrode 44 is reflected from the pixel electrode 44, and emitted to the outside as light LO2 through the inside of the image display panel 40*c* and the inside of the light guide plate 47. When the light source unit 72 is turned ON, light LI1 from the light source unit 72 enters the light guide plate 47 through the side surface 47B of the light guide plate 47. The light LI1 that has entered the light guide plate 47 is scattered by and reflected from the upper surface 47A of the light guide plate 47, and part of the light LI1 enters the image display panel 40*c* as light LI2 from the counter substrate 42 side of the image display panel 40*c* to be emitted to the pixel electrode 44. The light LI2 emitted to the pixel electrode 44 is reflected from the pixel electrode 44, and emitted to the outside as light LI3 through the image display panel 40*c* and the light guide plate 47. The other part of the light scattered by the upper surface 47A of the light guide plate 47 is reflected as light LI4, is further reflected from a boundary surface 40A between the light guide plate 47 and the counter substrate 42, and is repeatedly reflected in the light guide plate 47.

That is, the pixel electrode 44 reflects the external light LO1 or the light LI2 to the outside, the external light LO1 or the light LI2 being incident on the image display panel 40*c* from the front surface as a surface on an outer side (the counter substrate 42 side) of the image display panel 40*c*. The light LO2 and the light LI3 reflected to the outside pass through the liquid crystal layer 43 and the color filter 46. Accordingly, the display device 10*c* can display an image with the light LO2 and the light LI3 reflected to the outside. As described above, the display device 10*c* according to the sixth embodiment is a reflective display device including the light source unit 72 of front light type and edge light type. In the sixth embodiment, the display device 10*c* includes the light source unit 72 and the light guide plate 47. However, the display device 10*c* does not necessarily include the light source unit 72 or the light guide plate 47. In this case, the display device 10*c* can display an image with the light LO2 obtained by reflecting the external light LO1.

Characteristics of the pixel 48*b* such as a color to be assigned (white, yellow, or green as the high luminance color) are the same as those of the pixel 48 in the first embodiment except that the pixel 48*b* is a pixel of the reflective liquid crystal display panel. Characteristics of the sub-pixel 49*b* such as a color to be assigned (white, yellow, or green as the high luminance color) are the same as those of the sub-pixel 49 in the first embodiment except that the sub-pixel 49*b* is a sub-pixel of the reflective liquid crystal display panel.

As described above, according to the sixth embodiment, the same advantages as those in the first to the fifth embodiments and the modifications thereof (embodiments and the like) can be obtained by employing the arrangement of the pixels 48 and the sub-pixels 49 and the signal processing performed by the signal processing unit 20 according to any of the embodiments and the like.

The colors and the arrangements of the pixels 48 and the sub-pixels 49 in the embodiments and the like described above are merely an example, and not limited thereto. The colors and the arrangements thereof can be appropriately modified within a range specified by matters specifying the claimed invention. For example, any ratio among colors of the pixels 48 can be set in the fourth and the fifth embodiments. The color of the pixel 48W according to the fourth and the fifth embodiments may be replaced with a color of another pixel 48. The color or colors of any or all of the pixels 48W, 48Y, and 48G may be replaced with a color or colors (for example, cyan (C), etc.) having higher luminance than those of colors of the sub-pixels 49. In the embodiments and the like, the row direction and the column direction may be exchanged.

The present invention naturally encompasses other working effects caused by the aspects described in the above embodiments that are obvious from the description herein or that are conceivable as appropriate by those skilled in the art.

The present invention can include the following aspects:

(1) A display device comprising:

a display panel including:

sub-pixels of three primary colors, and pixels having a high-luminance color having higher luminance than that of the primary colors, wherein the three primary colors include a first primary color, a second primary color, and a third primary color, the number of the sub-pixels is smaller than twice the number of the pixels, sub-pixels of the same color are arranged at even intervals in a row direction and at even intervals in a column direction, and the sub-pixels of the same color are arranged in a staggered manner.

(2) The display device according to (1), wherein one of the sub-pixels having the first primary color, one of the sub-pixels having the second primary color, and one of the sub-pixels having the third primary color are adjacent to each of the pixels.

(3) A display device comprising a display panel including:

sub-pixels of three primary colors, and pixels having a high-luminance color having higher luminance than that of the primary colors, wherein the three primary colors include a first primary color, a second primary color, and a third primary color, the number of the sub-pixels is smaller than twice the number of the pixels, and sub-pixels of the same color are arranged in a matrix along row and column directions.

(4) The display device according to any one of (1) to (3), wherein the pixels are arranged in a matrix along the row and column directions.

(5) The display device according to (1) or (2), wherein the pixels are arranged in a staggered manner.

(6) The display device according to any one of (1) to (5), wherein the numbers of the pixels in the row direction and the column direction are the same as the numbers of pieces of pixel data constituting an image to be displayed by the display device in the row direction and the column direction.

(7) The display device according to any one of (1) to (6), further comprising a signal processing unit configured to extract a white component that is outputtable as white from color components of an input signal indicating gradation values of pixel data constituting an image to be displayed by the display panel, to assign the extracted white component to the pixels, and to assign components other than the white component among the color components to the sub-pixels.

The present invention can also include the following aspects:

(A) A display device comprising sub-pixels of three primary colors and pixels having a high-luminance color having higher luminance than that of the primary colors, wherein the three primary colors include a first primary color, a second primary color, and a third primary color, sub-pixels of the same color are arranged at even intervals in a row direction and at even intervals in a column direction, the sub-pixels of the same color are arranged in a staggered manner, and the pixels are arranged in a matrix along the row and column directions.

(B) The display device according to (A), wherein one of the sub-pixels having the first primary color, one of the sub-pixels having the second primary color, and one of the sub-pixels having the third primary color are adjacent to each of the pixels.

(C) The display device according to (B), wherein the pixels are trapezoidal, and two parallel sides of each of the pixels along a predetermined direction have lengths at a ratio of 1 to 2, and two sides of each of the sub-pixels along the predetermined direction have the same length as a length of shorter one of the two parallel sides of the pixel.

(D) The display device according to (B), wherein the pixels and the sub-pixels are rectangular, and parallel sides of each of the pixels that extend along a predetermined direction and that are adjacent to the sub-pixels have a length 1.5 times a length of a side along the predetermined direction of each of the sub-pixels.

(E) The display device according to (B), wherein the pixels and the sub-pixels are arranged along a first direction in different rows, and pixel rows and sub-pixel rows are alternately arranged along a second direction orthogonal to the first direction, and when an intermediate line between sub-pixels of two of the colors in one of two sub-pixel rows facing each other with one of the pixel rows interposed between the two sub-pixel rows is extended along the second direction, an intermediate position in the first direction of a sub-pixel of the other one color in the other of the two rows is on the extended intermediate line.

(F) The display device according to (E), wherein a width in the first direction of the sub-pixel is equal to or larger than a width in the first direction of the pixel, and the width in the first direction of the sub-pixel is smaller than twice the width in the first direction of the pixel.

(G) The display device according to (E), wherein a width in the first direction of the sub-pixel is twice a width in the first direction of the pixel, and a boundary line between two pixels in each of the pixel rows is not located on the extended line of the intermediate line between sub-pixels of the two colors in one of the two sub-pixel rows.

(H) The display device according to (G), wherein the pixels have a hexagonal shape having acute angles on one side and obtuse angles on the other side, and the sub-pixels have a shape meshing with the hexagonal pixels.

(I) The display device according to (H), wherein the sub-pixels are pentagonal or hexagonal.

(J) The display device according to (H), wherein the sub-pixels are rhombic or triangular.

(K) The display device according to (B), wherein the pixels and the sub-pixels are alternately arranged with respect to two orthogonal directions.

(L) The display device according to (B), wherein the pixels and the sub-pixels are hexagonal.

(M) A display device comprising:

sub-pixels of three primary colors including a first primary color, a second primary color, and a third primary color; and pixels having a high-luminance color having higher luminance than that of the primary colors, wherein sub-pixels of the same color are arranged at even intervals in a row direction and at even intervals in a column direction, and the sub-pixels of the same color and the pixels are arranged in a staggered manner.

(N) The display device according to (M), wherein one of the sub-pixels having the first primary color, one of the sub-pixels having the second primary color, and one of the sub-pixels having the third primary color are adjacent to each of the pixels.

(O) The display device according to (M), wherein the pixels and the sub-pixels are triangular.

(P) The display device according to (M), wherein the pixels are hexagonal, and the sub-pixels have a Y-shape that fills gaps between the pixels.

(Q) The display device according to (M), wherein the pixels and the sub-pixels are rectangular, and a width in the row direction of the sub-pixels exceeds twice a width in the row direction of the pixels.

(R) A display device comprising:

sub-pixels of three primary colors including a first primary color, a second primary color, and a third primary color; and pixels having a high-luminance color having higher luminance than that of the primary colors, wherein sub-pixels of the same color are arranged at even intervals in a row direction and at even intervals in a column direction, and the sub-pixels of the same color and the pixels are arranged in a matrix along the row and column directions.

(S) The display device according to (R), wherein the pixels and the sub-pixels each have a shape in which diagonals of the shape are along two orthogonal directions.

(T) The display device according to (R), wherein a width in a predetermined direction of the sub-pixels is 1.5 times a width in the predetermined direction of the pixels.

What is claimed is:

1. A display device having a display panel including unit pixels each being used to output one set of RGB data indicated by an input signal, the display panel comprising:

sub-pixels of three primary colors including a first sub-pixel of a first primary color, a second sub-pixel of a second primary color, and a third sub-pixel of a third primary color; and pixels having a high-luminance color having higher luminance than that of the primary colors, wherein the unit pixel regions each have an upper portion and a lower portion, and the unit pixel regions include:

a first first-unit pixel region including the first sub-pixel in the upper portion, and including the second sub-pixel and the third sub-pixel that have staggered positional relationships with the first sub-pixel and that are disposed in the lower portion;

a second first-unit pixel region including the second sub-pixel in the upper portion, and including the third sub-pixel and the first sub-pixel that have staggered positional relationships with the second sub-pixel and that are disposed in the lower portion;

a third first-unit pixel region including the third sub-pixel in the upper portion, and including the first sub-pixel and the second sub-pixel that have staggered positional relationships with the third sub-pixel and that are disposed in the lower portion;

a first second-unit pixel region including the first sub-pixel in the lower portion, and including the second sub-pixel and the third sub-pixel that have staggered positional relationships with the first sub-pixel and that are disposed in the upper portion;

a second second-unit pixel region including the second sub-pixel in the lower portion, and including the third sub-pixel and the first sub-pixel that have staggered positional relationships with the second sub-pixel and that are disposed in the upper portion;

a third second-unit pixel region including the third sub-pixel in the lower portion, and including the first sub-pixel and the second sub-pixel that have staggered positional relationships with the third sub-pixel and that are disposed in the upper portion.

* * * * *